US006815156B2

(12) United States Patent
Hosoya

(10) Patent No.: US 6,815,156 B2
(45) Date of Patent: Nov. 9, 2004

(54) SILVER HALIDE EMULSION

(75) Inventor: Yoichi Hosoya, Minami-Ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/146,922

(22) Filed: May 17, 2002

(65) Prior Publication Data

US 2003/0064334 A1 Apr. 3, 2003

(30) Foreign Application Priority Data

May 21, 2001 (JP) ..... 2001-151389
Oct. 19, 2001 (JP) ..... 2001-322065

(51) Int. Cl.[7] ..... G03C 1/00
(52) U.S. Cl. ..... 430/567
(58) Field of Search ..... 430/567

(56) References Cited

U.S. PATENT DOCUMENTS 5,472,836 A * 12/1995 Haga ..... 430/567
5,587,281 A * 12/1996 Saitou et al. ..... 430/567

FOREIGN PATENT DOCUMENTS

EP 0615157 A2 9/1994
JP 11-174606 * 7/1999

* cited by examiner

*Primary Examiner*—Thorl Chea
(74) *Attorney, Agent, or Firm*—Sughrue Mion, PLLC

(57) ABSTRACT

A silver halide emulsion containing a dispersion medium and silver halide grains, wherein the silver halide grains have a variation coefficient of projected area diameters of 30% or less and 50% or more of the total projected area of the silver halide grains is occupied by silver halide grains satisfying the following requirements (a), (b), (c) and (d): (a) a hexagonal tabular silver halide grain having a smooth (111) face as a principal plane; (b) the silver iodide content is 7 mol % or more; (c) the projected area diameter is 3 $\mu$m or more; and (d) the aspect ratio is 8 or more.

8 Claims, No Drawings

SILVER HALIDE EMULSION

CROSS-REFERENCE TO RELATED APPLICATIONS

This application is based upon and claims the benefit of priority from the prior Japanese Patent Applications No. 2001-151389, filed May 21, 2001; and No. 2001-322065, filed Oct. 19, 2001, the entire contents of both of which are incorporated herein by reference.

BACKGROUND OF THE INVENTION

1. Field of the Invention

The present invention relates to a silver halide emulsion that is excellent in the ratio of sensitivity/granularity and is useful as, in particular, an emulsion for forming a blue-sensitive layer.

2. Description of the Related Art

In the field of silver halide photographic lightsensitive materials, silver halide tabular grains have become to be used widely because of their many advantages; their recent technical development is remarkable.

As a composition of silver halide grains, silver iodobromide (also including silver iodochlorobromide)-based compositions are mainly employed in color photographic light-sensitive materials except color paper. A silver iodobromide grain contains silver iodide in a silver bromide crystal lattice in an amount not more than a solid solubility limit in the silver bromide (that is, at a silver iodide content not more than 40 mol %). Silver iodobromide has advantages over silver bromide, such as improvement in latent image-forming efficiency, improvement in light absorption (absorption inherent to silver halide), improvement in adsorption of addition adsorbant, and improvement in graininess. On the other hand, drawbacks of silver iodobromide include inhibition of development and chemical sensitization inhibition. Many researches have been made to solve such drawbacks. In Duffin, Photgraphic Emulsion (Focal Press, 1966) p. 18, there is a statement "In the case of silver iodobromide emulsions, an important factor to be considered is the position of an iodide. An iodide may be present mainly in a central region of a crystal, throughout a grain or mainly in a perimeter surface. The practical position of an iodide depends on preparation conditions and have clear effects on physical and chemical characteristics of a crystal." A core-shell silver iodobromide emulsion is a technology for overcoming the drawbacks of the aforementioned silver iodobromide and for improving photographic properties and has been recognized in the art. U.S. Pat. No. 1,027,146 describes the concept of that emulsion. Bndou et al., "Photographic Silver Halide Emulsion Containing Double Structure Grains" J. Imag. Sci., Vol. 29, No. 5, 193–195 (1985) demonstrates the fact that a grain of a double structure shows an enhanced blue absorption and exhibits a good development activity due to an octahedral structure.

On the other hand, the fact that silver iodobromide grains have a microscopic distribution of silver iodide has been reported by M. King et al. in "Progress in Basic Principles of Imaging Systems," reported in International Congress of Photographic Science held in Cologne (1986) and by Y. T. Tan et al., in SPSE, the 41st annual meeting. In Jpn. Pat. Appln. KOKAI Publication No. (hereinafter referred to as JP-A-)1-183644, a silver halide grain having no microscopic distribution of silver iodide and having a completely uniform silver iodobromide layer has been disclosed.

Since the absorption of blue light is increased when the silver iodide content in a silver iodobromide grain is increased, silver halide grains having a high silver iodide content are suitable for an emulsion to be used particularly for a blue-sensitive layer.

In formation of tabular grains having a high silver iodide content, grain formation has become more difficult, for example, a distribution of silver iodide contents between grains has become greater or a distribution of grain sizes has become greater.

In JP-A-6-332092, a silver halide emulsion having a narrow distribution of silver iodide contents between grains is disclosed. JP-A-11-174606 describes a tabular silver halide grain emulsion having a silver iodide content of from 4 to 15 mol %, a thickness of 0.07 $\mu$m or less, and a variation coefficient of projected area diameters (diameters of circles each having the same area as a projected area) of less than 30%. In JP-A-10-293372, a manufacture method is disclosed in which projected area diameters of tabular silver iodobromide grains are monodispersed through formation of silver halide nuclei with a high silver chloride content in a nucleation step. As described above, advance in technique for forming tabular silver iodobromide grains has made possible to obtain silver iodobromide emulsions having a narrow distribution of silver iodide contents between grains and silver iodobromide emulsions having a small variation coefficient of projected area diameters. However, to further enhance sensitivity, silver halide grains having a larger size and/or silver halide grains having a larger aspect ratio (projected area diameter/thickness) are desired. Particularly, as emulsions for blue-sensitive layers, silver halide tabular grain emulsions are desired which have a high silver iodide content, a large size and/or a large aspect ratio, a small distribution of silver iodide contents and a small distribution of projected area diameters.

BRIEF SUMMARY OF THE INVENTION

A principal object of the present invention is to provide a silver halide photographic emulsion containing silver halide grains excellent in photographic properties, particularly, sensitivity/granularity, sharpness, gradation and the like, the emulsion being an emulsion of tabular silver halide grains having a high silver iodide content, a large size and/or aspect ratio, a small distribution in silver iodide content and a small distribution in projected area diameter; the emulsion is henceforth also called an "emulsion of the present invention."

The task of the present invention has successfully been attained by the following approaches:

(1) A silver halide emulsion containing a dispersion medium and silver halide grains, wherein the silver halide grains have a variation coefficient of projected area diameters of 30% or less and 50% or more of the total projected area of the silver halide grains is occupied by silver halide grains satisfying the following requirements (a), (b), (c) and (d):

(a) a hexagonal tabular silver halide grain having a smooth (111) face as a principal plane;

(b) the silver iodide content is 7 mol % or more;

(c) the projected area diameter is 3 $\mu$m or more; and (d) the aspect ratio is 8 or more.

(2) The silver halide emulsion according to item (1) above, wherein the silver halide grains occupying 50% or more of the total projected area satisfy requirement (e) below as well as requirements of from (a) to (d):

(e) the ratios of the areas of (100) faces relative to the average area of the side surface calculated from the average projected area and the average thickness of all the grains are 50% or more.

(3) The silver halide emulsion according to item (1) above, wherein the silver halide grains occupying 50% or more of the total projected area satisfy requirement (f) below as well as requirements of from (a) to (d):

(f) the equivalent-sphere diameter is 1.2 $\mu$m or more.

(4) The silver halide emulsion according to item (2) above, wherein the silver halide grains occupying 50% or more of the total projected area satisfy requirement (f) below as well as requirements of from (a) to (e):

(f) the equivalent-sphere diameter is 1.2 $\mu$m or more.

(5) The silver halide emulsion according to item (1) above, wherein the silver halide grains occupying 50% or more of the total projected area satisfy requirement (g) below as well as requirements of from (a) to (d):

(g) the grains have at least ten dislocation lines per grain.

(6) The silver halide emulsion according to item (2) above, wherein the silver halide grains occupying 50% or more of the total projected area satisfy requirement (g) below as well as requirements of from (a) to (e):

(g) the grains have at least ten dislocation lines per grain.

(7) The silver halide emulsion according to item (3) above, wherein the silver halide grains occupying 50% or more of the total projected area satisfy requirement (g) below as well as requirements of from (a) to (d) and (f):

(g) the grains have at least ten dislocation lines per grain.

(8) The silver halide emulsion according to item (4) above, wherein the silver halide grains occupying 50% or more of the total projected area satisfy requirement (g) below as well as requirements of from (a) to (f):

(g) the grains have at least ten dislocation lines per grain.

(9) The silver halide emulsion according to item (1) above, wherein the silver halide grains occupying 50% or more of the total projected area satisfy requirement (h) below as well as requirements of from (a) to (d):

(h) the grains have, in their vertex portions and/or peripheral portions and/or principal plane portions, at least one epitaxial junction per grain.

(10) The silver halide emulsion according to item (2) above, wherein the silver halide grains occupying 50% or more of the total projected area satisfy requirement (h) below as well as requirements of from (a) to (e):

(h) the grains have, in their vertex portions and/or peripheral portions and/or principal plane portions, at least one epitaxial junction per grain.

(11) The silver halide emulsion according to item (3) above, wherein the silver halide grains occupying 50% or more of the total projected area satisfy requirement (h) below as well as requirements of from (a) to (d) and (f):

(h) the grains have, in their vertex portions and/or peripheral portions and/or principal plane portions, at least one epitaxial junction per grain.

(12) The silver halide emulsion according to item (4) above, wherein the silver halide grains occupying 50% or more of the total projected area satisfy requirement (h) below as well as requirements of from (a) to (f):

(h) the grains have, in their vertex portions and/or peripheral portions and/or principal plane portions, at least one epitaxial junction per grain.

(13) The silver halide emulsion according to item (5) above, wherein the silver halide grains occupying 50% or more of the total projected area satisfy requirement (h) below as well as requirements of from (a) to (d) and (g):

(h) the grains have, in their vertex portions and/or peripheral portions and/or principal plane portions, at least one epitaxial junction per grain.

(14) The silver halide emulsion according to item (6) above, wherein the silver halide grains occupying 50% or more of the total projected area satisfy requirement (h) below as well as requirements of from (a) to (e) and (g):

(h) the grains have, in their vertex portions and/or peripheral portions and/or principal plane portions, at least one epitaxial junction per grain.

(15) The silver halide emulsion according to item (7) above, wherein the silver halide grains occupying 50% or more of the total projected area satisfy requirement (h) below as well as requirements of from (a) to (d), (f) and (g):

(h) the grains have, in their vertex portions and/or peripheral portions and/or principal plane portions, at least one epitaxial junction per grain.

(16) The silver halide emulsion according to item (8) above, wherein the silver halide grains occupying 50% or more of the total projected area satisfy requirement (h) below as well as requirements of from (a) to (g):

(h) the grains have, in their vertex portions and/or peripheral portions and/or principal plane portions, at least one epitaxial junction per grain.

(17) The silver halide emulsion according to any one of items (1) to (16) above, wherein, during its production, the growth of the grains corresponding to at least 50% of the whole silver amount is carried out by adding, at the same time as the addition of an aqueous silver salt solution and an aqueous halide salt solution, silver iodide fine grains and/or silver iodobromide fine grains formed outside a vessel in which the growth is being conducted to the vessel.

(18) The silver halide emulsion according to item (17) above, wherein the silver iodide fine grains and/or the silver iodobromide fine grains are added while being prepared continuously to a reaction vessel in which the growth of the grain is carried out.

(19) A silver halide photographic lightsensitive material comprising at least one silver halide emulsion layer on a support, wherein at least one of the emulsion layers contains the silver halide emulsion according to any of items (1) to (18) above.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

DETAILED DESCRIPTION OF THE INVENTION

The present invention will be described in detail below.

The silver halide emulsion in the present invention is preferably silver iodobromide and silver iodochlorobromide. With respect to the shape of the silver halide grains, tabular grains are preferred.

In the present invention, "tabular grain" means a silver halide grain having two parallelly facing (111) principal planes. The tabular grains of the present invention have one twin face or two or more parallel twin faces. The twin face refers to the (111) face on both sides of which the ions of all the lattice points are in the relationship of reflected images.

The tabular grains, as viewed from above position, have a triangular, tetragonal or hexagonal shape, or a circular shape as resulting from rounding thereof. The triangular, hexagonal and circular tabular grains have triangular, hexagonal and circular mutually parallel external surfaces, respectively.

The projected area diameter and grain thickness of tabular grains can be determined by taking a transmission electron micrograph according to the replica method and, from the transmission electron micrograph, measuring the diameter of a circle having the same area as the projected area of each individual grain (projected area diameter) and the thickness thereof. In this method, the thickness can be calculated from the length of the shadow of the replica.

In the silver halide emulsion of the present invention, 50% or more of total projected area of the silver halide grains contained therein is accounted for by hexagonal tabular grains projected area diameter of which is 3 $\mu$m or more and aspect ratio of which is 8 or more.

Further, the hexagonal tabular grains preferably have a projected area diameter of 3.0 $\mu$m or more and 20.0 $\mu$m or less, and more preferably 4.0 $\mu$m or more and 10.0 $\mu$m or less. The grains preferably have an equivalent-sphere diameter of 1.2 $\mu$m or more and 5.0 $\mu$m or less, and more preferably 1.5 $\mu$m or more and 4 $\mu$m or less. "Equivalent-sphere diameter" means a diameter of a sphere having a volume equal to that of an individual grain. The aspect ratio is preferably 8 or more and 100 or less, and more preferably 10 or more and 50 or less. "Aspect ratio" means the quotient of the projected area diameter of a grain divided by the thickness of the grain.

The emulsion of the present invention is preferably monodisperse. The variation coefficient of the equivalent-sphere diameters of all the silver halide grains constituting the emulsion of the present invention is preferably 30% or less, more preferably 25% or less. In the cases of tabular grains, the variation coefficient of projected area diameters is also important. The variation coefficient of the projected area diameters of all the silver halide grains constituting the emulsion of the present invention is 30% or less, more preferably 25% or less. The variation coefficient of thicknesses of the tabular grains is preferably 30% or less, more preferably 25% or less. "Variation coefficient" means the quotient of the standard deviation of the distribution of the equivalent diameters of the individual silver halide grains divided by the average equivalent diameter, or the quotient of the standard deviation of the distribution of the thicknesses of the individual tabular silver halide grains divided by the average thickness.

In the present invention, the content of silver iodide contained in the aforesaid hexagonal tabular silver halide grain, relative to the amount of the whole silver in the grain, is preferably 7 mol % or more and 20 mol % or less, and more preferably 8 mol % or more and 20 mol % or less. The content of silver chloride is preferably 10 mol % or less relative to the amount of the whole silver in the grain.

In the emulsion of the present invention, the relative standard deviation of the distribution of silver iodide contents between grains is preferably 20% or less, and more preferably 10% or less. The relative standard deviation of the distribution of silver iodide contents between grains can be easily obtained by EPMA method (Electron-Probe Micro Analyzer method). In this method, a sample in which emulsion grains are well dispersed so as not to come into contact with each other is prepared and the sample is irradiated with electron beams. X-ray analysis utilizing excitation caused by electron beams allows elemental analysis in a very minute area. When the intensities of the characteristic X-rays of silver and iodine emitted from each individual grain are determined using the above method, the halogen composition of each grain can be determined. If the halogen composition is determined by the EPMA method for at least 100 grains in an emulsion, it is possible to judge whether or nor the emulsion is an emulsion of the present invention. "Relative standard deviation of the distribution of silver iodide contents" means a value obtained by dividing the standard deviation of the distribution of the silver iodide contents of at least 100 grains by the average silver iodide content to obtain a quotient and then multiplying the quotient by 100.

In the silver halide emulsion of the present invention, it is preferable that the ratios of the areas of (100) faces to the average area of the side surfaces calculated from the average projected area diameter and the average thickness of all the grains are 50% or more. Concretely, they are preferably 50% or more and 100% or less, and more preferably 50% or more and 90% or less. "Side surface" indicates a portion located between two parallel principal planes, and the area thereof can be calculated from the measurements of the average projected area diameter and the average thickness of all the grains determined by taking transmission electron micrographs by the aforementioned replica technique. For observation of crystal surfaces of a tabular grain can be applied the method disclosed in the report, T. Tani et al J. Img. Sci, 29 165–171(1985). Concretely, the ratio of the area of the (100) faces to the (111) faces can be obtained using this method, and, from the ratio obtained above, the ratio of the area of the grains having a (100) face as its principal plane to the average area of the side surfaces can be caluculated.

The tabular silver halide grains contained in the emulsion of the present invention may preferably have a so-called core/shell structure comprising a core and a shell surrounding the core, the core and the shell differing in silver iodide content. The shell may surround the entire core, or may surround only the side surface of the tabular grain of the core, or may surround only the principal plane portions. The number of the shells may be one or may be two or more. If the number of the shells is two or more, the shell located just outside the core is called a first shell, the shell located just outside the first shell is called a second shell, and shells located outside in order are called, for example, a third shell and a fourth shell. In the present specification, "outermost layer" refers to the shell that is located outermost.

In the silver halide grains in the present invention, it is preferable that there is a dislocation line in a region within 20%, more preferably within 10%, in terms of area from the periphery of a projected grain. The dislocation line may either extend near a periphery along the periphery or exist locally in the vicinity of a vertex portion. The expression "vicinity of a vertex portion" refers to three-dimensional portions each defined by sides making each vertex and perpendiculars to the sides, the perpendiculars drawn from a point positioned on a straight line combining the grain center and the vertex at a distance of x%, based on the line length, from the grain center. The value of x is preferably in the range of 50 to less than 100, more preferably 75 to less than 100. The average number of the dislocation lines present is preferably 10 or more, and more preferably 20 or more per grain.

In the silver halide emulsion of the present invention, it is preferable that silver halide grains accounting for 50% or more of total projected area have at least one epitaxial junction in each grain. Epitaxial junction refers to a junction of a crystal protruding outwardly to a surface of a tabular grain. The crystal composition of an epitaxial portion may be the same as, but is preferably different from, that of the silver halide tabular grain, which is a base. Specific examples include AgBr, AgCl, AgI, AgBrI, AgClI, AgBrCl, AgBrClI and AgSCN. The epitaxial junction may be formed at any position in the vertex portions, the periphery portion and the principal plane portions of a tabular grain and also may spread two or more positions. The vertex portions refer to the six vertexes of a hexagonal tabular grain. The periphery portion refers to the six sides of a hexagonal tabular grain and the surface connecting the two principal planes, that is, the side surface portion. The epitaxy may be located at any position in the six sides and the side surface portion. The principal plane portions refer to the two principal planes referred to in a tabular grain. The epitaxy may be present at any site in the principal planes. With regard to the shape of the epitaxy, a {100} face, a {111} face and a {110} face may appear alone in an epitaxial surface, or two or more faces may appear. Further, the epitaxy may be of indeterminate form wherein a higher-order face appears.

A method of preparing silver halide grains is described below.

A method comprising forming silver halide nuclei and then allowing the silver halide grains to grow, thereby obtaining grains with a desired size is general as a method of preparing a silver halide emulsion. The present invention is certainly similar to that. Further, with respect to the formation of tabular grains, steps of, at least, nucleation, ripening and growing are contained. These steps are described in detail in U.S. Pat. No. 4,945,037. The growing step is a step in which an aqueous silver salt solution and an aqueous halide salt solution are added to a reaction vessel by a double-jet method and allowing silver halide grain nuclei to grow. Alternatively, a method in which pAg in a reaction solution is regulated during the growth by the double-jet method may also be employed.

The following is a detailed description on a method of preparing a silver halide emulsion of the present invention.

Each of the silver halide grains according to the present invention can be divided into a base region and a perimeter region surrounding the base region. The grains generally have the perimeter region, but also may have no perimeter region. It is preferable that there are no dislocation lines in a base region and also is preferable that there are 10 or more, per grain, dislocation lines in a perimeter region. This can attain enhancement of sensitivity while preventing deterioration of pressure desensitization.

The preparation step comprises a base region forming step (step (a)) and a perimeter region forming step (step (b)) subsequent to step (a). Although only step (a) is required basically, it is preferable to perform step (b) following step (a). Step (b) refers to (b1) a step of introducing dislocation, (b2) a step of introducing dislocation at a vertex portion restrictedly, and (b3) an epitaxial junction step any of which may be employed.

First, a description on the base region is provided. Although the base regions may contain silver as much as 100% the whole silver used for the formation of the grains, it is preferable that the silver content in the base regions is 50% or more and 95% or less and more preferably 60% or more and 90% or less. The average content of iodine relative to the amount of silver in a base region is preferably 5 mol % or more and the solid solubility limit or less and more preferably 7 mol % or more and 30 mol % or less. The base region may have core/shell structure as needed. In this situation, the core of the base region preferably contains silver as much as from 50 mol % to 90 mol % the whole silver. The average iodine content in the core is preferably 5 mol % or more and the solid solubility limit or less and more preferably 7 mol % or more and 30 mol % or less. On the other hand, the average iodine content in the shell is preferably 0 mol % or more and 5 mol % or less and more preferably 3 mol % or less.

Step (a), which is a step of forming a base region, is described below.

The base region can be produced through a step well-known in the art, that is, a step comprising a nucleation step, a ripening step and a growing step. Hereafter, the steps, nucleation, ripening and growing, are described.

1. Nucleation Step

The nucleation of tabular grains is in general carried out by a double-jet method comprising adding an aqueous silver salt solution and an aqueous alkali halide solution to a reaction vessel containing an aqueous protective colloid solution, or a single-jet method comprising adding an aqueous silver salt solution to a protective colloid solution containing alkali halide. If necessary, a method comprising adding an alkali halide aqueous solution to a protective colloid solution containing silver salt as required may be used. Further, if necessary, a method comprising adding a protective colloid solution, a silver salt solution and an aqueous alkali halide solution to the mixer disclosed in JP-A-2-44335, and immediately transfer the mixture to a reaction vessel may be used for the nucleation of tabular grains. Further, as disclosed in U.S. Pat. No. 5,104,786, nucleation can be performed by passing an aqueous solution containing alkali halide and a protective colloid solution through a pipe and adding an aqueous silver salt solution thereto.

Gelatin is used as protective colloid but natural high polymers besides gelatin and synthetic high polymers can also be used. Alkali-processed gelatin, oxidized gelatin, i.e., gelatin in which a methionine group in the gelatin molecule is oxidized with hydrogen peroxide, etc. (a methionine content of 40 $\mu$mol/g or less), amino group-modified gelatin (e.g., phthalated gelatin, trimellitated gelatin, succinated gelatin, maleated gelatin, and esterified gelatin), and low molecular weight gelatin (molecular weight of from 3,000 to 40,000) are used. JP-B-5-12696 can be referred to about oxidized gelatin. Descriptions of JP-A's-8-82883 and 11-143002 can be referred to about amino group-modified gelatin. Further, if necessary, lime-processed ossein gelatin containing 30% or more of components having a molecular weight of 280,000 or more in a molecular weight distribution determined by Puggy's method disclosed in JP-A-11-237704 may be employed. Furthermore, for example, starches disclosed in European Patent No. 758758 and U.S. Pat. No. 5,733,718 may also be used. Further, natural high polymers are described in JP-B-7-111550 and Research Disclosure, Vol. 176, No. 17643, item IX (December, 1978).

In the nucleation, it is usually preferable that there are excessive halogen salt before and/or during the nucleation. The excessive halogen salt is preferably $Cl^-$, $Br^-$ and $I^-$. These may be present alone or in combination. In the present invention, it is preferable that $Cl^-$ exists. The total concentration of the halogen salt is preferably $3\times10^{-5}$ mol/liter or more and 0.1 mol/liter or less, and more preferably $3\times10^{-4}$ mol/liter or more and 0.01 mol/liter or less.

The halogen composition in a halide solution to be added during the nucleation is preferably $Br^-$, $Cl^-$ and $I^-$. These may be present alone or in combination. In the present invention, it is preferable that $Cl^-$ exists. At this time, the composition of Cl in a silver halide nuclear after the nucleation is preferably 5 mol % or more and 100 mol % or less, and more preferably 10 mol % or more and 80 mol % or less. Such a protective colloid may be dissolved in an alkali halide solution to be added during the nucleation.

The temperature in the nucleation is preferably from 5 to 60° C., but when fine tabular grains having an average grain diameter of 0.5 μm or less are produced, the temperature is more preferably from 5 to 48° C.

The pH of the dispersion medium when amino group-modified gelatin is used is preferably 4 or more and 8 or less, but when other gelatins are used it is preferably 2 or more and 8 or less.

2. Ripening Step

In the nucleation of step 1 above, not only tabular grains but also fine grains (in particular, octahedral and single twinned crystal grains) are formed. It is needed to eliminate grains other than tabular grains and to obtain highly monodisperse nuclei having a configuration destined for tabular grains before the growth step described below. For meeting this necessity, it is well known to carry out the Ostwald ripening subsequent to the nucleation.

Immediately after the nucleation, the pBr value is adjusted, and the temperature is raised to thereby carry out ripening until the ratio of hexagonal tabular grains is maximized. At this stage, supplemental addition of a gelatin solution may be effected. It is preferred that the gelatin concentration of dispersion medium solution be 10% by mass or less. The above-described alkali-processed gelatin, amino group-modified gelatin, oxidized gelatin, low molecular weight gelatin, natural high polymers or synthetic high polymers may be used as the additional protective colloid. Further, if necessary, lime-processed ossein gelatin containing 30% or more of components having a molecular weight of 280,000 or more in a molecular weight distribution determined by Puggy's method disclosed in JP-A-11-237704 may be employed. Furthermore, for example, starches disclosed in European Patent No. 758758 and U.S. Pat. No. 5,733,718 may also be used.

The temperature at which the ripening is carried out is in the range of 40 to 80° C., preferably 50 to 80° C. It is preferred that the pBr value is in the range of 1.2 to 3.0. Further, the pH value when amino group-modified gelatin is used is preferably 4 or more and 8 or less, but when other gelatins are used it is preferably 2 or more and 8 or less.

Further, at this stage, a silver halide solvent may be added so as to rapidly eliminate grains other than the tabular grains. The concentration of silver halide solvent is preferably 0.3 mol/liter, more preferably 0.2 mol/L.

The state of approximately 100% tabular grains can be attained by the above ripening.

After the completion of ripening, when the silver halide solvent is not needed in the subsequent growth step, the silver halide solvent is removed by the following method.

(i) With respect to an alkaline silver halide solvent as $NH_3$, it is rendered noneffective by the addition of an acid of large solubility product with $Ag^+$, such as $HNO_3$.

(ii) With respect to a thioether silver halide solvent, it is rendered noneffective by the addition of an oxidizer such as $H_2O_2$ as described in JP-A-60-136736.

In a method of producing an emulsion of the present invention, the completion of the ripening step is defined as a time of disappearance of tabular grains (regular or single twin grains) having hexagonal or triangular principal planes but not having two or more twin planes. The disappearance of tabular grains having hexagonal or triangular principal planes but not having two or more twin planes can be confirmed through the observation of the TEM image of a replica of grains.

In the ripening step, an over-ripening step disclosed in JP-A-11-174606 may be provided, if necessary. The over-ripening step refers to a step where ripening (ripening step) is performed until the proportion of hexagonal tabular grains becomes maximum, and then the tabular grains subjected to Ostwald ripening, thereby eliminating tabular grains with a slow anisotropic growing rate. When letting the number of grains obtained in the ripening step be 100, it is preferable to reduce the number of tabular grains to 90 or less, and more preferable to reduce it into the range of 60 or more and 80 or less.

In a method of producing the emulsion of the present invention, conditions of pBr, temperature and so on during the over-ripening step may be set as in the ripening step. Further, in the over-ripening step, a silver halide solvent may be added as in the ripening step, and the kind, concentration and so on thereof may be set to those the same as in the ripening step.

3. Growing Step

In the crystal growing step subsequent to the ripening step, the pBr value is preferably maintained at 1.4 to 3.5. When the gelatin concentration of dispersion medium solution prior to the growing step is too low (1% by mass or less), supplemental addition of a gelatin may be effected.

Further, protective colloid may be additionally added during the growing step. The timing of the addition may be any time during the growing step. The concentration of protective colloid in a dispersion medium solution at that time is preferably from 1 to 10% by mass. The above-described alkali-processed gelatin, amino group-modified gelatin, oxidized gelatin, natural high polymers or synthetic high polymers may be used as additional protective colloids. Further, if necessary, lime-processed ossein gelatin containing 30% or more of components having a molecular weight of 280,000 or more in a molecular weight distribution determined by Puggy's method disclosed in JP-A-11-237704 may be employed. Furthermore, for example, starches disclosed in European Patent No. 758758 and U.S. Pat. No. 5,733,718 may also be used. The pH during growing is preferably from 4 to 8 when amino group-modified gelatin is present, and preferably from 2 to 8 when other gelatins are used. The addition rate of $Ag^+$ and halide ions during the crystal growing step is preferably so regulated as to cause the crystal growing rate to be 20 to 100%, preferably 30 to 100%, of the critical crystal growing rate. At this stage, the addition rate of silver ions and halide ions is increased in accordance with the crystal growth. This can be accomplished by, as described in Jpn. Pat. Appln. KOKOKU Publication No. (hereinafter referred to as JP-B-) 48-36890 and JP-B-52-16364, increasing the addition rates of aqueous solutions of a silver salt and a halide, or by increasing the concentration of such aqueous solutions.

When performing by the double-jet method in which an aqueous silver salt solution and an aqueous halide salt solution are added simultaneously, it is preferable to stir well in the reaction vessel or to dilute the concentration of the solution to be added for preventing the introduction of growth dislocation due to ununiformity of iodine.

A method is more preferable in which an AgI fine grain emulsion prepared outside the reaction vessel is added to the same timing as that an aqueous silver salt solution and an aqueous halide salt solution are added. It is preferable that the growth of grains corresponding to 50% or more of the whole amount of silver is performed using the above method. In this case, the temperature of growth is preferably 50° C. or more and 90° C. or less, and more preferably 60° C. or more and 85° C. or less. The AgI fine grain emulsion may be that prepared in advance or, alternatively, may be added while being prepared continuously. In this case, with respect to the preparation method, JP-A-10-43570 is available as a reference.

The average grain size of added AgI emulsion is preferably in the range of 0.01 to 0.1 μm, more preferably 0.02 to 0.08 μm. The iodide composition of base grains can be varied by the amount of added AgI emulsion.

It is preferred to add fine grains of silver iodobromide instead of the addition of an aqueous solution of silver salt and an aqueous solution of halide. In that instance, base grains of desired iodide composition can be obtained by causing the iodide quantity of fine grains to be equal to the desired iodide quantity of base grains. Although fine grains of silver iodobromide may be those prepared in advance, it is preferred that the addition thereof be effected while continuously preparing the same. The size of added silver iodobromide fine grains is preferably in the range of 0.005 to 0.05 μm, more preferably 0.01 to 0.03 μm. In this growing step, the temperature is preferably in the range of 60 to 90° C., more preferably 70 to 85° C.

It is also possible to combine the aforementioned ion adding method, the AgI fine grain adding method, and the AgBrI fine grain adding method.

In the present invention, tabular grains preferably have dislocation lines. However, for the purpose of reducing pressure desensitization, it is preferable that there are no dislocation lines in a base portion. Dislocation lines in tabular grains can be observed by a direct method using a transmission electron microscope at a low temperature described in, e.g., J. F. Hamilton, Phot. Sci. Eng., 11, 57, (1967) or T. Shiozawa, J. Soc. Phot. Sci. Japan, 35, 213, (1972). That is, silver halide grains, extracted carefully from an emulsion so as not to apply a pressure at which dislocations are produced in the grains, are placed on a mesh for electron microscopic observation. Observation is performed by a transmission method while the sample is cooled to prevent damage (e.g., print out) due to electron rays. In this case, the greater the thickness of a grain, the more difficult it becomes to transmit electron rays through it. Therefore, grains can be observed more clearly by using an electron microscope of high voltage type (200 kV or more for a grain having a thickness of 0.25 μm). From photographs of grains obtained by the above method, it is possible to obtain the positions and the number of dislocation lines in each grain viewed in a direction perpendicular to the principal planes of the grain.

The process (b) will be described below.

First, the process (b1) will be described. The process (b1) consists of a 1st shell process and a 2nd shell process. The first shell is formed on the above base. Preferably, the ratio of the 1st shell is in the range of 1 to 10 mol % based on the total silver quantity, and the average silver iodide content thereof is in the range of 20 to 100 mol %. More preferably, the ratio of the 1st shell is in the range of 1 mol % to 5 mol % based on the total silver quantity, and the average silver iodide content thereof is in the range of 25 to 100 mol %. The growth of the 1st shell on the base can basically accomplished by adding an aqueous solution of silver nitrate and an aqueous solution of halides containing an iodide and a bromide according to the double jet method. Alternatively, an aqueous solution of silver nitrate and an aqueous solution of halide containing an iodide are added according to the double jet method. Still alternatively, an aqueous solution of halide containing an iodide is added according to the single jet method.

Use may be made of any of the above growing methods, or alternatively a combination thereof. As apparent from the average silver iodide content of the 1st shell, not only mixed crystals of silver iodobromide but also silver iodide can be precipitated at the formation of the 1st shell. In either case, generally, the silver iodide would disappear at the subsequent formation of the 2nd shell, resulting in entire conversion to mixed crystals of silver iodobromide.

As a preferred means for forming the 1st shell, there can be mentioned the method in which addition of a silver iodobromide or silver iodide fine grain emulsion, ripening and dissolution thereof are performed in sequence. As another preferred means, there can be mentioned the method in which a silver iodide fine grain emulsion is added, followed by addition of an aqueous solution of silver nitrate or addition of an aqueous solution of silver nitrate and an aqueous solution of halides. In this method, the dissolution of silver iodide fine grain emulsion is accelerated by the addition of an aqueous solution of silver nitrate. The silver quantity of added silver iodide fine grain emulsion is calculated as the 1st shell, and the silver iodide content is regarded as 100 mol %. On the other hand, the silver quantity of added silver nitrate aqueous solution is calculated as the 2nd shell. It is preferred that the silver iodide fine grain emulsion be added rapidly.

The expression "rapidly adding the silver iodide fine grain emulsion" means completing the addition of the silver iodide fine grain emulsion within preferably 10 min, more preferably 7 min. Although this condition can be varied depending on the temperature, pBr and pH of addition system, type of protective colloid agent such as gelatin, concentration thereof, presence of silver halide solvent, type and concentration thereof, etc., the shorter the addition time, the greater the preference, as mentioned above. At the time of the addition, it is preferred substantially not to add any aqueous solution of silver salt such as silver nitrate. The temperature of the system at the time of the addition is preferably in the range of 40 to 90° C., more preferably 50 to 80° C.

The silver iodide fine grain emulsion is not limited as long as it is substantially constituted of silver iodide. The silver iodide fine grain emulsion may contain silver bromide and/or silver chloride as long as a mixed crystal can be formed. The silver iodide fine grain emulsion preferably 100% consists of silver iodide. With respect to the crystalline structure, the silver iodide can have not only β form and γ form but also, as described in U.S. Pat. No. 4,672,026, a form or a structure similar thereto.

In the present invention, although the crystalline structure thereof is not particularly limited, use is made of a mixture of β form and γ form, preferably β form only. Although the silver iodide fine grain emulsion may be one prepared immediately before the addition as described in, for example, U.S. Pat. No. 5,004,679, or one having undergone the customary washing, it is preferred in the present invention to employ the silver iodide fine grain emulsion having undergone the customary washing. The silver iodide fine grain emulsion can be easily prepared by the methods as described in, for example, U.S. Pat. No. 4,672,026. The method of adding an aqueous solution of silver salt and an aqueous solution of iodide by double jet, wherein the grain formation is carried out at a fixed pI value, is preferred. The terminology "pI" used herein means the logarithm of inverse of $I^-$ ion concentration of the system. Although there is no particular limitation with respect to the temperature, pI, pH, type of protective colloid agent such as gelatin, concentration thereof, presence of silver halide solvent, type and concentration thereof, etc., it is advantageous in the present invention that the grain size be 0.1 μm or less, preferably 0.07 μm or less. Although the grain configuration cannot be fully specified because of the fine grains, it is preferred that the variation coefficient of grain size distribution be 25% or less. In particular, when it is 20% or less, the effect of the present invention is especially striking. The size and size distribution of the silver iodide fine grain emulsion are determined by placing silver iodide fine grains on a mesh for electron microscope observation and, not through the carbon replica method, directly making an observation according to the transmission technique. The reason is that, because the grain size is small, the observation by the carbon replica method causes a large measuring error. The grain size is defined as the diameter of a circle having the same projected area as that of observed grain. With respect to the grain size distribution as well, it is determined by the use of the above diameter of a circle having the same projected area. In the present invention, the most effective silver iodide fine grains have a grain size of 0.06 to 0.02 μm and exhibit a variation coefficient of grain size distribution of 18% or less.

After the above grain formation, the silver iodide fine grain emulsion is preferably subjected to, as described in, for example, U.S. Pat. No. 2,614,929, the customary washing and the regulation of pH, pI and concentration of protective colloid agent, such as gelatin, and regulation of concentration of contained silver iodide. The pH value is preferably in the range of 5 to 7. The pI value is preferably set for one minimizing the solubility of silver iodide or one higher than the same. Common gelatin having an average molecular weight of about 100 thousand is preferably used as the protective colloid agent. Also, low-molecular-weight gelatins having an average molecular weight of 20 thousand or less are preferably used. There are occasions in which the use of a mixture of such gelatins having different molecular weights is advantageous. The amount of gelatin per kg of emulsion is preferably in the range of 10 to 100 g, more preferably 20 to 80 g. The silver quantity in terms of silver atom per kg of emulsion is preferably in the range of 10 to 100 g, more preferably 20 to 80 g. With respect to the gelatin amount and/or silver quantity, it is preferred to select a value suitable for rapid addition of the silver iodide fine grain emulsion.

Although the silver iodide fine grain emulsion is generally dissolved prior to the addition, it is requisite that the agitation efficiency of the system be satisfactorily high at the time of the addition. Preferably, the agitation rotating speed is set higher than usual. The addition of an antifoaming agent is effective in preventing the foaming during the agitation. Specifically, use is made of antifoaming agents described in, for example, Examples of U.S. Pat. No. 5,275,929.

As a further preferred method of forming the 1st shell, there can be mentioned the formation of a silver halide phase containing silver iodide while rapidly forming iodide ions with the use of iodide ion release agents as described in U.S. Pat. No. 5,496,694, the disclosure of which is incorporated herein by reference, in place of the conventional iodide ion supply method (method of adding free iodide ions).

The iodide ion release agent reacts with an iodide ion release controlling agent (base and/or nucleophilic agent) to thereby release iodide ions. The nucleophilic agent used in that reaction can preferably be any of the following chemical species. The chemical species include, for example, hydroxide ions, sulfite ions, hydroxylamine, thiosulfate ions, metabisulfite ions, hydroxamic acids, oximes, dihydroxybenzenes, mercaptans, sulfinates, carboxylates, ammonia, amines, alcohols, ureas, thioureas, phenols, hydrazines, hydrazides, semicarbazides, phosphines and sulfides.

The release speed and timing of iodide ions can be controlled by controlling the concentrations of base and nucleophilic agent, the addition method thereof and the temperature of reaction mixture. An alkali hydroxide can preferably be used as the base.

The concentration of each of the iodide ion release agent and iodide ion release controlling agent which are used to rapidly generate iodide ions is preferably in the range of $1\times10^{-7}$ to 20 M, more preferably $1\times10^{-5}$ to 10 M, yet more preferably $1\times10^{-4}$ to 5 M, and most preferably $1\times10^{-3}$ to 2 M.

When the concentration exceeds 20 M, the addition amount of large-molecular-weight iodide ion release agent and iodide ion release controlling agent is unfavorably too large as compared with the capacity of the grain forming vessel.

On the other hand, when the concentration is lower than $1\times10^{-7}$ M, the iodide ion releasing reaction rate is unfavorably reduced to such an extent that rapid release of iodide ions becomes difficult.

The temperature thereof is preferably in the range of 30 to 80° C., more preferably 35 to 75° C., and most preferably 35 to 60° C.

When the reaction temperature is higher than 80° C., the iodide ion releasing reaction rate generally becomes extremely high. On the other hand, when the reaction temperature is lower than 30° C., the iodide ion releasing reaction rate generally becomes extremely low. Thus, in both the cases, the use conditions are unfavorably limited.

When the base is used in the release of iodide ions, use may be made of changing of the liquid pH. In this instance, the pH for controlling the releasing rate and timing of iodide ions is preferably in the range of 2 to 12, more preferably 3 to 11, and most preferably 5 to 10. The optimum pH after controlling is in the range of 7.5 to 10.0. Even under neutral conditions of pH 7, hydroxide ions defined by the ionic product of water function as a controlling agent.

Furthermore, the nucleophilic agent and the base can be used in combination. In this instance as well, the pH may be controlled so as to fall within the above ranges to thereby control the releasing rate and timing of iodide ions.

When iodine atoms are released in the form of iodide ions from the iodide ion release agent, all the iodine atoms may be released, or some thereof may remain unreleased without being split.

The 2nd shell is formed on the tabular grain comprising the above base and 1st shell. Preferably, the ratio of the 2nd shell is in the range of 10 to 40 mol % based on the total silver quantity, and the average silver iodide content thereof is in the range of 0 to 5 mol %. More preferably, the ratio of the 2nd shell is in the range of 15 to 30 mol % based on the total silver quantity, and the average silver iodide content thereof is in the range of 0 to 3 mol %. The growth of the 2nd shell on the tabular grain comprising the base and 1st shell may be effected in the direction either increasing or decreasing the aspect ratio of the tabular grain. Fundamentally, the growth of the 2nd shell is accomplished by adding an aqueous solution of silver nitrate and an aqueous solution of halides including a bromide according to the double jet method. Alternatively, the 2nd shell may be grown by first adding an aqueous solution of halides including a bromide and thereafter adding an aqueous solution of silver nitrate according to the single jet method. The temperature and pH of system, type of protective colloid agent such as gelatin, concentration thereof, presence of silver halide solvent, type and concentration thereof, etc. can be widely varied. With respect to pBr, in the present invention, it is preferred that the pBr at the completion of the formation of the layer be higher than the pBr at the initial stage of the formation of the layer. Preferably, the pBr at the initial stage of the formation of the layer is 2.9 or less while the pBr at the completion of the formation of the layer is 1.7 or more. More preferably, the pBr at the initial stage of the formation of the layer is 2.5 or less while the pBr at the completion of the formation of the layer is 1.9 or more. Most preferably, the pBr at the initial stage of the formation of the layer is in the range of 2.3 to 1. Most preferably, the pBr at the completion of the formation of the layer is in the range of 2.1 to 4.5.

It is preferred that dislocation lines exist at the portions of the process (b1). Dislocation lines preferably exist in the vicinity of tabular grain lateral sides. The expression "vicinity of lateral sides" refers to, with respect to six sides of the tabular grains, lateral side portions plus inner portions thereof, namely, portions grown in the process (b1). The number of dislocation lines existing at lateral side portions is preferably 10 or more per grain on the average. More preferably, the number is 20 or more per grain on the average. When dislocation lines are densely present or when dislocation lines are observed in the state of crossing each other, it may occur that the number of dislocation lines per grain cannot accurately be counted. However, in this instance as well, rough counting on the order of, for example, 10, 20 or 30 dislocation lines can be effected, so that a clear distinction can be made from the presence of only a few dislocation lines. The average number of dislocation lines per grain is determined by counting the number of dislocation lines of each of at least 100 grains and calculating a number average thereof.

With respect to the tabular grains of the present invention, it is preferred that the inter-granular dislocation line quantitative distribution be uniform. In the emulsion of the present invention, silver halide grains having 10 or more dislocation lines per grain preferably occupy 100 to 50% of all the grains. These silver halide grains more preferably occupy 100 to 70%, most preferably 100 to 90%, of all the grains. Ratios of below 50% are unfavorable from the viewpoint of inter-granular uniformity.

In the present invention, the ratio of grains having dislocation lines and the number of dislocation lines are preferably determined by directly observing the dislocation lines of at least 100 grains, more preferably 200 or more grains, and most preferably 300 or more grains.

The process (b2) will now be described.

The first mode of the process comprises dissolving only vertex portions and vicinities thereof with the use of iodide ions. The second mode of the process comprises simultaneously adding an aqueous solution of silver salt and an aqueous solution of iodide salt. The third mode of the process comprises substantially dissolving only vertex portions and vicinities thereof with the use of a silver halide solvent. The fourth mode of the process comprises utilizing a halogen conversion.

The first mode of the process comprising dissolving with the use of iodide ions will be described below.

When iodide ions are added to the base grains, vertex portions and vicinities thereof of the base grains are dissolved and rounded. Further, when a silver nitrate solution and a bromide solution, or a silver nitrate solution and a mixture of bromide solution and iodide solution, are simultaneously added, the grains are further grown with the result that dislocation would be introduced at the vertex portions and vicinities thereof. With respect to this method, reference can be made to JP-A's 4-149541 and 9-189974.

With respect to the total amount of iodide ions added in this mode, from the viewpoint of attaining effective dissolution according to the present invention, it is preferred that the relationship $(I_2-I_1)=0$ to 8, wherein $I_2$ represents the value (mol %) obtained by dividing the total molar amount of iodide ions by the total molar amount of base grain silver and multiplying the quotient by 100 and wherein $I_1$ represents the silver iodide content (mol %) of base grains, be satisfied. More preferably, the relationship $(I_2-I_1)=0$ to 4 is satisfied.

It is preferred that the concentration of iodide ions added in this mode be low. In particular, the concentration is preferably 0.2 mol/L or less, more preferably 0.1 mol/L or less. The pAg value at the addition of iodide ions is preferably 8.0 or more, more preferably 8.5 or more.

After the dissolution of vertex portions of base grains by the addition of iodide ions to base grains, a silver nitrate solution is added alone, or a silver nitrate solution and a bromide solution, or a silver nitrate solution and a mixture of bromide solution and iodide solution are simultaneously added to thereby further grow the grains. This introduces dislocation at vertex portions and vicinities thereof.

The second mode of the process comprising simultaneously adding a silver salt solution and an iodide salt solution will be described below. Epitaxial formation of silver iodide or a silver halide of high silver iodide content at grain vertex portions can be effected by rapidly adding a silver salt solution and an iodide salt solution to base grains. The addition rate of these silver salt solution and iodide salt solution is preferably in the range of 0.2 to 0.5 min, more preferably 0.5 to 2 min. With respect to this method, reference can be made to a detailed description of JP-A-4-149541.

After the dissolution of vertex portions of base grains by the addition of iodide ions to base grains, a silver nitrate solution is added alone, or a silver nitrate solution and a bromide solution, or a silver nitrate solution and a mixture of bromide solution and iodide solution are simultaneously added to thereby further grow the grains. This introduces dislocation at vertex portions and vicinities thereof.

The third mode of the process comprising using a silver halide solvent will be described below.

When a silver halide solvent is first added to a dispersion medium containing base grains and thereafter a silver salt solution and an iodide salt solution are simultaneously added thereto, silver iodide or a silver halide of high silver iodide content would preferentially be grown at base grain vertex portions dissolved by the silver halide solvent. At that time, it is not needed to rapidly add the silver salt solution and iodide salt solution. With respect to this method, reference can be made to a detailed description of JP-A-4-149541.

After the dissolution of vertex portions of base grains by the addition of iodide ions to base grains, a silver nitrate solution is added alone, or a silver nitrate solution and a bromide solution, or a silver nitrate solution and a mixture of bromide solution and iodide solution are simultaneously added to thereby further grow the grains. This introduces dislocation at vertex portions and vicinities thereof.

The fourth mode of the process utilizing a halogen conversion will be described below.

Specifically, this mode comprises adding an epitaxial growth site director (hereinafter referred to simply as "site director"), such as a sensitizing dye described in JP-A-58-108526 or a water soluble iodide, to base grains to thereby form silver chloride epitaxies at vertex portions of base grains and thereafter adding iodide ions to thereby effect a halogen conversion from silver chloride to silver iodide or a silver halide of high silver iodide content. Sensitizing dyes, water soluble thiocyanate ions and water soluble iodide ions can be used as the site director. Water soluble iodide ions are preferred. Iodide ions are preferably used in an amount of 0.0005 to 1 mol %, more preferably 0.001 to 0.5 mol %, based on base grains. The addition of the optimum amount of iodide ions followed by the simultaneous addition of a silver salt solution and a chloride solution enables forming silver chloride epitaxies at vertex portions of base grains.

The halogen conversion of silver chloride by iodide ions will be described below. A silver halide of high solubility can be converted to a silver halide of low solubility by the addition of halide ions capable of forming a silver halide of low solubility. This step is known as a halogen conversion, and is described in, for example, U.S. Pat. No. 4,142,900. A silver iodide phase is formed at vertex portions of base grains by carrying out a selective halogen conversion of silver chloride having undergone epitaxial growth at base vertex portions with the use of iodide ions. This is described in detail in JP-A-4-149541.

After the halogen conversion of silver chloride having undergone epitaxial growth at vertex portions of base grains to a silver iodide phase with the use of iodide ions, a silver nitrate solution is added alone, or a silver nitrate solution and a bromide solution, or a silver nitrate solution and a mixture of bromide solution and iodide solution are simultaneously added to thereby further grow the grains. This introduces dislocation at vertex portions and vicinities thereof.

It is preferred that dislocation lines exist at the portions of the process (b2). Dislocation lines preferably exist in vicinities of vertex portions of the tabular grains. The expression "vicinities of vertex portions" refers to three-dimensional portions each defined by sides making each vertex and perpendiculars to the sides, the perpendiculars drawn from a point positioned on a straight line combining the grain center and the vertex at a distance of x%, based on the line length, from the grain center. The value of x is preferably in the range of 50 to less than 100, more preferably 75 to less than 100.

The process (b3) epitaxial junction step will now be described.

The epitaxial formation of silver halide on base grains, as described in U.S. Pat. No. 4,435,501, can be effected at sites, for example, lateral side or vertex of base grains, selected for silver salt epitaxial formation by a site director, such as iodide ions, aminoazaindene or a spectral sensitizing dye, adsorbed on the base grain surface. In JP-A-8-69069, a high photographic speed is attained by effecting a silver salt epitaxial formation at selected portions of an extremely thin tabular grain base and carrying out the optimum chemical sensitization of the epitaxial phase.

In the present invention as well, it is extremely preferable to highly sensitize the base grains of the present invention with the use of the above methods. As the site director, there can be employed aminoazaindene or a spectral sensitizing dye. Also, there can be employed iodide ions or thiocyanate ions. According to an intended use, an appropriate site director can be used, or site directors may be used in combination.

The site for silver salt epitaxial formation may be limited to principal planes, peripheries or vertexes of base grains, or the combination thereof, by varying the amount of sensitizing dye and the addition amount of iodide ions and thiocyanate ions. It is preferable that the addition amount of aminoazaindenes, iodide ions, thiocyanate ions and sensitizing dyes for use as the site director is suitably selected according to the silver amount of silver halide base grain, surface area and the limited portions of the epitaxial. At the silver salt epitaxial formation, the temperature is preferably in the range of 40 to 70° C., more preferably 45 to 60° C. The pAg value is preferably 9.0 or less, more preferably 8.0 or less. As described above, by suitable selection of the kind of site directors, the addition amount, the conditions of the epitaxial formation (such as temperature and pAg), silver salt epitaxial can selectively be formed in principal planes, peripheries or vertexes of base grains. With respect to the thus obtained emulsion, as described in JP-A-8-69069, the epitaxial phase may be chemically sensitized in a selective manner so as to exhibit a high photographic speed. Also, however, after the silver salt epitaxial formation, a silver salt solution and a halide solution may be simultaneously added to thereby effect further growth. The aqueous halide solution added at this stage is preferably a bromide solution or a mixture of bromide solution and iodide solution. Moreover, at this stage, the temperature is preferably in the range of 40 to 80° C., more preferably 45 to 70° C. The pAg value is preferably in the range of 5.5 to 9.5, more preferably 6.0 to 9.0.

At the portions of the process (b3), although dislocation lines may not exist, it is preferred that dislocation lines exist. It is preferred that dislocation lines exist at junctions of base grains and epitaxial growth portions, or epitaxial portions. The number of dislocation lines existing at such junctions or epitaxial portions is preferably 10 or more per grain on the average. More preferably, the number is 20 or more per grain on the average. When dislocation lines are densely present or when dislocation lines are observed in the state of crossing each other, it may occur that the number of dislocation lines per grain cannot accurately be counted. However, in this instance as well, rough counting on the order of, for example, 10, 20 or 30 dislocation lines can be effected, so that a clear distinction can be made from the presence of only a few dislocation lines. The average number of dislocation lines per grain is determined by counting the number of dislocation lines of each of at least 100 grains and calculating a number average thereof.

It is more preferable to introduce a "dopant (metal complex)" such as those disclosed in JP-A-8-69069, to an epitaxial layer. Concretely, it is preferable that the system is doped with a hexacyano metal complex during the formation of an epitaxial portion. The hexacyano metal complex is preferably one containing iron, ruthenium, osmium, cobalt, rhodium, iridium or chromium. The addition amount of hexacyano metal complex is preferably in the range of $10^{-9}$ to $10^{-2}$ mol, more preferably $10^{-8}$ to $10^{-4}$ mol, per mol of silver halides. The hexacyano metal complex can be dissolved in water or an organic solvent before addition. The organic solvent is preferably miscible with water. Examples of suitable organic solvents include alcohols, ethers, glycols, ketones, esters and amides.

Although it is advantageous to use aforementioned gelatins as a protective colloid employed in the preparation of the emulsion of the present invention, use also can be made of other hydrophilic colloids.

For example, use can be made of a variety of synthetic hydrophilic polymeric materials, including proteins such as gelatin derivatives, graft polymers from gelatin/other polymers, albumin and casein; sugar derivatives, for example, cellulose derivatives such as hydroxyethylcellulose, carboxymethylcellulose and cellulose sulfate, sodium alginate and starch derivatives; and homo- or copolymers such as polyvinyl alcohol, partially acetalized polyvinyl alcohol, poly-N-vinylpyrrolidone, polyacrylic acid, polymethacrylic acid, polyacrylamide, polyvinylimidazole and polyvinylpyrazole.

Preferably, the silver halide emulsion according to the present invention is washed with water for desalting and is dispersed in a freshly prepared protective colloid. Gelatin is used as protective colloid, but natural high polymers besides gelatin and synthetic high polymers may also be used. With respect to the kind of gelatin, alkali-processed gelatin, oxidized gelatin (a methionine content of 40 $\mu$mol/g or less) in which a methionine group in the gelatin molecule is oxidized with hydrogen peroxide, etc., and amino group-modified gelatin (e.g., phthalated gelatin, trimellitated gelatin, succinated gelatin, maleated gelatin, and esterified gelatin) are employed. Further, if necessary, lime-processed ossein gelatin containing 30% or more of components having a molecular weight of 280,000 or more in a molecular weight distribution determined by Puggy's method disclosed in JP-A-11-237704 may be employed. Furthermore, for example, starches disclosed in European Patent No. 758758 and U.S. Pat. No. 5,733,718 may also be used. Further, natural high polymers are described in JP-B-7-111550 and Research Disclosure, Vol. 176, No. 17643, item IX (December, 1978). Although the washing temperature can be selected in conformity with the object, it is preferably selected within the range of 5 to 50° C. Although the pH value at which the washing is conducted can also be selected in conformity with the object, it is preferably selected within the range of 2 to 10, more preferably within the range of 3 to 8. Although the pAg value at which the washing is conducted can also be selected in conformity with the object, it is preferably selected within the range of 5 to 10. The method of washing can be selected from among the noodle washing technique, the dialysis with the use of a semipermeable membrane, the centrifugation, the coagulation precipitation method and the ion exchange method. The coagulation precipitation can be conducted according to a method selected from among the method in which a sulfate is used, the method in which an organic solvent is used, the method in which a water soluble polymer is used and the method in which a gelatin derivative is used.

During the grain formation of the present invention, it is possible to cause a polyalkyleneoxide block copolymer disclosed in, for example, JP-A's-5-173268, 5-173269, 5-173270, 5-173271, 6-202258 and 7-175147, or a polyalkyleneoxide copolymer disclosed in Japanese Patent No. 3089578 to be present, the disclosures of which are incorporated herein by reference. Such a compound may be present at any timing during the preparation of the grains. However, its use in early stages of grain formation exhibits a great effect.

In the preparation (e.g., grain formation, desalting step, chemical sensitization, and before coating) of the emulsion of the present invention, it is preferable to make a salt of metal ion exist in accordance with purposes. The metal ion salt is preferably added during grain formation when doped into grains, and after grain formation and before completion of chemical sensitization when used to decorate the grain surface or used as a chemical sensitizer. In addition to a method of doping the salt to all the grains, a method of doping to only the core or the shell of a grain can be selected. As examples of the dopant, Mg, Ca, Sr, Ba, Al, Sc, Y, La, Cr, Mn, Fe, Co, Ni, Cu, Zn, Ga, Ru, Rh, Pd, Re, Os, Ir, Pt, Au, Cd, Hg, Tl, In, Sn, Pb, and Bi can be used. Those metals can be added as long as they are in the form of salt that can be dissolved during grain formation, such as an ammonium salt, an acetate, a nitrate, a sulfate, a phosphate, a hydroxide, a 6-coordinated complex salt, or a 4-coordinated complex salt. For example, $CdBr_2$, $CdCl_2$, $Cd(NO_3)_2$, $Pb(NO_3)_2$, $Pb(CH_3COO)_2$, $K_3[Fe(CN)_6]$, $(NH_4)_4[Fe(CN)_6]$, $K_4Fe(CN)_6$, $K_2IrCl_6$, $K_3IrCl_6$, $(NH_4)_3RhCl_6$, and $K_4Ru(CN)_6$ are mentioned. The ligand of a coordination compound can be selected from halo, aqua, cyano, cyanate, thiocyanate, nitrosyl, thionitrosyl, oxo and carbonyl. These metal can be used either singly or in the form of a combination of two or more types of them.

The metal compounds are preferably dissolved in an appropriate solvent such as water, methanol, acetone and added in a form of a solution. In order to stabilize the solution, a method of adding an aqueous hydrogen halogenide (e.g., HCl and HBr) or an alkali halide (e.g., KCl, KBr and NaBr) can be used. Further, it is also possible to add an acid or alkali, if necessary. The metal compounds may be added to a reaction vessel before or during grain formation. Alternatively, the metal compounds may be added to a water-soluble silver salt (e.g., $AgNO_3$) or an aqueous alkali halide solution (e.g., NaCl, KBr and KI) and added in the from of a solution continuously during formation of silver halide grains. Furthermore, a solution of the metal compounds can be prepared independently of a water-soluble salt or an alkali halide and added continuously at a proper timing during grain formation. It is also preferable to further combine many addition methods.

It is sometimes useful to perform a method of adding a chalcogen compound during preparation of an emulsion described in U.S. Pat. No. 3,772,031, the disclosure of which is incorporated herein by reference. In addition to S, Se and Te, a cyanate, a thiocyanate, a selenocyanate, a carbonate, a phosphate, and an acetate may be present.

In case of the silver halide grains of the present invention, at least one of chalcogen sensitizations such as sulfur sensitization, selenium sensitization and the like; noble metal sensitizations such as gold sensitization, palladium sensitization, and the like; and the reduction sensitization can be carried out in an arbitrary step of the production steps of the silver halide photographic emulsion. It is preferable to combine 2 or more of sensitization methods.

Various type emulsions can be prepared depending on decision at what steps chemical sensitization is carried out. There is a type of burying chemical sensitization nuclei in the inside of grains, a type of burying them at a shallow position from the grain surface, or a type of making the chemical sensitization nuclei on surface. The position of the chemical sensitization nuclei can be selected in accordance with purposes for the emulsion of the present invention, but in general, a case of making at least one of the chemical sensitization nuclei around surface in the vicinity is preferable.

One of the chemical sensitizations which can be preferably carried out in the present invention is single or a combination of chalcogen sensitization and noble metal sensitization, and can be carried out using active gelatin as described in T. H. James, "The Theory of the Photographic Process, 4$^{th}$ edition, (1977), pp. 67–76", published by Macmillan. Further, as described in "Research Disclosure Vol. 120 (Apr. 1974), p. 12008"; "Research Disclosure Vol. 34 (Jun. 1975), p. 13452", U.S. Pat. Nos. 2,642,361, 3,297,446, 3,772,031, 3,857,711, 3,901,714, 4,266,018, 3,904,415, and BG Patent No. 1,315,755, the chemical sensitization can be carried out using sulfur, selenium, tellurium, gold, platinum, palladium, iridium or the combination of a plural number of these sensitizers at a pAg of 5 to 10, a pH of 5 to 8 and a temperature of 30 to 80° C.

Noble metal salts such as gold, platinum, palladium, iridium and the like can be used in the noble metal sensitization, and among these, particularly, gold sensitization, palladium sensitization and a combination of both are preferable.

For the gold sensitization may be used gold salts as described in, for example, P. Grafkides, Chimie et Physique Photographique, 5th Ed., Paul Montel, 1987, and Research Disclosure, Vol. 307, No. 307105.

Specifically, in addition to chloroauric acid, potassium chloroaurate and potassium auriothiocyanate, gold compounds can also be used, e.g., those disclosed in U.S. Pat. Nos. 2,642,361 (e.g., gold sulfide and gold selenide), 3,503,749 (e.g., gold thiolate having a water-soluble group), 5,049,484 (e.g., bis(methylhydantoinato) gold complex), 5,049,485 (mesoionic thiolate gold complexes, e.g., 1,4,5-trimethyl-1,2,4-triazolium-3-thiolate gold complex), 5,252,455 and 5,391,727 (macroheterocyclic gold complexes), 5,620,841, 5,700,631, 5,759,760, 5,759,761, 5,912,111, 5,912,112 and 5,939,245, JP-A's-1-147537, 8-69074, 8-69075 and 9-269554, JP-B-45-29274, German Patent DD-264524A, 264525A, 265474A and 298321A, JP-A's-2001-75214, 2001-75215, 2001-75216, 2001-75217 and 2001-75218, the disclosures of which are incorporated herein by reference.

The palladium compound means divalent salt of palladium or tetra-valent salt of palladium. The preferable palladium compound is represented by $R_2PdX_6$, and $R_2PdX_4$. Wherein R represents a hydrogen atom, an alkali atom, or an ammonium group. X represents a halogen atom, and represents a chlorine atom, a bromine atom or an iodine atom.

Specifically, $K_2PdCl_4$, $(NH_4)_2PdCl_6$, $Na_2PdCl_4$, $(NH_4)_2PdCl_4$, $Li_2PdCl_4$, $Na_2PdCl_6$ or $K_2PdBr_4$ is preferable. It is preferable to use a gold compound and a palladium compound together with a thiocyanate or a selenocyanate.

For the sulfur sensitization, unstable sulfur compounds are used and those described, for example, in P. Grafkides, Chimie et Physique Photographique, 5th Ed., Paul Montel, 1987, and Research Disclosure, Vol. 307, No. 307105, the disclosures of which are incorporated herein by reference, may be used.

Specifically, known sulfur compounds, for example, thiosulfates (e.g., hypo), thioureas (e.g., diphenyithiourea, triethylthiourea, N-ethyl-N'-(4-methyl-2-thiazolyl) thiourea, dicarboxymethyl-dimethylthiourea and carboxymethyl-trimethylthiourea), thioamides (e.g., thioacetamide), rhodanines (e.g., diethylrhodanine and 5-benzylidene-N-ethylrhodanine), phosphine sulfides (e.g., trimethylphosphine sulfide), thiohydantoins, 4-oxo-oxazolidine-2-thiones, di- or poly-sulfides (e.g., dimorpholine disulfide, cystine, and hexathionic acid), mercapto compounds (e.g., cysteine), polythionates, and elemental sulfur, active gelatins may also be used. Particularly, thiosulfates, thioureas, phosphine sulfides and rhodanines are preferred.

For the selenium sensitization, an unstable selenium compound is used and, for example, selenium compounds described in JP-B's-43-13489 and 44-15748, JP-A's-4-25832, 4-109340, 4-271341, 5-40324, 5-11385, 6-51415, 6-175258, 6-180478, 6-208186, 6-208184, 6-317867, 7-92599, 7-98483 and 7-140579 may be used.

Specifically, colloidal metallic selenium, selenoureas (e.g., N,N-dimethylselenourea, trifluoromethylcarbonyltrimethylselenourea, and acetyl-trimethylselenourea), selenoamides (e.g., selenoamide and N,N-diethylphenylselenoamide), phosphine selenides (e.g., triphenylphosphine selenide and pentafluorophenyltriphenylphosphine selenide), selenophosphates (e.g., tri-p-tolylselenophosphate and tri-n-butylselenophosphate), selenoketones (e.g., selenobenzophenone), isoselenocyanates, selenocarboxylic acids, selenoesters (e.g., methoxyphenylselenocarboxy-2,2-dimethoxycyclohexane ester) and diacylselenides may be used. Further, non-unstable selenium compounds as described in JP-B's-46-4553 and 52-34492, for example, selenites, selenocyanic acids (e.g., potassium selenocyanide), selenazoles, and selenides are also available. Particularly, phosphine selenides, selenoureas, selenoesters and selenocyanic acids are preferred.

For the tellurium sensitization, an unstable tellurium compound is used and, for example, unstable tellurium compounds described in JP-A's-4-224595, 4-271341, 4-333043, 5-303157, 6-27573, 6-175258, 6-180478, 6-208186, 6-208184, 6-317867 and 7-140579 may be used.

Specific examples thereof include phosphine tellurides (e.g., butyl-diisopropylphosphine telluride, tributylphosphine telluride, tributoxyphosphine telluride, ethoxydiphenylphosphine telluride), diacyl (di)tellurides (e.g., bis(diphenylcarbamoyl) ditelluride, bis(N-phenyl-N-methylcarbamoyl) ditelluride, bis(N-phenyl-N-methylcarbamoyl) telluride, bis(N-phenyl-N-benzylcarbamoyl) telluride, bis-(ethoxycarbonyl)telluride), telluroureas (e.g., N,N'-dimethylethylenetellurourea and N,N'-dephenylethylenetellurourea), telluroamides and telluroesters.

Compounds that may be employed as a useful chemical sensitization auxiliary include compounds known as a compound that suppresses fogging and increases the sensitivity in the process of chemical sensitization, such as azaindenes, azapyridazines and azapyrimidines. Examples of chemical sensitization auxiliary modifiers are mentioned in U.S. Pat. Nos. 2,131,038, 3,411,914 and 3,554,757, JP-A-58-126526, and G. F. Duffin "Photographic Emulsion Chemistry" cited above, pages 138 to 143, the disclosures of which are incorporated herein by reference.

The amounts of the gold sensitizer and the chalcogen sensitizer used in the present invention vary depending on the silver halide grain or chemical sensitization conditions employed. However, they are from $10^{-8}$ to $10^{-2}$ mol, preferably approximately from $10^{-7}$ to $10^{-3}$ mol, per mol of silver halide. It is preferable to perform reduction sensitization during the grain formation of the silver halide emulsion of the present invention, or after the grain formation and before or during the chemical sensitization, or after the chemical sensitization.

The reduction sensitization can be performed by a method selected from among the method in which a reduction sensitizer is added to the silver halide emulsion, the method commonly known as silver ripening in which growth or ripening is carried out in an environment of pAg as low as 1 to 7 and the method commonly known as high-pH ripening in which growth or ripening is carried out in an environment of pH as high as 8 to 11. Also, two or more of these methods can be used in combination.

The above method in which a reduction sensitizer is added is preferred from the viewpoint that the level of reduction sensitization can be finely regulated.

Examples of known reduction sensitizers include thiourea dioxide, ascorbic acid and derivatives thereof, amines and polyamines, hydrazine derivatives, dihydroxybenzenes and derivatives thereof (e.g., disodium 4,5-dihydroxy-1,3-benzenesulfonate), hydroxylamines and derivatives thereof, silane compounds and borane compounds. In the reduction sensitization according to the present invention, appropriate one may be selected from among these known reduction sensitizers and used, or two or more compounds may be selected and used in combination. Preferred reduction sensitizers are thiourea dioxide, ascorbic acid and derivatives thereof, hydrazine derivatives, and dihydroxybenzenes and derivatives thereof. Although the addition amount of reduction sensitizer must be selected because it depends on the emulsion manufacturing conditions, the addition amount ranges from $10^{-7}$ to $10^{-3}$ mol per mol of silver halides.

Each reduction sensitizer is dissolved in, for example, water or any of organic solvents such as alcohols, glycols, ketones, esters and amides, and added during the grain growth. Although the reduction sensitizer may be placed in a reaction vessel in advance, it is preferred that the addition be effected at an appropriate time during the grain growth. It is also suitable to add in advance the reduction sensitizer to an aqueous solution of a water-soluble silver salt or a water-soluble alkali halide and to precipitate silver halide grains with the use of the resultant aqueous solution. Alternatively, the reduction sensitizer solution may preferably be either divided and added a plurality of times in accordance with the grain growth or continuously added over a prolonged period of time.

It is preferred to use an oxidizer capable of oxidizing silver during the process of producing the emulsion of the present invention. The silver oxidizer is a compound having an effect of acting on metallic silver to thereby convert the same to silver ion. A particularly effective compound is one that converts very fine silver grains, formed as a by-product in the step of forming silver halide grains and the step of chemical sensitization, into silver ions. Each silver ion produced may form a silver salt sparingly soluble in water, such as a silver halide, silver sulfide or silver selenide, or may form a silver salt easily soluble in water, such as silver nitrate. The silver oxidizer may be an inorganic or organic substance. Examples of suitable inorganic oxidizers include ozone, hydrogen peroxide and its adducts (e.g., $NaBO_2.H_2O_2.3H_2O$, $2NaCO_3.3H_2O_2$, $Na_4P_2O_7.2H_2O_2$ and $2Na_2SO_4.H_2O_2.2H_2O$) peroxy acid salts (e.g., $K_2S_2O_8$, $K_2C_2O_6$ and $K_2P_2O_8$) peroxy complex compounds (e.g., $K_2[Ti(O_2)\ C_2O_4].3H_2O$, $4K_2SO_4.Ti(O_2)OH.SO_4.2H_2O$ and $Na_3[VO(O_2)(C_2H_4)_2].6H_2O$), permanganates (e.g., $KMnO_4$), chromates (e.g., $K_2Cr_2O_7$) and other oxyacid salts, halogen elements such as iodine and bromine, halogen oxyacid salts (e.g., potassium periodate), salts of high-valence metals (e.g., potassium hexacyanoferrate (II)) and thiosulfonates.

Examples of suitable organic oxidizers include quinones such as p-quinone, organic peroxides such as peracetic acid and perbenzoic acid, and active halogen releasing compounds (e.g., N-bromosuccinimide, chloramine T and chloramine B).

Oxidizers preferred in the present invention are inorganic oxidizers selected from among hydrogen peroxide and its adducts, halogen elements, halogen oxyacid salts and thiosulfonates, and organic oxidizers selected from among quinones. The use of the silver oxidizer in combination with the above reduction sensitization is preferred. This combined use can be effected by performing the reduction sensitization after the use of the oxidizer, or vice versa, or by simultaneously performing both. These can be performed during a step selected from among the step of grain formation and the step of chemical sensitization.

The photographic emulsion of the present invention can be loaded with various compounds for the purpose of preventing fogging during the process for producing a lightsensitive material or during the storage or photographic processing thereof, or for the purpose of stabilizing the photographic performance. That is, the emulsion can be loaded with various compounds known as antifoggants or stabilizers, including thiazoles (e.g., benzothiazolium salts), nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nirobenzotriazoles, mercaptotetrazoles (especially, 1-phenyl-5-mercaptotetrazole), mercaptopyrimidines, mercaptotriazines (e.g., thioketo compounds such as oxazolinethione), and azaindenes such as triazaindenes, tetraazaindenes (especially, 4-hydroxy-substituted (1,3,3a,7) tetraazaindenes) and pentaazaindenes. For example, use can be made of those described in U.S. Pat. Nos. 3,954,474 and 3,982,947 and JP-B-52-28660. Preferred compounds are described in JP-A-63-212932. The loading with the antifoggant or stabilizer can be effected at a varied timing, for example, before, during or after the grain formation, or during the washing with water, or during the dispersion after the water washing, or before, during or after the chemical sensitization, or before the coating, in accordance with the object. The loading during emulsion preparation can be made not only for the above primary exertion of fog prevention and stabilizing effects but also for a multiplicity of other purposes including control of the crystal wall of grains, decrease of the grain size, lowering of the grain solubility, control of the chemical sensitization and control of the dye arrangement.

Photographic emulsions of the present invention can achieve the purpose of the present invention when spectrally sensitized by preferably methine dyes and the like. Usable dyes involve a cyanine dye, merocyanine dye, composite cyanine dye, composite merocyanine dye, holopolar cyanine dye, hemicyanine dye, styryl dye, and hemioxonole dye. Most useful dyes are those belonging to a cyanine dye, merocyanine dye, and composite merocyanine dye. These dyes can contain any nucleus commonly used as a basic heterocyclic nucleus in cyanine dyes. Examples are a pyrroline nucleus, oxazoline nucleus, thiazoline nucleus, pyrrole nucleus, oxazole nucleus, thiazole nucleus, selenazole nucleus, imidazole nucleus, tetrazole nucleus, and pyridine nucleus; a nucleus in which an aliphatic hydrocarbon ring is fused to any of the above nuclei; and a nucleus in which an aromatic hydrocarbon ring is fused to any of the above nuclei, e.g., an indolenine nucleus, benzindolenine nucleus, indole nucleus, benzoxadole nucleus, naphthoxazole nucleus, benzthiazole nucleus, naphthothiazole nucleus, benzoselenazole nucleus, benzimidazole nucleus, and quinoline nucleus. These nuclei can be substituted on a carbon atom.

It is possible to apply to a merocyanine dye or a composite merocyanine dye a 5- or 6-membered heterocyclic nucleus as a nucleus having a ketomethylene structure. Examples are a pyrazoline-5-one nucleus, thiohydantoin nucleus, 2-thiooxazolidine-2,4-dione nucleus, thiazolidine-2,4-dione nucleus, rhodanine nucleus, and thiobarbituric acid nucleus.

Although these sensitizing dyes can be used singly, they can also be combined. The combination of sensitizing dyes is often used for a supersensitization purpose. Representative examples of the combination are described in U.S. Pat. Nos. 2,688,545, 2,977,229, 3,397,060, 3,522,0523, 3,527,641, 3,617,293, 3,628,964, 3,666,480, 3,672,898, 3,679, 4283, 3,703,377, 3,769,301, 3,814,609, 3,837,862, and 4,026,707, British Patents 1,344,281 and 1,507,803, JP-B's-43-4936 and 53-12375, and JP-A's-52-110618 and 52-109925, the disclosures of which are incorporated herein by reference.

In addition to sensitizing dyes, emulsions can contain dyes having no spectral sensitizing effect or substances not substantially absorbing visible light and presenting super-sensitization.

Sensitizing dyes can be added to an emulsion at any point conventionally known to be useful during the preparation of an emulsion. Most ordinarily, sensitizing dyes are added after the completion of chemical sensitization and before coating. However, it is possible to perform the addition simultaneously with the addition of chemical sensitizing dyes to thereby perform spectral sensitization and chemical sensitization at the same time, as described in U.S. Pat. Nos. 3,628,969 and 4,225,666, the disclosures of which are incorporated herein by reference. It is also possible to perform the addition prior to chemical sensitization, as described in JP-A-58-113928, the disclosure of which is incorporated herein by reference, or before the completion of the formation of a silver halide grain precipitate to thereby start spectral sensitization. Alternatively, as disclosed in U.S. Pat. No. 4,225,666, these sensitizing dyes can be added separately; a portion of the sensitizing dyes is added prior to chemical sensitization, and the rest is added after that. That is, sensitizing dyes can be added at any timing during the formation of silver halide grains, including the method disclosed in U.S. Pat. No. 4,183,756, the disclosure of which is incorporated herein by reference.

The addition amount of sensitizing dyes can be $4\times10^{-6}$ to $8\times10^{-3}$ mol per mol of a silver halide.

Use of a fragmentable electron-donating sensitizer is also recommended. Electron-donating sensitizers are described in U.S. Pat. Nos. 5,747,235, 5,747,236, 6,054,260 and 5,994,051, European Patent Nos. 786692A1 and 893732A1, JP-A's-2000-181001, 2000-180999, 2000-181002, 2000-181000, 2000-221626 and 2000-221628, the disclosures of which are incorporated herein by reference. The fragmentable electron-donating sensitizer may be used in any situation during the preparation of a lightsensitive material, for example, in grain formation, in a desalting step, in chemical sensitization and before coating. The agent may also be added separately a plurality of times during these steps. It is preferable that the compound of the present invention is used after being dissolved in any of water, a water-soluble solvent such as methanol and ethanol, and a mixed solvent of these. In the case of dissolving a compound in water, as for a compound the solubility of which increases when the pH is raised or lowered, it may be added after being dissolved by raising or lowering the pH. The fragmentable electron-donating sensitizer is preferably used in an emulsion layer, but it is also possible to add the agent, in advance, to a protective layer or an intermediate layer as well as an emulsion layer, thereby diffusing it at the time of application. The compound of the present invention may be added either before or after addition of a sensitizing dye. It is contained in a silver halide emulsion layer in a proportion of preferably from $1\times10^{-9}$ to $5\times10^{-2}$ mol, more preferably from $1\times10^{-8}$ to $2\times10^{-3}$ mol, per mol of silver halide.

When using a fragmentable electron-donating sensitizer, it is preferable to use a preservativity improver. As the preservativity improver, it is preferable to use compounds described in JP-A's-11-119364 and 2001-42466, the disclosures of which are incorporated herein by reference.

Although the emulsion of the present invention can be used any type of lightsensitive material, it is preferable to use emulsions for multi-layer color photographic lightsensitive materials, more preferably for blue-sensitive layers, and most preferably for blue-supersensitive layers in multi-layer color photographic lightsensitive materials. In such cases, a high sensitivity/granularity ratio can be obtained due to increase in the amount of the blue light absorbed based on a high silver iodide content or due to increase in the amount of the blue light absorbed based on increase in the amount of the sensitizing dye adsorbed resulting from a tabular shape. In addition, a high sensitivity/granularity ratio, an improvement in pressure characteristics, an improvement in preservation characteristics and an improvement in treatment dependency can be obtained due to an improvement in monodisperse of projected area diameters of grains and to decrease in distribution of silver iodide contents between grains. Furthermore, due to a tabular shape, light scattering is decreased and sharpness of an under layer is improved.

The lightsensitive material manufactured by using a silver halide emulsion of the present invention is required only to have at least one blue-sensitive silver halide emulsion layer, at least one green-sensitive silver halide emulsion layer and at least one red-sensitive silver halide emulsion layer on a support, and there is no particular restrictions on the number and order of the silver halide emulsion layers and the light-insensitive layers. A typical example is a silver halide photographic lightsensitive material having on a support at least one lightsensitive layer that comprises a plurality of silver halide emulsion layers color sensitivities of which are substantially identical but sensitivities of which are different, the lightsensitive layer being a unit lightsensitive layer having color sensitivity to any of blue light, green light, and red light, and in a multi-layer silver halide color photographic lightsensitive material, the arrangement of the unit lightsensitive layers is generally such that a red-sensitive layer, a green-sensitive layer, and a blue-sensitive layer in the order stated from the support side are placed. However, the above order may be reversed according to the purpose and such an order is possible that layers having the same color sensitivity have a layer different in color sensitivity therefrom between them.

Light-insensitive layers such as various intermediate layers may be placed between, on top of, or under the above-mentioned silver halide lightsensitive layers.

The intermediate layer may contain, for example, couplers and DIR compounds, as described in JP-A's-61-43748, 59-113438, 59-113440, 61-20037 and 61-20038, and may also contain a color-mixing inhibitor as generally used.

Each of the silver halide emulsion layers constituting unit lightsensitive layers respectively can preferably take a two-layer constitution comprising a high-sensitive emulsion layer and a low-sensitive emulsion layer, as described in West Germany Patent No. 1,121,470 or GB-923,045. Generally, they are preferably arranged such that the sensitivities are decreased toward the support and each light-insensitive layer may be placed between the silver halide emulsion layers. As described, for example, in JP-A's-57-112751, 62-200350, 62-206541 and 62-206543, a low-sensitive emulsion layer may be placed away from the support and a high-sensitive emulsion layer may be placed nearer to the support.

A specific example of the order includes an order of a low-sensitive blue-sensitive layer (BL)/high-sensitive blue-sensitive layer (BH)/high-sensitive green-sensitive layer (GH)/low-sensitive green-sensitive layer (GL)/high-sensitive red-sensitive layer (RH)/low-sensitive red-sensitive layer (RL), or an order of BH/BL/GL/GH/RH/RL, or an order of BH/BL/GH/GL/RL/RH stated from the side away from the support.

As described in JP-B-55-34932, an order of a blue-sensitive layer/GH/RH/GL/RL stated from the side away from the support is also possible. Further as described in JP-A's-56-25738 and 62-63936, an order of a blue-sensitive layer/GL/RL/GH/RH stated from the side away from the support is also possible.

Further as described in JP-B-49-15495, an arrangement is possible wherein the uppermost layer is a silver halide emulsion layer highest in sensitivity, the intermediate layer is a silver halide emulsion layer lower in sensitivity than that of the uppermost layer, the lower layer is a silver halide emulsion layer further lower in sensitivity than that of the intermediate layer so that the three layers different in sensitivity may be arranged with the sensitivities successively lowered toward the support. Even in such a constitution comprising three layers different in sensitivity, an order of a medium-sensitive emulsion layer/high-sensitive emulsion layer/low-sensitive emulsion layer stated from the side away from the support may be taken in layers identical in color sensitivity as described in JP-A-59-202464.

Further, for example, an order of a high-sensitive emulsion layer/low-sensitive emulsion layer/medium-sensitive emulsion layer or an order of a low-sensitive emulsion layer/medium-sensitive emulsion layer/high-sensitive emulsion layer may be taken. In the case of four or more layers, the arrangement may be varied as above.

Moreover, as JP-A's-2000-305228 and 2000-314940 disclose, it is also possible to dispose a silver halide tabular grain-containing reflection layer in which no image will be formed after exposure.

As described above, various layer constructions and layer arrangements are available in accordance with the purpose of each lightsensitive material.

Although the various additives described above can be used in a light-sensitive material according to the present invention, a variety of other additives can also be used in accordance with the intended use.

The details of these additives are described in RD Item 17643 (December, 1978), Item 18716 (November, 1979), and Item 308119 (December, 1989), and these portions are summarized in a table below.

| | Additives | RD17643 | RD18716 |
|---|---|---|---|
| 1. | Chemical sensitizers | page 23 | page 648, right column |
| 2. | Sensitivity increasing agents | | do |
| 3. | Spectral sensitizers, super sensitizers | pages 23–24 | page 648, right column to page 649, right column |
| 4. | Brighteners | page 24 | page 647, right column |
| 5. | Antifoggants and stabilizers | pages 24–25 | page 649, right column |
| 6. | Light absorbents, filter dyes, ultraviolet absorbents | pages 25–26 | page 649, right column to page 650, left column |
| 7. | Stain preventing agents | page 25, right column | page 650, left to right columns |
| 8. | Dye image stabilizers | page 25 | |
| 9. | Hardening agents | page 26 | page 651, left column |
| 10. | Binders | page 26 | do |

-continued

| | Additives | RD17643 | RD18716 |
|---|---|---|---|
| 11. | Plasticizers, lubricants | page 27 | page 650, right column |
| 12. | Coating aids, surface active agents | pages 26–27 | do |
| 13. | Antistatic agents | page 27 | do |
| 14. | Matting agents | | |

| | Additives | RD308119 |
|---|---|---|
| 1. | Chemical sensitizers | page 996 |
| 2. | Sensitivity increasing agents | |
| 3. | Spectral sensitizers, super sensitizers | page 996, right column to page 998, right column |
| 4. | Brighteners | page 998, right column |
| 5. | Antifoggants and stabilizers | page 998, right column to page 1,000, right column |
| 6. | Light absorbents, filter dyes, ultraviolet absorbents | page 1,003, left to right columns |
| 7. | Stain preventing agents | page 1,002, right column |
| 8. | Dye image stabilizers | page 1,002, right column |
| 9. | Hardening agents | page 1,004, right column to page 1,005, left column |
| 10. | Binders | page 1,003, right column to page 1,004, right column |
| 11. | Plasticizers, lubricants | page 1,006, left to right columns |
| 12. | Coating aids, surface active agents | page 1,005, left column to page 1,006, left column |
| 13. | Antistatic agents | page 1,006, right column to page 1,007, left column |
| 14. | Matting agents | page 1,008, left column to page 1,009, left column |

In order to prevent deterioration in photographic properties caused by formaldehyde gas, a compound described in U.S. Pat. Nos. 4,411,987 or 4,435,503, which can react with and fix formaldehyde, is preferably added to a light-sensitive material.

Various color couplers can be used in the present invention, and specific examples of these couplers are described in patents described in above-mentioned RD No. 17643, VII-C to VII-G and No. 307105, VII-C to VII-G.

Preferred examples of a yellow coupler are described in, e.g., U.S. Pat. Nos. 3,933,501, 4,022,620, 4,326,024, 4,401,752, and 4,248,961, JP-B-58-10739, British Patent Nos. 1,425,020 and 1,476,760, U.S. Pat. Nos. 3,973,968, 4,314,023, and 4,511,649, and European Patent No. 249,473A.

Examples of a magenta coupler are preferably 5-pyrazolone and pyrazoloazole compounds, and more preferably, compounds described in, e.g., U.S. Pat. Nos. 4,310,619 and 4,351,897, European Patent No. 73,636, U.S. Pat. Nos. 3,061,432 and 3,725,067, RD No. 24220 (June 1984), JP-A-60-33552, RD No. 24230 (June 1984), JP-A-60-43659, JP-A-61-72238, JP-A-60-35730, JP-A-55-

118034, and JP-A-60-185951, U.S. Pat. Nos. 4,500,630, 4,540,654, and 4,556,630, and WO88/04795.

Examples of a cyan coupler are phenol and naphthol couplers, preferably those described in, e.g., U.S. Pat. Nos. 4,052,212, 4,146,396, 4,228,233, 4,296,200, 2,369,929, 2,801,171, 2,772,162, 2,895,826, 3,772,002, 3,758,308, 4,334,011, and 4,327,173, West German Patent Publication No. 3,329,729, European Patent Nos. 121,365A and 249, 453A, U.S. Pat. Nos. 3,446,622, 4,333,999, 4,775,616, 4,451,559, 4,427,767, 4,690,889, 4,254,212, and 4,296,199, and JP-A-61-42658.

Typical examples of a polymerized dye-forming coupler are described in U.S. Pat. Nos. 3,451,820, 4,080,211, 4,367, 282, 4,409,320, and 4,576,910, British Patent No. 2,102, 137, and European Patent No. 341,188A.

Preferred examples of a coupler capable of forming colored dyes having proper diffusibility are those described in U.S. Pat. No. 4,366,237, British Patent No. 2,125,570, European Patent No. 96,570, and West German Patent (Publication) No. 3,234,533.

Preferred examples of a colored coupler for correcting unnecessary absorption of a colored dye are those described in RD No. 17643, VII-G and No. 307105, VII-G, U.S. Pat. No. 4,163,670, JP-B-57-39413, U.S. Pat. Nos. 4,004,929 and 4,138,258, and British Patent No. 1,146,368. A coupler for correcting unnecessary absorption of a colored dye by a fluorescent dye released upon coupling described in U.S. Pat. No. 4,774,181 or a coupler having a dye precursor group which can react with a developing agent to form a dye as a split-off group described in U.S. Pat. No. 4,777,120 can be preferably used.

Couplers releasing a photographically useful residue upon coupling are preferably used in the present invention. DIR couplers, i.e., couplers releasing a development inhibitor are described in the patents cited in the above-described RD No. 17643, VII-F, RD No. 307105, VII-F, JP-A-57-151944, JP-A-57-154234, JP-A-60-184248, JP-A-63-37346, JP-A-63-37350, and U.S. Pat. Nos. 4,248,962 and 4,782,012.

Favored examples of a coupler for imagewise releasing a nucleating agent or a development accelerator are described in British Patent Nos. 2,097,140 and 2,131,188, JP-A-59-157638, and JP-A-59-170840. It is also preferable to use compounds described in JP-A-60-107029, JP-A-60-252340, JP-A-1-44940, and JP-A-1-45687, which release, e.g., a fogging agent, a development accelerator, or a silver halide solvent upon a redox reaction with the oxidation product of a developing agent.

Examples of other couplers which can be used in a light-sensitive material of the present invention are competing couplers described in, e.g., U.S. Pat. No. 4,130,427; poly-equivalent couplers described in, e.g., U.S. Pat. Nos. 4,283,472, 4,338,393, and 4,310,618; a DIR redox compound releasing coupler, a DIR coupler releasing coupler, a DIR coupler releasing redox compound, or a DIR redox releasing redox compound described in, e.g., JP-A-60-185950 and JP-A-62-24252; couplers releasing a dye which turns to a colored form after being released described in European Patent Nos. 173,302A and 313,308A; bleaching accelerator releasing couplers described in, e.g., RD. Nos. 11449 and 24241 and JP-A-61-201247; a ligand releasing coupler described in, e.g., U.S. Pat. No. 4,555,477; a coupler releasing a leuco dye described in JP-A-63-75747; and a coupler releasing a fluorescent dye described in U.S. Pat. No. 4,774,181.

Couplers for use in the present invention can be added to a light-sensitive material by various known dispersion methods.

Examples of a high-boiling organic solvent to be used in an oil-in-water dispersion method are described in, e.g., U.S. Pat. No. 2,322,027.

Examples of a high-boiling organic solvent having a boiling point of 175° C. or more at atmospheric pressure to be used in the oil-in-water dispersion method are phthalic esters (e.g., dibutylphthalate, dicyclohexylphthalate, di-2-ethylhexylphthalate, decylphthalate, bis(2,4-di-tert-amylphenyl)phthalate, bis(2,4-di-tert-amylphenyl) isophthalate, and bis(1,1-diethylpropyl)phthalate); phosphates or phosphonates (e.g., triphenylphosphate, tricresylphosphate, 2-ethylhexyldiphenylphosphate, tricyclohexylphosphate, tri-2-ethylhexylphosphate, tridodecylphosphate, tributoxyethylphosphate, trichloropropylphosphate, and di-2-ethylhexylphenylphosphonate); benzoates (e.g., 2-ethylhexylbenzoate, dodecylbenzoate, and 2-ethylhexyl-p-hydroxybenzoate); amides (e.g., N,N-diethyldodecaneamide, N,N-diethyllaurylamide, and N-tetradecylpyrrolidone); alcohols or phenols (e.g., isostearylalcohol and 2,4-di-tert-amylphenol); aliphatic carboxylates (e.g., bis(2-ethylhexyl)sebacate, dioctylazelate, glyceroltributylate, isostearyllactate, and trioctylcitrate); an aniline derivative (e.g., N,N-dibutyl-2-butoxy-5-tert-octylaniline); and hydrocarbons (e.g., paraffin, dodecylbenzene, and diisopropylnaphthalene). An organic solvent having a boiling point of about 30° C. or more, and preferably, 50° C. to about 160° C. can be used as a co-solvent. Typical examples of the co-solvent are ethyl acetate, butyl acetate, ethyl propionate, methylethylketone, cyclohexanone, 2-ethoxyethylacetate, and dimethylformamide.

The steps and effects of a latex dispersion method and examples of an impregnating latex are described in, e.g., U.S. Pat. No. 4,199,363 and West German Patent Application (OLS) Nos. 2,541,274 and 2,541,230.

Phenethyl alcohol and various types of an antiseptic agent or a mildewproofing agent are preferably added to a color light-sensitive material of the present invention. Examples of the antiseptic agent and the mildewproofing agent are 1,2-benzisothiazoline-3-one, n-butyl-p-hydroxybenzoate, phenol, 4-chloro-3,5-dimethylphenol, 2-phenoxyethanol, and 2-(4-thiazolyl)benzimidazole described in JP-A-63-257747, JP-A-62-272248, and JP-A-1-80941.

The present invention can be applied to various color light-sensitive materials. Examples of the material are a color negative film for general purposes or motion pictures, a color reversal film for slides or television, color paper, a color positive film, and color reversal paper. The present invention is also particularly preferably usable as a color dupe film.

A support which can be suitably used in the present invention is described in, e.g., RD. No. 17643, page 28, RD. No. 18716, from page 647, right column to page 648, left column, and RD. No. 307105, page 879.

In a light-sensitive material containing the emulsion of the present invention, the sum total of film thicknesses of all hydrophilic colloidal layers on the side having emulsion layers is preferably 28 $\mu$m or less, more preferably, 23 $\mu$m or less, further preferably, 18 $\mu$m or less, and most preferably, 16 $\mu$m or less. A film swell speed $T_{1/2}$ is preferably 30 sec or less, and more preferably, 20 sec or less. The film thickness means a film thickness measured under moisture conditioning at a temperature of 25° C. and a relative humidity of 55% (two days). The film swell speed $T_{1/2}$ can be measured in accordance with a known method in this field of art. For example, the film swell speed $T_{1/2}$ can be measured by using a swell meter described in Photogr. Sci Eng., A. Green et al., Vol. 19, No. 2, pp. 124–129. When 90% of a maximum swell film thickness reached by performing processing by using a color developing agent at 30° C. for 3 min and 15 sec is defined as a saturated film thickness, $T_{1/2}$ is defined as a time required for reaching ½ of the saturated film thickness.

The film swell speed $T_{1/2}$ can be adjusted by adding a film hardening agent to gelatin as a binder or changing aging conditions after coating.

In a light-sensitive material containing the emulsion of the present invention, hydrophilic colloid layers (called back layers) having a total dried film thickness of 2 to 20 μm are preferably formed on the side of a support away from the side having emulsion layers. The back layers preferably contain, e.g., the light absorbent, the filter dye, the ultraviolet absorbent, the antistatic agent, the film hardener, the binder, the plasticizer, the lubricant, the coating aid, and the surfactant described above. The swell ratio of the back layers is preferably 150% to 500%.

A color photographic light-sensitive material according to the present invention can be developed by conventional methods described in RD. No. 17643, pp. 28–29, RD. No. 18716, p. 651, the left to right column, and RD No. 307105, pp. 880–881.

A color developer used in the development of a light-sensitive material of the present invention is preferably an aqueous alkaline solution mainly consisting of an aromatic primary amine-based color developing agent. As this color developing agent, although an aminophenol-based compound is effective, a p-phenylenediamine-based compound is preferably used. Typical examples of the p-phenylenediamine-based compound are 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylani line, 3-methyl-4-amino-N-ethyl-β-methoxyethylaniline, and sulfates, hydrochlorides, and p-toluenesulfonates thereof. Of these compounds, sulfate of 3-methyl-4-amino-N-ethyl-N-β-hydroxyethylaniline is most preferred. Two or more types of these compounds can be used jointly in accordance with the application.

In general, the color developer contains a pH buffering agent such as a carbonate, a borate, or a phosphate of an alkali metal, and a development restrainer or an antifoggant such as a bromide, an iodide, benzimidazoles, benzothiazoles, or a mercapto compound. If necessary, the color developer can also contain a preservative such as hydroxylamine, diethylhydroxylamine, a sulfite, hydrazines such as N,N-biscarboxymethylhydrazine, phenylsemicarbazides, triethanolamine, or catechol sulfonic acids; an organic solvent such as ethyleneglycol or diethyleneglycol; a development accelerator such as benzylalcohol, polyethyleneglycol, a quaternary ammonium salt, or amines; a dye forming coupler, a competing coupler, and an auxiliary developing agent such as 1-phenyl-3-pyrazolidone; a viscosity imparting agent; and various chelating agents represented by aminopolycarboxylic acid, aminopolyphosphonic acid, alkylphosphonic acid, and phosphonocarboxylic acid. Representative examples of the chelating agent are ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N,N-tetramethylenephosphonic acid, ethylenediamine-di(o-hydroxyphenylacetic acid), and salts of these acids.

In order to perform reversal development, black-and-white development is performed and then color development is performed.

As a black-and-white developer, well-known black-and-white developing agents, e.g., dihydroxybenzenes such as hydroquinone, 3-pyrazolidones such as 1-phenyl-3-pyrazolidone, and aminophenols such as N-methyl-p-aminophenol can be used singly or in combination. The pH of the color and black-and-white developers is generally 9 to 12. Although the replenishment rate of these developers depends on a color photographic light-sensitive material to be processed, it is generally 3 liters (liters will be also referred to as "L" hereinafter) or less per $m^2$ of a light-sensitive material. The replenishment rate can be decreased to 500 milliliters (milliliters will be also referred to as "mL" hereinafter) or less by decreasing a bromide ion concentration in the replenisher. In order to decrease the replenishment rate, the area of contact of a processing solution with air is preferably decreased to prevent evaporation and air oxidation of the solution.

The area of contact of a photographic processing solution with air in a processing tank can be represented by an aperture rate defined below:

$$\text{Aperture rate}=[\text{area } (cm^2) \text{ of contact of processing solution with air}]\div[\text{volume } (cm^3) \text{ of processing solution}]$$

The above aperture rate is preferably 0.1 or less, and more preferably, 0.001 to 0.05. In order to reduce the aperture rate, a shielding member such as a floating cover can be placed on the liquid surface of the photographic processing solution in the processing tank. In addition, a method of using a movable cover described in JP-A-1-82033 or a slit developing method described in JP-A-63-216050 can be used. The aperture is preferably reduced not only in color and black-and-white development steps but also in all subsequent steps, e.g., bleaching, bleach-fixing, fixing, washing, and stabilizing steps. In addition, the replenishment rate can be reduced by using a means of suppressing storage of bromide ions in the developing solution.

The color development time is normally two to five minutes. The processing time, however, can be shortened by setting high temperature and high pH and using the color developing agent at high concentration.

A photographic emulsion layer is generally subjected to bleaching after color development. Bleaching can be performed either simultaneously with fixing (bleach-fixing) or independently thereof. In addition, in order to increase the processing speed, bleach-fixing can be performed after bleaching. Also, the processing can be performed in a bleach-fixing bath having two continuous tanks, fixing can be performed before bleach-fixing, or bleaching can be performed after bleach-fixing, in accordance with the application. Examples of the bleaching agent are a compound of a multivalent metal such as iron(III), peroxides (in particular, soda persulfate is suited to color negative motion picture films), quinones, and a nitro compound. Typical examples of the bleaching agent are organic complex salts of iron(III), e.g., complex salts of aminopolycarboxylic acids such as ethylenediaminetetraacetic acid, diethylenetriaminepentaacetic acid, cyclohexanediaminetetraacetic acid, methyliminodiacetic acid, and 1,3-diaminopropanetetraacetic acid, and glycoletherdiaminetetraacetic acid, and complex salts of citric acid, tartaric acid, and malic acid. Of these compounds, iron(III) complex salts of aminopolycarboxylic acid such as iron(III) complex salts of ethylenediaminetetraacetic acid and 1,3-diaminopropanetetraacetic acid are preferred because they can increase the processing speed and prevent environmental contamination. The iron(III) complex salt of aminopolycarboxylic acid is particularly useful in both the bleaching and bleach-fixing solutions. The pH of the bleaching or bleach-fixing solution using the iron(III) complex salt of aminopolycarboxylic acid is normally 4.0 to 8. In order to increase the processing speed, however, the processing can be performed at lower pH.

A bleaching accelerator can be used in the bleaching solution, the bleach-fixing solution, and their pre-bath, if necessary. Useful examples of the bleaching accelerator are: compounds having a mercapto group or a disulfide group described in, e.g., U.S. Pat. No. 3,893,858, West German Patent Nos. 1,290,812 and 2,059,988, JP-A-53-32736, JP-A-53-57831, JP-A-53-37418, JP-A-53-72623, JP-A-53-95630, JP-A-53-95631, JP-A-53-104232, JP-A-53-124424, and JP-A-53-141623, and JP-A-53-18426, and RD No. 17129 (July, 1978); a thiazolidine derivative described in JP-A-51-140129; thiourea derivatives described in JP-B-45-8506, JP-A-52-20832, JP-A-53-32735, and U.S. Pat. No. 3,706,561, and iodide salts described in West German Patent No. 1,127,715 and JP-A-58-16235; polyoxyethylene compounds described in West German Patent Nos. 966,410 and 2,748,430; polyamine compounds described in JP-B-45-8836; compounds described in JP-A-49-40943, JP-A-49-59644, JP-A-53-94927, JP-A-54-35727, JP-A-55-26506, and JP-A-58-163940; and bromide ion. Of these compounds, a compound having a mercapto group or a disulfide group is preferable since the compound has a large accelerating effect. In particular, compounds described in U.S. Pat. No. 3,893,858, West German Patent No. 1,290,812, and JP-A-53-95630 are preferred. Compounds described in U.S. Pat. No. 4,552,884 are also preferred. These bleaching accelerators can be added to a light-sensitive material. These bleaching accelerators are useful especially in bleach-fixing of a photographic color light-sensitive material.

The bleaching solution or the bleach-fixing solution preferably contains, in addition to the above compounds, an organic acid in order to prevent bleaching stains. The most preferable organic acid is a compound having an acid dissociation constant (pKa) of 2 to 5, e.g., acetic acid, propionic acid, or hydroxy acetic acid.

Examples of the fixing agent and the bleach-fixing agent are thiosulfate, thiocyanate, a thioether-based compound, thioureas, and a large amount of iodide salt. Of these compounds, the use of thiosulfate is common, and especially ammonium thiosulfate can be used in the widest range of applications. In addition, a combination of thiosulfate and, e.g., thiocyanate, a thioether-based compound, or thiourea is preferably used. As a preservative of the fixing solution or the bleach-fixing solution, sulfite, bisulfite, a carbonyl bisulfite adduct, or a sulfinic acid compound described in EP294,769A is preferred. Furthermore, in order to stabilize the fixing solution or the bleach-fixing solution, various types of aminopolycarboxylic acids or organic phosphonic acids are preferably added to the solution.

In the present invention, 0.1 to 10 mol/L of a compound having a pKa of 6.0 to 9.0 are preferably added to the fixing solution or the bleach-fixing solution in order to adjust the pH. It is preferable to add 0.1 to 10 mols/L of imidazoles such as imidazole, 1-methylimidazole, 1-ethylimidazole, and 2-methylimidazole.

The total time of a delivering step is preferably as short as possible provided that no delivering defect occurs. The time is preferably one to three minutes, and more preferably, one to two minutes. A processing temperature is 25° C. to 50° C., and preferably, 35° C. to 45° C. Within the preferable temperature range, the delivering speed is increased, and the generation of stains after the processing can be effectively prevented.

In the delivering step, stirring is preferably as strong as possible. Examples of a method of strengthening stirring are a method of colliding a jet stream of the processing solution against the emulsion surface of a light-sensitive material described in JP-A-62-183460, and a method of increasing the stirring effect using rotating means described in JP-A-62-183461. Other examples are a method of moving a light-sensitive material while the emulsion surface is brought into contact with a wiper blade placed in a solution to cause disturbance on the emulsion surface, thereby improving the stirring effect, and a method of increasing the circulating flow amount in an overall processing solution. Such a stirring improving means is effective in any of the bleaching solution, the bleach-fixing solution, and the fixing solution. Improving stirring presumably accelerates the supply of the bleaching agent and the fixing agent into an emulsion film to thereby increase the delivering rate. The above stirring improving means is more effective when the bleaching accelerator is used, i.e., this means can significantly increase the accelerating effect or eliminate fixing interference caused by the bleaching accelerator.

An automatic processor for processing a light-sensitive material containing the emulsion of the present invention preferably has a light-sensitive material conveyor means described in JP-A-60-191257, JP-A-60-191258, or JP-A-60-191259. As described in JP-A-60-191257, this conveyor means can significantly reduce carry-over of a processing solution from a pre-bath to a post-bath, thereby effectively preventing degradation in performance of the processing solution. This effect significantly shortens especially the processing time of each processing step and reduces the replenishment rate of a processing solution.

A silver halide color photographic light-sensitive material containing the emulsion of the present invention is normally subjected to a washing step and/or a stabilizing step after delivering. The amount of water used in the washing step can be arbitrarily determined over a broad range in accordance with the properties (e.g., a property determined by a material used such as a coupler) of the light-sensitive material, the application of the material, the temperature of the water, the number of water tanks (the number of stages), a replenishing method such as a counter or forward current, and other diverse conditions. The relationship between the amount of water and the number of water tanks in a multi-stage counter-current method can be obtained by a method described in "Journal of the Society of Motion Picture and Television Engineering", Vol. 64, pp. 248–253 (May, 1955).

According to the above-described multi-stage counter-current method, the amount of water used for washing can be greatly decreased. Since washing water stays in the tanks for a long period of time, however, bacteria multiply and floating substances stick to a light-sensitive material. In order to solve this problem in the processing of a color light-sensitive material of the present invention, a method of decreasing calcium and magnesium ions described in JP-A-62-288838 can be very effectively used. It is also possible to use an isothiazolone compound, cyabendazoles, and a chlorine-based germicide such as chlorinated sodium isocyanurate described in JP-A-57-8542, and germicides such as benzotriazole described in Hiroshi Horiguchi et al., "Chemistry of Antibacterial and Antifungal Agents", (1986), Sankyo Shuppan, Eiseigijutsu-Kai ed., "Sterilization, Antibacterial, and Antifungal Techniques for Microorganisms", (1982), Kogyogijutsu-Kai, and Nippon Bokin Bokabi Gakkai ed., "Dictionary of Antibacterial and Antifungal Agents", (1986).

The pH of the water for washing a light-sensitive material containing the emulsion of the present invention is 4 to 9, preferably 5 to 8. The water temperature and the washing time can vary in accordance with the properties and applications of a light-sensitive material. Normally, the washing time is 20 sec to 10 min at a temperature of 15° C. to 45° C., preferably 30 sec to 5 min at 25° C. to 40° C. A light-sensitive material of the present invention can be processed directly by a stabilizing agent in place of washing. All known methods described in JP-A-57-8543, JP-A-58-14834, and JP-A-60-220345 can be used in such a stabilizing process.

Stabilizing is sometimes performed subsequently to washing. An example is a stabilizing bath containing a dye stabilizing agent and a surface-active agent to be used as a final bath of a color light-sensitive material for photography. Examples of the dye stabilizing agent are aldehydes such as formalin and glutaraldehyde, an N-methylol compound, hexamethylenetetramine, and an aldehyde sulfurous acid adduct. Various chelating agents or antifungal agents can be added to the stabilizing bath.

An overflow solution produced upon washing and/or replenishment of the stabilizing solution can be reused in another step such as a desilvering step.

In processing using an automatic processor or the like, if each processing solution described above is condensed by evaporation, water is preferably added to correct the condensation.

A silver halide color photographic light-sensitive material containing the emulsion of the present invention can contain a color developing agent in order to simplify the processing and increase the processing speed. For this purpose, various types of precursors of the color developing agent can be preferably used. Examples of the precursor are indoaniline-based compounds described in U.S. Pat. No. 3,342,597, e.g., Schiff base compounds described in U.S. Pat. No. 3,342,599 and RD Nos. 14,850 and 15,159, aldol compounds described in RD No. 13,924, metal salt complexes described in U.S. Pat. No. 3,719,492, and urethane-based compounds described in JP-A-53-135628.

A silver halide color light-sensitive material containing the emulsion of the present invention can contain various 1-phenyl-3-pyrazolidones in order to accelerate color development, if necessary. Typical examples of the compound are described in JP-A-56-64339, JP-A-57-144547, and JP-A-58-115438.

Each processing solution in the present invention is used at a temperature of 10° C. to 50° C. Although a normal processing temperature is 33° C. to 38° C., processing can be accelerated at higher temperatures to shorten the processing time, or the image quality or the stability of a processing solution can be improved at lower temperatures.

A silver halide light-sensitive material of the present invention can be applied to thermal development light-sensitive materials described in, e.g., U.S. Pat. No. 4,500,626, JP-A-60-133449, JP-A-59-218443, JP-A-61-238056, and European Patent No. 210,660A2.

When a silver halide color photographic light-sensitive material containing the emulsion of the present invention is applied to a film unit with lens, such as described in JP-B-2-32615 or Jpn. UM Appln. KOKOKU Publication No. 3-39784, the effects of the present invention can be achieved more easily.

The present invention will be described in more detail below by way of its examples. However, the present invention is not limited to these examples.

EXAMPLE-1

Silver halide seed emulsions and silver halide emulsions Em-A1 to Em-A20 and Em-B to Em-P were prepared by the following processes.

Seed Emulsion 1

The preparation of seed emulsion 1 was performed with reference to the process for the preparation of silver halide tabular grains described in Example 2 in JP-A-10-293372. One liter of a dispersion medium solution containing 0.38 g of KBr and 0.5 g of low molecular weight gelatin (molecular weight: 15,000) was held at 40° C. in a reaction vessel. While stirring this solution, 20 cc of a 0.29 mol/liter aqueous silver nitrate solution and 20 cc of a 0.29 mol/liter aqueous KBr solution were added thereto simultaneously over 40 seconds. After the addition, 22 cc of a 10% KBr solution was added and then the temperature was raised to 75° C. After that, an aqueous gelatin solution (60° C.) comprising 35 g of trimellitated gelatin and 250 cc of water was added to the dispersion medium solution. During the addition, the pH was adjusted to 6.0. Thereafter, a 1.2 mol/liter aqueous silver nitrate solution and a 1.2 mol/liter aqueous KBr solution were added simultaneously. At this time, silver iodide fine grains in such an amount that the amount of silver iodide became 10 mol % of the amount of silver nitrate to be added. During the addition, the pBr of the dispersion medium was kept at 2.64. The resulting dispersion medium solution was washed with water, followed by the addition of gelatin to adjust conditions: the pH to 5.7, the pAg to 8.8, the mass, in terms of silver per kg of emulsion, to 131.8 g, and the mass of gelatin to 64.1 g. Thus, seed emulsion 1 was obtained. In the emulsion obtained, grains having a silver iodide content of 10 mol %, an equivalent-sphere diameter of 0.7 $\mu$m and an aspect ratio of 28 accounted for 97% of total projected area.

Seed Emulsion 2

The preparation of seed emulsion 1 was performed with reference to the process for the preparation of silver halide tabular grains described in Example 2 in JP-A-10-293372. One liter of a dispersion medium solution containing 0.54 g of NaCl and 0.5 g of low molecular weight gelatin (molecular weight: 15,000) was held at 40° C. in a reaction vessel. While stirring this solution, 20 cc of a 0.29 mol/liter aqueous silver nitrate solution and 20 cc of a 0.29 mol/liter aqueous halide salt (KBr, NaCl) solution of KBr/NaCl=80/20 in molar ratio were added thereto simultaneously over 40 seconds. After the addition, 25.8 cc of a 10% KBr solution was added and then the temperature was raised to 75° C. After that, an aqueous gelatin solution (60° C.) comprising 35 g of trimellitated gelatin and 250 cc of water was added to the dispersion medium solution. During the addition, the pH was adjusted to 6.0. Thereafter, a 1.2 mol/liter aqueous silver nitrate solution and a 1.2 mol/liter aqueous KBr solution were added simultaneously. At this time, silver iodide fine grains in such an amount that the amount of silver iodide became 10 mol % of the amount of silver nitrate to be added. During the addition, the pBr of the dispersion medium was kept at 2.64. The resulting dispersion medium solution was washed with water, followed by the addition of gelatin to adjust conditions: the pH to 5.7, the pAg to 8.8, the mass, in terms of silver per kg of emulsion, to 131.8 g, and the mass of gelatin to 64.1 g. Thus, seed emulsion 2 was obtained. In the emulsion obtained, grains having a silver iodide content of 10 mol %, an equivalent-sphere diameter of 0.7 $\mu$m and an aspect ratio of 28 accounted for 97% of total projected area.

Em-A1

1211 mL of an aqueous solution containing 46 g of trimellitated gelatin having a trimellitation degree of 97% and 1.7 g of KBr was vigorously stirred at 75° C. After addition of 48 g of the above-described seed emulsion 1, 0.3 g of modified silicone oil (L7602 manufactured by Nippon Unicar Co. Ltd.) was added. After the adjustment of the pH to 5.5 with $H_2SO_4$, 67.6 mL of an aqueous solution containing 7.0 g of $AgNO_3$ and an aqueous mixed solution containing both KI and KBr with 10% of KI were added over 6 minutes by the double-jet method while the flow rate was accelerated such that the final flow rate became 5.1 times the initial flow rate. During the addition, the silver potential was held at +0 mV with respect to a saturated calomel electrode. After addition of 2 mg of sodium benzenethiosulfinate and 2 mg of thiourea dioxide, 600 mL of an aqueous solution containing 170 g of $AgNO_3$ and an aqueous mixed solution containing both KI and KBr with 10% of KI were added over 120 minutes by the double-jet method while the flow rate was accelerated such that the final flow rate became 3.7 times the initial flow rate. During the addition, the silver potential was held at +10 mV with respect to a saturated calomel electrode. 150 mL of an aqueous solution containing 46.8 g of $AgNO_3$ and an aqueous KBr solution were added over 22 minutes by the double-jet method. During the addition, the silver potential was held at +20 mV with respect to a saturated calomel electrode. After washing with water, gelatin was added to adjust the pH to 5.8 and the pAg to 8.7 at 40° C. Subsequent to addition of compounds 1 and 2, the temperature was raised to 60° C. After addition of sensitizing dyes 1 and 2, potassium thiocyanate, chloroauric acid, sodium thiosulfate and N,N-dimethylselenourea were added to perform optimum chemical sensitization. At the completion of the chemical sensitization, compounds 3 and 4 were added. "To perform optimum chemical sensitization" stated here means that the amounts of each sensitizing dye and each compound to be added were selected in the range of from $10^{-1}$ mol to $10^{-8}$ mol per mol of silver halide.

Compound 1

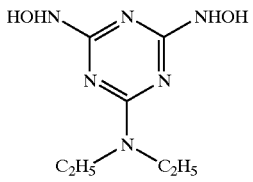

Compound 2

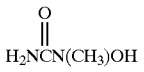

Sensitizing dye 1

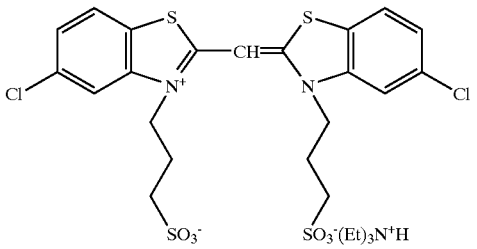

-continued

Sensitizing dye 2

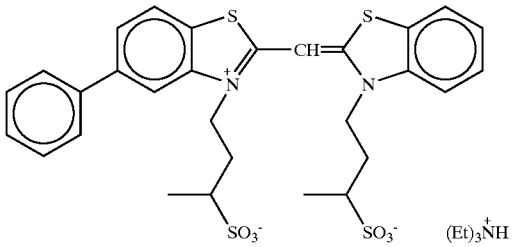

Compound 3

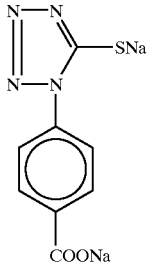

Compound 4

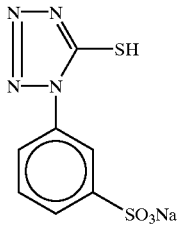

Em-A2

1211 mL of an aqueous solution containing 46 g of trimellitated gelatin having a trimellitation degree of 97% and 1.7 g of KBr was vigorously stirred at 75° C. After addition of 48 g of the above-described seed emulsion 1, 0.3 g of modified silicone oil (L7602 manufactured by Nippon Unicar Co. Ltd.) was added. After the adjustment of the pH to 5.5 with $H_2SO_4$, 67.6 mL of an aqueous solution containing 7.0 g of $AgNO_3$ and an aqueous mixed solution containing both KI and KBr with 10% of KI were added over 6 minutes by the double-jet method while the flow rate was accelerated such that the final flow rate became 5.1 times the initial flow rate. During the addition, the silver potential was held at −40 mV with respect to a saturated calomel electrode. After addition of 2 mg of sodium benzenethiosulfinate and 2 mg of thiourea dioxide, 600 mL of an aqueous solution containing 170 g of $AgNO_3$ and an aqueous mixed solution containing both KI and KBr with 10% of KI were added over 120 minutes by the double-jet method while the flow rate was accelerated such that the final flow rate became 3.7 times the initial flow rate. During the addition, the silver potential was held at −40 mV with respect to a saturated calomel electrode. 150 mL of an aqueous solution containing 46.8 g of $AgNO_3$ and an aqueous KBr solution were added over 22 minutes by the double-jet method. During the addition, the silver potential was held at −20 mV with respect to a saturated calomel electrode. After washing with water, gelatin was added to adjust the pH to 5.8 and the pAg to 8.7 at 40° C. After that, chemical sensitization was carried out in the same manner as that employed in the preparation of Em-A1.

Em-A3

1211 mL of an aqueous solution containing 46 g of trimellitated gelatin having a trimellitation degree of 97% and 1.7 g of KBr was vigorously stirred at 75° C. After addition of 48 g of the above-described seed emulsion 1, 0.3 g of modified silicone oil (L7602 manufactured by Nippon Unicar Co. Ltd.) was added. After the adjustment of the pH to 5.5 with $H_2SO_4$, 67.6 mL of an aqueous solution containing 7.0 g of $AgNO_3$ and an aqueous mixed solution containing both KI and KBr with 10 mol % of KI were added over 6 minutes by the double-jet method while the flow rate was accelerated such that the final flow rate became 5.1 times the initial flow rate. During the addition, the silver potential was held at +0 mV with respect to a saturated calomel electrode. After addition of 2 mg of sodium benzenethiosulfinate and 2 mg of thiourea dioxide, 600 mL of an aqueous solution containing 153 g of $AgNO_3$ and an aqueous KBr solution were added over 120 minutes by the double-jet method while the flow rate was accelerated such that the final flow rate became 3.7 times the initial flow rate. The emulsion of AgI fine grains having a grain size of 0.037 μm was simultaneously added at an accelerated flow rate so that the silver iodide content became 10 mol %. Also, the silver potential was held at −30 mV with respect to a saturated calomel electrode. 150 mL of an aqueous solution containing 46.8 g of $AgNO_3$ and an aqueous KBr solution were added over 22 minutes by the double-jet method. During the addition, the silver potential was held at −20 mV with respect to a saturated calomel electrode. After washing with water, gelatin was added to adjust the pH to 5.8 and the pAg to 8.7 at 40° C. After that, chemical sensitization was carried out in the same manner as that employed in the preparation of Em-A1.

Em-A4

1211 mL of an aqueous solution containing 46 g of trimellitated gelatin having a trimellitation degree of 97% and 1.7 g of KBr was vigorously stirred at 75° C. After addition of 48 g of the above-described seed emulsion 1, 0.3 g of modified silicone oil (L7602 manufactured by Nippon Unicar Co. Ltd.) was added. After the adjustment of the pH to 5.5 with $H_2SO_4$, 67.6 mL of an aqueous solution containing 7.0 g of $AgNO_3$ and an aqueous mixed solution containing both KI and KBr with 3 mol % of KI were added over 6 minutes by the double-jet method while the flow rate was accelerated such that the final flow rate became 5.1 times the initial flow rate. During the addition, the silver potential was held at +0 mV with respect to a saturated calomel electrode. After addition of 2 mg of sodium benzenethiosulfinate and 2 mg of thiourea dioxide, 600 mL of an aqueous solution containing 165 g of $AgNO_3$ and an aqueous KBr solution were added over 120 minutes by the double-jet method while the flow rate was accelerated such that the final flow rate became 3.7 times the initial flow rate. The emulsion of AgI fine grains having a grain size of 0.037 μm was simultaneously added at an accelerated flow rate so that the silver iodide content became 3 mol %. Also, the silver potential was held at −30 mV with respect to a saturated calomel electrode. 150 mL of an aqueous solution containing 46.8g of $AgNO_3$ and an aqueous KBr solution were added over 22 minutes by the double-jet method. During the addition, the silver potential was held at +10 mV with respect to a saturated calomel electrode. After washing with water, gelatin was added to adjust the pH to 5.8 and the pAg to 8.7 at 40° C. After that, chemical sensitization was carried out in the same manner as that employed in the preparation of Em-A1.

Em-A5

1211 mL of an aqueous solution containing 46 g of trimellitated gelatin having a trimellitation degree of 97% and 1.7 g of KBr was stirred vigorously at 75° C. After addition of 48 g of the above-described seed emulsion 1, 0.3 g of modified silicone oil (L7602 manufactured by Nippon Unicar Co. Ltd.) was added. After the adjustment of the pH to 5.5 with $H_2SO_4$, 67.6 mL of an aqueous solution containing 7.0 g of $AgNO_3$ and an aqueous mixed solution containing both KI and KBr with 10% of KI were added over 6 minutes by the double-jet method while the flow rate was accelerated such that the final flow rate became 5.1 times the initial flow rate. During the addition, the silver potential was held at +0 mV with respect to a saturated calomel electrode. After addition of 2 mg of sodium benzenethiosulfinate and 2 mg of thiourea dioxide, an emulsion containing AgBrI fine grains (average grain size: 0.015 mm) having a silver iodide content of 10 mol % was prepared by simultaneous additions of 762 mL of an aqueous solution containing 170 g of $AgNO_3$ and 762 mL of an aqueous solution containing 107.1 g of KBr, 16.6g of KI and 76.2g of gelatin having an average molecular weight of 20000 to a stirring device that was located outside the reaction vessel, and simultaneously the emulsion of AgBrI fine grains was added into a reaction vessel over 120 minutes. During the addition, the silver potential was held at −30 mV with respect to a saturated calomel electrode. 150 mL of an aqueous solution containing 46.8 g of $AgNO_3$ and an aqueous KBr solution were added over 22 minutes by the double-jet method. During the addition, the silver potential was held at +10 mV with respect to a saturated calomel electrode. Following washing with water, gelatin was added to adjust the pH to 5.8 and the pAg to 8.7 at 40° C. After that, chemical sensitization was carried out in the same manner as that employed in the preparation of Em-A1.

Em-A6

1211 mL of an aqueous solution containing 46 g of trimellitated gelatin having a trimellitation degree of 97% and 1.7 g of KBr was stirred vigorously at 75° C. After addition of 48 g of the above-described seed emulsion 1, 0.3 g of modified silicone oil (L7602 manufactured by Nippon Unicar Co. Ltd.) was added. After the adjustment of the pH to 5.5 with $H_2SO_4$, 67.6 mL of an aqueous solution containing 7.0 g of $AgNO_3$ and an aqueous mixed solution containing both KI and KBr with 10% of KI were added over 6 minutes by the double-jet method while the flow rate was accelerated such that the final flow rate became 5.1 times the initial flow rate. During the addition, the silver potential was held at +0 mV with respect to a saturated calomel electrode. After addition of 2 mg of sodium benzenethiosulfinate and 2 mg of thiourea dioxide, an emulsion containing AgBrI fine grains (average grain size: 0.015 mm) having a silver iodide content of 10 mol % was prepared by simultaneous additions of 762 mL of an aqueous solution containing 170 g of $AgNO_3$ and 762 mL of an aqueous solution containing 107.1 g of KBr, 16.6 g of KI and 76.2 g of gelatin having an average molecular weight of 20000 to a stirring device that was located outside the reaction vessel, and simultaneously the emulsion of AgBrI fine grains was added into a reaction vessel over 120 minutes. During the addition, the silver potential was held at −30 mV with respect to a saturated calomel electrode. 75 mL of an aqueous solution containing 23.4 g of $AgNO_3$ and an aqueous KBr solution were added over 11 minutes by the double-jet method. During the addition, the silver potential was held at +10 mV with respect to a saturated calomel electrode. The temperature was raised to 82° C. and the silver potential was adjusted to −80 mV by the addition of KBr. Thereafter the AgI fine grain emulsion having a grain size of 0.037 μm was added in an amount of 2.28 g in terms of KI mass. Immediately after the addition, 100.2 mL of an aqueous solution containing 23.4 g of $AgNO_3$ was added over 10 minutes. For 5 minutes during the first addition, the silver potential was kept at −80 mV with an aqueous KBr solution. Following washing with water, gelatin was added to adjust the pH to 5.8 and the pAg to 8.7 at 40° C. After that, chemical sensitization was carried out in the same manner as that employed in the preparation of Em-A1.

Em-A7

1211 mL of an aqueous solution containing 46 g of trimellitated gelatin having a trimellitation degree of 97% and 1.7 g of KBr was stirred vigorously at 75° C. After addition of 48 g of the above-described seed emulsion 1, 0.3 g of modified silicone oil (L7602 manufactured by Nippon Unicar Co. Ltd.) was added. After the adjustment of the pH to 5.5 with $H_2SO_4$, 67.6 mL of an aqueous solution containing 7.0 g of $AgNO_3$ and an aqueous mixed solution containing both KI and KBr with 10% of KI were added over 6 minutes by the double-jet method while the flow rate was accelerated such that the final flow rate became 5.1 times the initial flow rate. During the addition, the silver potential was held at +0 mV with respect to a saturated calomel electrode. After addition of 2 mg of sodium benzenethiosulfinate and 2 mg of thiourea dioxide, an emulsion containing AgBrI fine grains (average grain size: 0.015 mm) having a silver iodide content of 10 mol % was prepared by simultaneous additions of 762 mL of an aqueous solution containing 170 g of $AgNO_3$ and 762 mL of an aqueous solution containing 107.1 g of KBr, 16.6 g of KI and 76.2 g of gelatin having an average molecular weight of 20000 to a stirring device that was located outside the reaction vessel, and simultaneously the emulsion of AgBrI fine grains was added into a reaction vessel over 120 minutes. During the addition, the silver potential was held at −30 mV with respect to a saturated calomel electrode. 75 mL of an aqueous solution containing 23.4 g of $AgNO_3$ and an aqueous KBr solution were added over 11 minutes by the double-jet method. During the addition, the silver potential was held at +10 mV with respect to a saturated calomel electrode. The temperature was lowered to 40° C. and the silver potential was adjusted to −40 mV by the addition of KBr. Thereafter an aqueous solution containing 14.5 g of sodium p-iodoacetamidobenzenesulfonate was added and 57 cc of a 0.8M aqueous sodium sulfite solution was added subsequently at a constant rate for one minute, thereby forming iodide ion while adjusting the pH to 9.0. After two minutes from the addition of the sodium sulfite solution, the temperature was raised to 55° C. over 15 minutes and then the pH was returned to 5.5. After that, 100.2 mL of an aqueous solution containing 23.4 g of $AgNO_3$ was added over 16 minutes. During the addition, the silver potential was kept at −50 mV with an aqueous KBr solution. Following washing with water, gelatin was added to adjust the pH to 5.8 and the pAg to 8.7 at 40° C. After that, chemical sensitization was carried out in the same manner as that employed in the preparation of Em-A1.

Em-A8

An emulsion (Em-A8) was prepared in the same manner as that employed in the preparation of Em-A7. After addition of compounds 1 and 2, the temperature was raised to 60° C. Following addition of sensitizing dyes 1 and 2, potassium thiocyanate, bis(1,4,5-trimethyl-1,2,4-triazolium-3-thiolate gold) (1) tetrafluoroborate, carboxymethyltrimethylthiourea and N,N-dimethylselenourea were added to perform optimum chemical sensitization. At the completion of the chemical sensitization, compounds 3 and 4 were added. "To perform optimum chemical sensitization" stated here means that the amounts of each sensitizing dye and each compound to be added were selected in the range of from $10^{-1}$ mol to $10^{-8}$ mol per mol of silver halide.

Em-A9

An emulsion (Em-A9) was prepared in the same manner as that employed in the preparation of Em-A7. After addition of compounds 1 and 2, the temperature was raised to 60° C. Following addition of sensitizing dyes 1 and 2, potassium thiocyanate, bis(1,4,5-trimethyl-1,2,4-triazolium-3-thiolate gold) (1) tetrafluoroborate, carboxymethyltrimethylthiourea and N,N-dimethylselenourea were added to perform optimum chemical sensitization. During the chemical sensitization, compound 5 was added in an amount of $1\times10^{-4}$ mol/mol-Ag. At the completion of the chemical sensitization, compounds 3 and 4 were added. "To perform optimum chemical sensitization" stated here means that the amounts of each sensitizing dye and each compound to be added were selected in the range of from $10^{-1}$ mol to $10^{-8}$ mol per mol of silver halide.

Compound 5

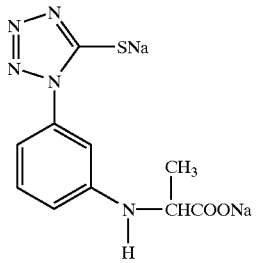

Em-A10

1211 mL of an aqueous solution containing 46 g of trimellitated gelatin having a trimellitation degree of 97% and 1.7 g of KBr was stirred vigorously at 75° C. After addition of 48 g of the above-described seed emulsion 1, 0.3 g of modified silicone oil (L7602 manufactured by Nippon Unicar Co. Ltd.) was added. After the adjustment of the pH to 5.5 with $H_2SO_4$, 67.6 mL of an aqueous solution containing 7.0 g of $AgNO_3$ and an aqueous mixed solution containing both KI and KBr with 10% of KI were added over 6 minutes by the double-jet method while the flow rate was accelerated such that the final flow rate became 5.1 times the initial flow rate. During the addition, the silver potential was held at +0 mV with respect to a saturated calomel electrode. After addition of 2 mg of sodium benzenethiosulfinate and 2 mg of thiourea dioxide, an emulsion containing AgBrI fine grains (average grain size: 0.015 mm) having a silver iodide content of 10 mol % was prepared by simultaneous additions of 762 mL of an aqueous solution containing 170 g of $AgNO_3$ and 762 mL of an aqueous solution containing 107.1 g of KBr, 16.6 g of KI and 76.2 g of gelatin having an average molecular weight of 20000 to a stirring device that was located outside the reaction vessel, and simultaneously the emulsion of AgBrI fine grains was added into a reaction vessel over 120 minutes. During the addition, the silver potential was held at −30 mV with respect to a saturated calomel electrode. 131 mL of an aqueous solution containing 58.5 g of $AgNO_3$ and an aqueous mixed solution containing both KI and KBr with 10 mol % of KI were added over 30 minutes by the double-jet method. For the first 20 minutes of the addition, the silver potential was held at +10 mV with respect to a saturated calomel electrode and for the remaining 10 minutes at 120 mV. The temperature was lowered to 50° C. and then 55 mL of a 0.3% aqueous KI solution was added over 10 minutes. Immediately after that addition, 18.8 mL of an aqueous solution containing 8.4 g of $AgNO_3$, 20 mL of an aqueous solution containing 1.44 g of NaCl and 2.35 g of KBr, and a solution containing 0.005 mol of AgI fine grains were added simultaneously. During the addition, $K_4[RuCN_6]$ were allowed to exist in an amount of $8.0\times10^{-4}$ mol per mol of $AgNO_3$ to be added. Subsequently, a sensitizing dye was added (for the purpose of stabilizing epitaxy). Following washing with water, gelatin was added to adjust the pH to 5.8 and the pAg to 8.7 at 40° C. After that, chemical sensitization was carried out in the same manner as that employed in the preparation of Em-A9.

Em-A11

Em-A11 was obtained in the same manner as that employed in the production of Em-A1 except using seed emulsion 2 in place of seed emulsion 1.

Em-A12

Em-A12 was obtained in the same manner as that employed in the production of Em-A2 except using seed emulsion 2 in place of seed emulsion 1.

Em-A13

Em-A13 was obtained in the same manner as that employed in the production of Em-A3 except using seed emulsion 2 in place of seed emulsion 1.

Em-A14

Em-A14 was obtained in the same manner as that employed in the production of Em-A4 except using seed emulsion 2 in place of seed emulsion 1.

Em-A15

Em-A15 was obtained in the same manner as that employed in the production of Em-A5 except using seed emulsion 2 in place of seed emulsion 1.

Em-A16

Em-A16 was obtained in the same manner as that employed in the production of Em-A6 except using seed emulsion 2 in place of seed emulsion 1.

Em-A17

Em-A17 was obtained in the same manner as that employed in the production of Em-A7 except using seed emulsion 2 in place of seed emulsion 1.

Em-A18

Em-A18 was obtained in the same manner as that employed in the production of Em-A8 except using seed emulsion 2 in place of seed emulsion 1.

Em-A19

Em-A19 was obtained in the same manner as that employed in the production of Em-A9 except using seed emulsion 2 in place of seed emulsion 1.

Em-A20

Em-A20 was obtained in the same manner as that employed in the production of Em-A10 except using seed emulsion 2 in place of seed emulsion 1.

Em-B 1192 mL of an aqueous solution containing 0.96 g of low molecular weight gelatin and 0.9 g of KBr was kept at 40° C. and was stirred vigorously. 37.5 mL of an aqueous solution containing 1.49 g of $AgNO_3$ and 37.5 mL of an aqueous solution containing 1.5 g of KBr were added over 30 seconds by the double-jet method. After 1.2 g of KBr was added, the temperature was raised to 75° C. and the mixture was ripened. After a full ripening, 30 g of trimellitated gelatin with a weight average molecular weight of 100,000, formed by chemically modifying an amino group thereof with trimellitic acid, was added and the pH was adjusted to 7.6 mg of thiourea dioxide was added. 116 mL of an aqueous solution containing 29 g of $AgNO_3$ and an aqueous KBr solution were added by the double-jet method while the flow rate was accelerated such that the final flow rate became 3 times the initial flow rate. During the addition, the silver potential was held at −20 mV with respect to a saturated calomel electrode. 440.6 mL of an aqueous solution containing 110.2 g of $AgNO_3$ and an aqueous KBr solution were added over 30 minutes by the double-jet method while the flow rate was accelerated such that the final flow rate became 5.1 times the initial flow rate. During the addition, the AgI fine grain emulsion used in the preparation of Em-A was simultaneously added at an accelerated flow rate so that the silver iodide content became 15.8 mol %. Also, the silver potential was held at 0 mV with respect to the saturated calomel electrode. 96.5 mL of an aqueous solution containing 24.1 g of $AgNO_3$ and an aqueous KBr solution were added over 3 minutes by the double-jet method. During the addition, the silver potential was held at 0 mV. After 26 mg of sodium ethylthiosulfonate was added, the temperature was lowered to 55° C. and an aqueous KBr solution was added to adjust the silver potential to −90 mV. The aforementioned AgI fine grain emulsion was added in an amount of 8.5 g in terms of KI mass. Immediately after the addition, 228 mL of an aqueous solution containing 57 g of $AgNO_3$ was added over 5 minutes. During the addition, an aqueous KBr solution was used to adjust the potential at the end of the addition to +20 mV. The resultant emulsion was washed with water and was chemically sensitized in almost the same manner as that employed in the preparation of Em-A1.

Em-C 1192 mL of an aqueous solution containing 1.02 g of phthalated gelatin containing 35 μmol of methionine per gram and having a weight average molecular weight of 100,000 and a phthalation degree of 97% and 0.97 g of KBr was kept at 35° C. and was stirred vigorously. 42 mL of an aqueous solution containing 4.47 g of $AgNO_3$ and 42 mL of an aqueous solution containing 3.16 g of KBr were added over 9 seconds by the double-jet method. After 2.6 g of KBr was added, the temperature was raised to 66° C. and the mixture was ripened fully. After the completion of the ripening, 41.2 g of the trimellitated gelatin with a weight average molecular weight of 100,000, which was used in the preparation of Em-B, and 18.5 g of NaCl were added. After the pH was adjusted to 7.2, 8 mg of dimethylamineborane was added. 203 mL of an aqueous solution containing 26 g of $AgNO_3$ and an aqueous KBr solution were added by the double-jet method while the flow rate was accelerated such that the final flow rate became 3.8 times the initial flow rate. During the addition, the silver potential was held at −30 mV with respect to a saturated calomel electrode. 440.6 mL of an aqueous solution containing 110.2 g of $AgNO_3$ and an aqueous KBr solution were added over 24 minutes by the double-jet method while the flow rate was accelerated such that the final flow rate became 5.1 times the initial flow rate. During the addition, the AgI fine grain emulsion used in the preparation of Em-A was simultaneously added at an accelerated flow rate so that the silver iodide content became 2.3 mol %. Also, the silver potential was held at −20 mV with respect to the saturated calomel electrode. After 10.7 mL of an 1N aqueous potassium thiocyanate solution was added, 153.5 mL of an aqueous solution containing 24.1 g of $AgNO_3$ and an aqueous KBr solution were added over 2 minutes and 30 seconds by the double-jet method. During the addition, the silver potential was held at 10 mV. An aqueous KBr solution was added to adjust the silver potential to −70 mV. The aforementioned AgI fine grain emulsion was added in an amount of 6.4 g in terms of KI mass. Immediately after the addition, 404 mL of an aqueous solution containing 57 g of $AgNO_3$ was added over 45 minutes. During the addition, an aqueous KBr solution was used to adjust the potential at the end of the addition to −30 mV. The resultant emulsion was washed with water and was chemically sensitized in almost the same manner as that employed in the preparation of Em-Al.

Em-D

The addition amount of $AgNO_3$ during the nucleation in the preparation of Em-C was increased by 2.0 times. Also, modification was made so that the potential at the completion of the final addition of 404 mL of the aqueous solution containing 57 g of $AgNO_3$ was adjusted to +90 mV by use of an aqueous KBr solution. Em-D was prepared following almost the same procedures as employed in the preparation of Em-C except the foregoing.

Em-E 1200 mL of an aqueous solution containing 0.71 g of low molecular weight gelatin having a weight average molecular weight of 15000, 0.92 g of KBr and 0.2 g of modified silicon oil, which was used in the preparation of Em-A, was kept at 39° C., adjusted to pH 1.8 and stirred vigorously. An aqueous solution containing 0.45 g of $AgNO_3$ and an aqueous KBr solution containing 1.5 mol % of KI were added over 17 seconds by the double-jet method. During the addition, the excess concentration of KBr was kept constant. The temperature was raised to 56° C. and the mixture was ripened. After a full ripening, 20 g of phthalated gelatin containing 35 $\mu$mol of methionine per gram and having a weight average molecular weight of 100000 and a phthalation degree of 97% was added. After the pH was adjusted to 5.9, 2.9 g of KBr was added. 288 mL of an aqueous solution containing 28.8 g of $AgNO_3$ and an aqueous KBr solution were added by the double-jet method over 53 minutes. During the addition, the AgI fine grain emulsion used in the preparation of Em-A was simultaneously added so that the silver iodide content became 4.1 mol %, and the silver potential was held at −60 mV with respect to a saturated calomel electrode. After 2.5 g of KBr was added, an aqueous solution containing 87.7 g of $AgNO_3$ and an aqueous KBr solution were added over 63 minutes by the double-jet method while the flow rate was accelerated such that the final flow rate became 1.2 times the initial flow rate. During the addition, the aforementioned AgI fine grain emulsion was simultaneously added at an accelerated flow rate so that the silver iodide content became 10.5 mol %. Also, the silver potential was held at −70 mV. After 1 mg of thiourea dioxide was added, 132 mL of an aqueous solution containing 41.8 g of $AgNO_3$ and an aqueous KBr solution were added over 25 minutes by the double-jet method. The addition of the aqueous KBr solution was adjusted so that the potential at the completion of the addition became +20 mV. After 2 mg of sodium benzenethiosulfate was added, the pH was adjusted to 7.3. After the silver potential was adjusted to −70 mV by addition of KBr, the aforementioned AgI fine grain emulsion was added in an amount of 5.73 g in terms of KI mass. Immediately after the addition, 609 mL of an aqueous solution containing 66.4 g of $AgNO_3$ was added over 10 minutes. For the first 6 minutes of the addition, the silver potential was held at −70 mV using an aqueous KBr solution. After washing with water, gelatin was added to adjust the pH to 6.5 and the pAg to 8.2 at 40° C. Subsequent to addition of compounds 1 and 2, the temperature was raised to 56° C. After the aforementioned AgI fine grain emulsion was added in an amount of 0.0004 mol per mol of silver, sensitizing dyes 3 and 4 were added. Further, potassium thiocyanate, chloroauric acid, sodium thiosulfate and N,N-dimethylselenourea were added to perform optimum chemical sensitization. At the completion of the chemical sensitization, compounds 3 and 4 were added.

Sensitizing dye 3

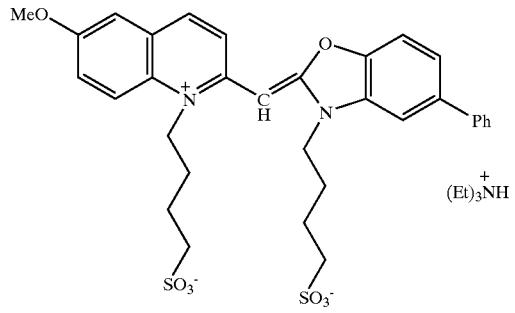

Sensitizing dye 4

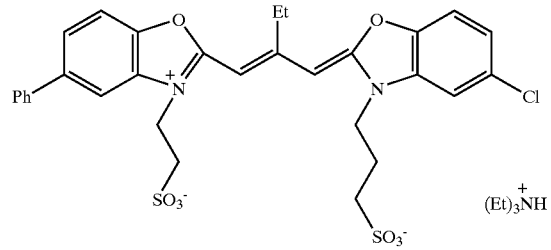

Em-F

Em-F was prepared in almost the same manner as that employed in the preparation of Em-E except that the addition amount of $AgNO_3$ during nucleation was increased by 3.1 times. It is to be noted that the sensitizing dyes used for Em-E were changed to sensitizing dyes 5, 6 and 7.

Sensitizing dye 5

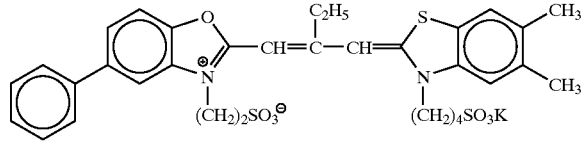

-continued

Sensitizing dye 6

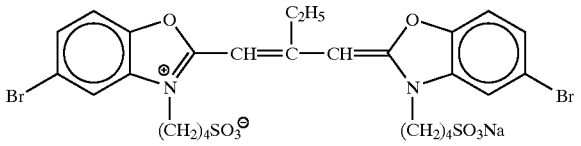

Sensitizing dye 7

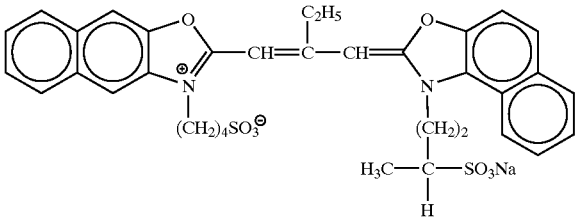

Em-G 1200 mL of an aqueous solution containing 0.70 g of low molecular weight gelatin having a weight average molecular weight of 15000, 0.9 g of KBr, 0.175 g of KI and 0.2 g of modified silicon oil, which was used in the preparation of Em-A, was kept at 33° C., adjusted to pH 1.8 and stirred vigorously. An aqueous solution containing 1.8 g of $AgNO_3$ and an aqueous KBr solution containing 3.2 mol % of KI were added over 9 seconds by the double-jet method. During the addition, the excess concentration of KBr was kept constant. The temperature was raised to 69° C. and the mixture was ripened. After the completion of the ripening, 27.8 g of trimellitated gelatin with a weight average molecular weight of 100000, formed by chemically modifying an amino group thereof with trimellitic acid, containing 35 μmol of methionine per gram was added. After the pH was adjusted to 6.3, 2.9 g of KBr was added. 270 mL of an aqueous solution containing 27.58 g of $AgNO_3$ and an aqueous KBr solution were added by the double-jet method over 37 minutes. During the addition, an AgI fine grain emulsion having a grain size of 0.008 μm, which was prepared by mixing, immediately before the addition, an aqueous solution of a low molecular weight gelatin having a weight average molecular weight of 15000, an aqueous $AgNO_3$ solution and an aqueous KI solution in another chamber having a magnetic coupling induction type stirrer described in JP-A-10-43570, was added simultaneously so that the silver iodide content became 4.1 mol %, and the silver potential was held at −60 mV with respect to a saturated calomel electrode. After 2.6 g of KBr was added, an aqueous solution containing 87.7 g of $AgNO_3$ and an aqueous KBr solution were added over 49 minutes by the double-jet method while the flow rate was accelerated such that the final flow rate became 3.1 times the initial flow rate. During the addition, the aforementioned AgI fine grain emulsion prepared by mixing immediately before the addition was simultaneously added at an accelerated flow rate so that the silver iodide content became 7.9 mol %. Also, the silver potential was held at −70 mV. After 1 mg of thiourea dioxide was added, 132 mL of an aqueous solution containing 41.8 g of $AgNO_3$ and an aqueous KBr solution were added over 20 minutes by the double-jet method. The addition of the aqueous KBr solution was adjusted so that the potential at the completion of the addition became +20 mV. After the temperature was raised to 78° C. and the pH was adjusted to 9.1, KBr was added to adjust the potential to −60 mV. The AgI fine grain emulsion used in the preparation of Em-A was added in an amount of 5.73 g in terms of KI mass. Immediately after the completion of the addition, 321 mL of an aqueous solution containing 66.4 g of $AgNO_3$ was added over 4 minutes. For the first 2 minutes of the addition, the silver potential was held at −60 mV with an aqueous KBr solution. The resultant emulsion was washed with water and chemically sensitized in almost the same manner as that employed in the preparation of Em-F.

Em-H

An aqueous solution containing 17.8 g of ion-exchanged gelatin with a molecular weight of 100000, 6.2 g of KBr, and 0.46 g of KI was stirred vigorously at 45° C. An aqueous solution containing 11.85 g of $AgNO_3$ and an aqueous solution containing 3.8 g of KBr were added over 47 seconds by the double-jet method. After the temperature was raised to 63° C., 24.1 g of ion-exchanged gelatin with a molecular weight of 100000 was added to ripen the material. After a full ripening, an aqueous solution containing 133.4 g of $AgNO_3$ and an aqueous KBr solution was added over 20 min by the double-jet method such that the final flow rate was 2.6 times the initial flow rate. During the addition, the silver potential was held at +40 mV with respect to a saturated calomel electrode. Also, 10 minutes after the start of the addition 0.1 mg of $K_2IrCl_6$ was added. After 7 g of NaCl was added, an aqueous solution containing 45.6 g of $AgNO_3$ and an aqueous KBr solution were added over 12 minutes by the double-jet method. During the addition, the silver potential was held at +90 mV with respect to the saturated calomel electrode. Also, for 6 minutes from the start of the addition, 100 mL of an aqueous solution containing 29 mg of yellow prussiate of potash was added. After 14.4 g of KBr was added, the AgI fine grain emulsion used in the preparation of Em-A was added in an amount of 6.3 g in terms of KI mass. Immediately after the addition, an aqueous solution containing 42.7 g of $AgNO_3$ and an aqueous KBr solution were added over 11 minutes by the double-jet method. During the addition, the silver potential was held at +90 mV. The resultant emulsion was washed with water and chemically sensitized in almost the same manner as that employed in the preparation of Em-F.

Em-I

Em-I was prepared in almost the same manner as that employed in the preparation of Em-H except that the temperature during nucleation was changed to 38° C.

Em-J 1200 mL of an aqueous solution containing 0.38 g of phthalated gelatin having a weight average molecular weight of 100000 and having a phthalation degree of 97% and 0.99 g of KBr was kept at 60° C., adjusted to pH 2 and stirred vigorously. An aqueous solution containing 1.96 g of $AgNO_3$ and an aqueous solution containing 1.97 g of KBr and 0.172 g of KI were added over 30 seconds by the double-jet method. After the completion of ripening, 12.8 g of trimellitated gelatin with a weight average molecular weight of 100000, formed by chemically modifying an amino group thereof with trimellitic acid, containing 35 μmol of methionine per gram was added. After the pH was adjusted to 5.9, 2.99 g of KBr and 6.2 g of NaCl were added. 60.7 mL of an aqueous solution containing 27.3 g of $AgNO_3$ and an aqueous KBr solution were added by the double-jet method over 35 minutes. During the addition, the silver potential was held at −50 mV with respect to a saturated calomel electrode. An aqueous solution containing 65.6 g of $AgNO_3$ and an aqueous KBr solution were added over 37 minutes by the double-jet method while the flow rate was accelerated such that the final flow rate became 2.1 times the initial flow rate. During the addition, the aforementioned AgI fine grain emulsion used in the preparation of Em-A was simultaneously added at an accelerated flow rate so that the silver iodide content became 6.5 mol %. Also, the silver potential was held at −50 mV. After 1.5 mg of thiourea dioxide was added, 132 mL of an aqueous solution containing 41.8 g of $AgNO_3$ and an aqueous KBr solution were added over 13 minutes by the double-jet method. The addition of the aqueous KBr solution was adjusted so that the potential at the completion of the addition became +40 mV. After 2 mg of sodium benzenethiosulfate was added, the silver potential was adjusted to −100 mV by addition of KBr. The aforementioned AgI fine grain emulsion was added in an amount of 6.2 g in terms of KI mass. Immediately after the addition, 300 mL of an aqueous solution containing 88.5 g of $AgNO_3$ was added over 8 minutes. An aqueous KBr solution was used to adjust the potential at the end of the addition to +60 mV. After washing with water, gelatin was added to adjust the pH to 6.5 and the pAg to 8.2 at 40° C. Subsequent to addition of compounds 1 and 2, the temperature was raised to 61° C. After addition of sensitizing dyes 8, 9, 10 and 11, potassium thiocyanate, chloroauric acid, sodium thiosulfate and N,N-dimethylselenourea were added to perform optimum chemical sensitization. At the completion of the chemical sensitization, compounds 3 and 4 were added.

Sensitizing dye 8

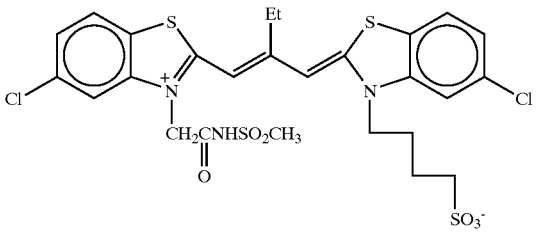

Sensitizing dye 9

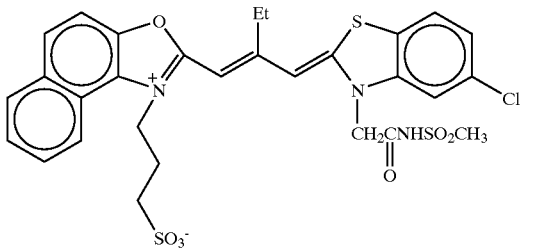

Sensitizing dye 10

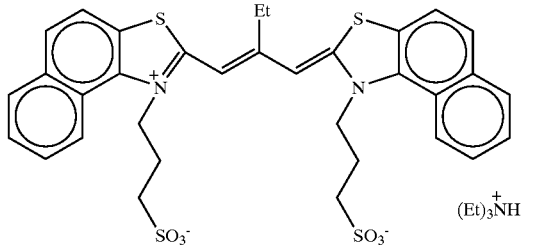

-continued

Sensitizing dye 11

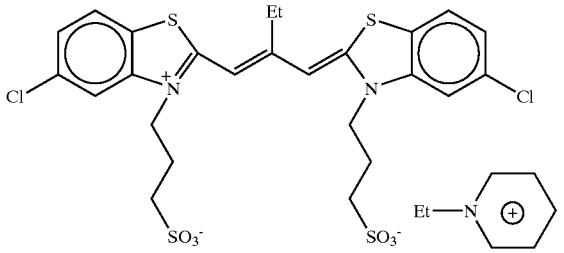

Em-K 1200 mL of an aqueous solution containing 4.9 g of low molecular weight gelatin having a weight average molecular weight of 15000 and 5.3 g of KBr was kept at 60° C. and was stirred vigorously. 27 mL of an aqueous solution containing 8.75 g of $AgNO_3$ and 36 mL of an aqueous solution containing 6.45 g of KBr were added over one minute by the double-jet method. After the temperature was raised to 77° C., 21 mL of an aqueous solution containing 6.9 g of $AgNO_3$ was added over 2.5 minutes. After 3.26 g of $NH_4NO_3$ and 56 mL of 1N NaOH were added in order, the mixture was ripened. After the completion of the ripening, the pH was adjusted to 4.8. 438 mL of an aqueous solution containing 141 g of $AgNO_3$ and 458 mL of an aqueous solution containing 102.6 g of KBr were added by the double-jet method such that the final flow rate became 4 times the initial flow rate. After the temperature was lowered to 55° C., 240 mL of an aqueous solution containing 7.1 g of $AgNO_3$ and an aqueous solution containing 6.46 g of KI were added by the double-jet method over 5 minutes. After 7.1 g of $AgNO_3$, 4 mg of sodium benzenethiosulfate and 0.05 mg of $K_2IrCl_6$ were added. 177 mL of an aqueous solution containing 57.2 g of $AgNO_3$ and 233 mL of an aqueous solution containing 40.2 g of KBr were added over 8 minutes by the double-jet method. The resultant emulsion was washed with water and was chemically sensitized in almost the same manner as that employed in the preparation of Em-J.

Em-L

Em-L was prepared in almost the same manner as in the preparation of Em-K except that the temperature during nucleation was changed to 42° C.

Em-M, N, O

Em-M, N, O were prepared in almost the same manner as in the preparation of Em-H or Em-I, provided that chemical sensitization was performed in almost the same manner as in the preparation of Em-J.

Em-P

Em-P was obtained by performing chemical sensitization while sensitizing dyes in Em-J were changed to 5, 6 and 7.

Characteristics of the thus obtained silver halide emulsions Em-A1 to A20 are shown in Table 1. Characteristics of silver halide emulsions Em-A1 to Em-A20 and Em-B to Em-P are shown in Table 2.

TABLE 1

| Emulsion | Average silver iodide content/mol % (COV %*) | Average equivalent sphere diameter/μm (COV %*) | Average projected area diameter/μm (COV %*) | Average grain thickness/μm (COV %*) | Average aspect ratio | Principal plane | Ratio of occupation by grains having silver iodide content of 7 mol % or more/% | Ratio of occupation by grains having projected area diameter of 3 μm or more/% | Ratio of occupation by grains having aspect ratio of 8 or more/% | Ratio of area of (100) face relative to average area of side face/% | Remark |
|---|---|---|---|---|---|---|---|---|---|---|---|
| Em-A1 | 8.0 (23) | 1.7 (10) | 2.9 (25) | 0.39 (20) | 7.4 | (111) face | 94 | 25 | 28 | 40 | Comp. |
| Em-A2 | 8.0 (15) | 1.7 (12) | 3.6 (32) | 0.25 (18) | 14.4 | (111) face | 96 | 79 | 87 | 30 | Comp. |
| Em-A3 | 8.0 (8) | 1.7 (12) | 3.8 (24) | 0.23 (18) | 16.4 | (111) face | 98 | 81 | 90 | 32 | Inv. |
| Em-A4 | 2.7 (6) | 1.7 (12) | 3.9 (24) | 0.21 (17) | 18.8 | (111) face | 0 | 85 | 93 | 33 | Comp. |
| Em-A5 | 8.0 (9) | 1.7 (12) | 4.7 (22) | 0.15 (16) | 31.2 | (111) face | 98 | 90 | 99 | 33 | Inv. |
| Em-A6 | 9.0 (10) | 1.7 (13) | 4.4 (23) | 0.17 (17) | 25.8 | (111) face | 99 | 87 | 99 | 32 | Inv. |
| Em-A7 | 9.0 (10) | 1.7 (12) | 4.3 (22) | 0.18 (16) | 23.7 | (111) face | 99 | 85 | 99 | 33 | Inv. |
| Em-A8 | 9.0 (10) | 1.7 (12) | 4.3 (22) | 0.18 (16) | 23.7 | (111) face | 99 | 85 | 99 | 32 | Inv. |
| Em-A9 | 9.0 (10) | 1.7 (12) | 4.3 (22) | 0.18 (16) | 23.7 | (111) face | 99 | 85 | 99 | 31 | Inv. |
| Em-A10 | 9.5 (9) | 1.7 (12) | 4.5 (23) | 0.17 (17) | 26.4 | (111) face | 99 | 85 | 99 | 32 | Inv. |
| Em-A11 | 8.0 (23) | 1.7 (10) | 3.1 (25) | 0.37 (20) | 7.5 | (111) face | 95 | 26 | 28 | 65 | Comp. |
| Em-A12 | 8.0 (15) | 1.7 (12) | 3.8 (32) | 0.23 (18) | 14.6 | (111) face | 97 | 79 | 87 | 62 | Inv. |
| Em-A13 | 8.0 (8) | 1.7 (12) | 3.8 (24) | 0.22 (18) | 16.9 | (111) face | 99 | 83 | 90 | 63 | Inv. |
| Em-A14 | 2.7 (6) | 1.7 (12) | 4.0 (24) | 0.20 (17) | 19.5 | (111) face | 0 | 86 | 93 | 63 | Comp. |
| Em-A15 | 8.0 (9) | 1.7 (12) | 4.8 (22) | 0.13 (16) | 31.9 | (111) face | 99 | 92 | 99 | 64 | Inv. |
| Em-A16 | 9.0 (10) | 1.7 (13) | 4.6 (23) | 0.15 (17) | 26.5 | (111) face | 99 | 88 | 99 | 62 | Inv. |
| Em-A17 | 9.0 (10) | 1.7 (12) | 4.5 (22) | 0.16 (16) | 24.4 | (111) face | 99 | 86 | 99 | 63 | Inv. |
| Em-A18 | 9.0 (10) | 1.7 (12) | 4.5 (22) | 0.16 (16) | 24.4 | (111) face | 99 | 85 | 99 | 63 | Inv. |
| Em-A19 | 9.0 (10) | 1.7 (12) | 4.5 (22) | 0.16 (16) | 24.4 | (111) face | 99 | 86 | 99 | 62 | Inv. |
| Em-A20 | 9.5 (9) | 1.7 (12) | 4.7 (23) | 0.14 (17) | 28.0 | (111) face | 99 | 85 | 99 | 64 | Inv. |

*COV % expresses variation coefficient.
With respect to silver iodide content, it expresses variation coefficient of distribution of silver iodide content between grains.

TABLE 2

Characteristics of grains contained in silver halide emulsions Em-A1 to Em-A20 and Em-B to Em-P

| Emulsion No. | Layer comprising the emulsion | Equivalent-sphere diameter/μm | Aspect ratio | Content of I/mol % | Content of Cl/mol % |
|---|---|---|---|---|---|
| Em-A1 | High-speed blue-sensitive layer | 1.7 | 7.4 | 8.0 | 0 |
| Em-A2 | High-speed blue-sensitive layer | 1.7 | 14.4 | 8.0 | 0 |
| Em-A3 | High-speed blue-sensitive layer | 1.7 | 16.4 | 8.0 | 0 |
| Em-A4 | High-speed blue-sensitive layer | 1.7 | 18.8 | 2.7 | 0 |
| Em-A5 | High-speed blue-sensitive layer | 1.7 | 31.2 | 8.0 | 0 |
| Em-A6 | High-speed blue-sensitive layer | 1.7 | 25.8 | 9.0 | 0 |
| Em-A7 | High-speed blue-sensitive layer | 1.7 | 23.7 | 9.0 | 0 |
| Em-A8 | High-speed blue-sensitive layer | 1.7 | 23.7 | 9.0 | 0 |
| Em-A9 | High-speed blue-sensitive layer | 1.7 | 23.7 | 9.0 | 0 |
| Em-A10 | High-speed blue-sensitive layer | 1.7 | 26.4 | 9.5 | 0 |
| Em-A11 | High-speed blue-sensitive layer | 1.7 | 7.5 | 8.0 | 0 |
| Em-A12 | High-speed blue-sensitive layer | 1.7 | 14.6 | 8.0 | 0 |
| Em-A13 | High-speed blue-sensitive layer | 1.7 | 16.9 | 8.0 | 0 |
| Em-A14 | High-speed blue-sensitive layer | 1.7 | 19.5 | 2.7 | 0 |
| Em-A15 | High-speed blue-sensitive layer | 1.7 | 31.9 | 8.0 | 0 |
| Em-A16 | High-speed blue-sensitive layer | 1.7 | 26.5 | 9.0 | 0 |
| Em-A17 | High-speed blue-sensitive layer | 1.7 | 24.4 | 9.0 | 0 |
| Em-A18 | High-speed blue-sensitive layer | 1.7 | 24.4 | 9.0 | 0 |
| Em-A19 | High-speed blue-sensitive layer | 1.7 | 24.4 | 9.0 | 0 |
| Em-A20 | High-speed blue-sensitive layer | 1.7 | 28.0 | 9.5 | 0 |
| Em-B | Low-speed blue-sensitive layer | 1.0 | 12.2 | 10.0 | 0 |
| Em-C | Low-speed blue-sensitive layer | 0.7 | 1.0 | 4.0 | 1 |
| Em-D | Low-speed blue-sensitive layer | 0.4 | 3.5 | 4.1 | 2 |
| Em-E | layer for donating interlayer effect to red-sensitive layer | 1.1 | 20.6 | 6.7 | 0 |
| Em-F | Medium-speed green-sensitive layer | 1.2 | 18.0 | 6.9 | 0 |
| Em-G | Low- and medium-speed green-sensitive layers | 0.9 | 15.9 | 6.1 | 0 |
| Em-H | Low-speed green-sensitive layer | 0.7 | 8.0 | 6.0 | 2 |
| Em-I | Low-speed green-sensitive layer | 0.7 | 8.0 | 6.0 | 2 |
| Em-J | High-speed red-sensitive layer | 1.3 | 24.0 | 3.5 | 2 |
| Em-K | Medium-speed red-sensitive layer | 1.0 | 20.0 | 4.0 | 0 |
| Em-L | Medium-speed red-sensitive layer | 0.8 | 19.0 | 3.6 | 0 |
| Em-M | Low-speed red-sensitive layer | 0.6 | 8.9 | 2.9 | 2 |
| Em-N | Low-speed red-sensitive layer | 0.4 | 6.0 | 2.0 | 2 |
| Em-O | Low-speed red-sensitive layer | 0.3 | 3.0 | 1.0 | 2 |
| Em-P | High-speed green-sensitive layer | 1.3 | 23.0 | 3.7 | 2 |

1) Support

A support used in this example was prepared as follows.

100 parts by mass of polyethylene-2,6-naphthalate polymer and 2 parts by mass of Tinuvin P.326 (manufactured by Ciba-Geigy Corp.) as an ultraviolet absorbent were dried, melted at 300° C., and extruded from a T-die. The resultant material was longitudinally oriented by 3.3 times at 140° C., subsequently was laterally oriented by 3.3 times at 130° C., and then was thermally fixed at 250° C. for 6 seconds, thereby resulting in a 90 μm thick PEN (polyethylenenaphthalate) film. It is to be noted that proper amounts of blue, magenta, and yellow dyes (I-1, I-4, I-6, I-24, I-26, I-27 and II-5 described in Journal of Technical Disclosure No. 94-6023) were added to this PEN film. The PEN film was wound around a stainless steel core 20 cm in diameter and was given a thermal history of 110° C. for 48 hr, resulting in a support with a high resistance to curling.

2) Application of Undercoat Layer

The two surfaces of the above-described support were subjected to corona discharge, UV discharge, and glow discharge. After that, each surface of the support was coated with an undercoat solution (10 cc/m$^2$, by using a bar coater) consisting of 0.1 g/m$^2$ of gelatin, 0.01 g/m$^2$ of sodium α-sulfodi-2-ethylhexylsuccinate, 0.04 g/m$^2$ of salicylic acid, 0.2 g/m$^2$ of p-chlorophenol, 0.012 g/m$^2$ of $(CH_2{=}CHSO_2CH_2CH_2NHCO)_2CH_2$, and 0.02 g/m$^2$ of a polyamide-epichlorohydrin polycondensate, thereby forming an undercoat layer on a side at a high temperature upon orientation. Drying was performed at 115° C. for 6 minutes (all rollers and conveyors in the drying zone were set at 115° C.).

3) Application of Back Layers

One surface of the undercoated support was coated with an antistatic, magnetic recording, and slip layers having the following compositions as back layers.

3-1) Application of Antistatic Layer

The surface was coated with 0.2 g/m$^2$ of a dispersion (secondary aggregation grain size=about 0.08 μm) of a fine-grain powder, having a specific resistance of 5 Ω·cm, of a tin oxide-antimony oxide composite material with an average grain size of 0.005 μm, together with 0.05 g/m$^2$ of gelatin, 0.02 g/m$^2$ of $(CH_2{=}CHSO_2CH_2CH_2NHCO)_2CH_2$, 0.005 g/m$^2$ of poly(polymerization degree of 10)oxyethylene-p-nonylphenol, and resorcin.

3-2) Application of Magnetic Recording Layer 0.06 g/m$^2$ of cobalt-γ-iron oxide (specific area of 43 m$^2$/g, major axis of 0.14 μm, minor axis of 0.03 μm, saturation magnetization of 89 Am$^2$/kg, $Fe^{+2}/Fe^{+3}$=6/94, and the surface was treated with 2 wt % of iron oxide by aluminum oxide silicon oxide) coated with 3-poly(polymerization degree of 15)oxyethylene-propyloxytrimethoxysilane (15 wt %) was applied with a bar coater by use of 1.2 g/m$^2$ of diacetylcellulose (iron oxide was dispersed by an open kneader and sand mill), 0.3 g/m$^2$ of $C_2H_5C(CH_2OCONH—C_6H_3(CH_3)NCO)_3$ as a hardener and acetone, methyl ethyl ketone and cyclohexane as solvents, thereby resulting in a 1.2-μm thick magnetic recording layer. Additions of silica grains (0.3 μm) as a matting agent and aluminum oxide (0.15 μm) coated with 3-poly(polymerization degree of 15)oxyethylene-propyloxytrimethoxysilane (15 wt %) as a polishing agent were conducted so that the amounts thereof became 10 mg/m$^2$, respectively. Drying was performed at 115° C. for 6 minutes (all rollers and conveyors in the drying zone were set at 115° C.). The color density increase of DB of the magnetic recording layer determined by an X-light (blue filter) was about 0.1. The saturation magnetization moment, coercive force, and squareness ratio of the magnetic recording layer were 4.2 Am$^2$/kg, 7.3×10$^4$ A/m, and 65%, respectively.

3-3) Preparation of Slip Layer

Diacetylcellulose (25 mg/m$^2$) and a mixture of $C_6H_{13}CH(OH)C_{10}H_{20}COOC_{40}H_{81}$ (compound a, 6 mg/m$^2$)/$C_{50}H_{101}O(CH_2CH_2O)_{16}H$ (compound b, 9 mg/m$^2$) were applied. It is to be noted that this admixture was added in the form of a dispersion (average grain size 0.01 μm) in acetone prepared by melting the ingredients in xylene/propylenemonomethylether (1/1) at 105° C. to form a mixture, then pouring and dispersing the mixture in propylenemonomethylether (ten-fold amount) at room temperature and forming the dispersion in acetone. Additions of silica grains (0.3 μm) as a matting agent and aluminum oxide (0.15 μm) coated with 3-poly(polymerization degree of 15)oxyethylene-propyloxytrimethoxysilane (15 wt %) as a polishing agent were conducted so that the amounts thereof became 15 mg/m$^2$, respectively. Drying was performed at 115° C. for 6 minutes (all rollers and conveyors in the drying zone were set at 115° C.). The resultant slip layer was found to have excellent characteristics; the coefficient of kinetic friction was 0.06 (5 mmϕ stainless steel hard ball, load of 100 g, and speed of 6 cm/min), and the coefficient of static friction was 0.07 (by clip method). The coefficient of kinetic friction between an emulsion surface (described later) and the slip layer was 0.12.

4) Application of Sensitive Layers

Next, samples 101 to 120, which are color negative lightsensitive materials, were prepared by applying a plurality of layers having the following compositions to the surface, opposite to the back layers formed as above, of the support. That is, samples 101 to 120 were prepared by substituting emulsions Em-A1 to Em-A20, respectively, for silver iodobromide emulsion Em-A1 in the 14the layer.

Compositions of Photosensitive Layers

The main materials used in the individual layers are classified as follows.

ExC: Cyan coupler ExS: Spectral sensitizing dye

UV Ultraviolet absorbent

ExM: Magenta coupler HBS: High-boiling organic solvent

ExY: Yellow coupler H : Gelatin hardener (In the following description, practical compounds have numbers attached to their symbols. Formulas of these compounds will be presented later.)

The number corresponding to each component indicates the coating amount in units of g/m$^2$. The coating amount of silver halide is indicated by the amount of silver.

Sample 101

| | | |
|---|---|---|
| 1st layer (1st antihalation layer) | | |
| Black colloidal silver | silver | 0.155 |
| 0.07 μm AgBrI (2) | silver | 0.01 |
| Gelatin | | 0.87 |
| ExC-1 | | 0.002 |
| ExC-3 | | 0.002 |
| Cpd-2 | | 0.001 |
| HBS-1 | | 0.004 |
| S-37 | | 0.002 |
| 2nd layer (2nd antihalation layer) | | |
| Black colloidal silver | silver | 0.066 |
| Gelatin | | 0.407 |
| ExM-1 | | 0.050 |
| ExF-1 | | 0.002 |
| HBS-1 | | 0.074 |
| Solid disperse dye ExF-2 | | 0.015 |
| Solid disperse dye ExF-3 | | 0.020 |
| 3rd layer (Interlayer) | | |
| 0.07 μm AgBrI (2) | | 0.020 |
| ExC-2 | | 0.022 |
| Polyethylacrylate latex | | 0.085 |
| Gelatin | | 0.294 |
| 4th layer (Low-speed red-sensitive emulsion layer) | | |
| Silver iodobromide emulsion Em-N | silver | 0.065 |
| Silver iodobromide emulsion Em-N | silver | 0.100 |
| Silver iodobromide emulsion Em-O | silver | 0.158 |
| ExC-1 | | 0.109 |
| ExC-3 | | 0.044 |
| ExC-4 | | 0.072 |
| ExC-5 | | 0.011 |
| ExC-6 | | 0.003 |
| Cpd-2 | | 0.025 |
| Cpd-4 | | 0.025 |
| HBS-1 | | 0.17 |
| Gelatin | | 0.80 |
| 5th layer (Medium-speed red-sensitive emulsion layer) | | |
| Silver iodobromide emulsion Em-K | silver | 0.21 |
| Silver iodobromide emulsion Em-L | silver | 0.62 |
| ExC-1 | | 0.14 |
| ExC-2 | | 0.026 |
| ExC-3 | | 0.020 |
| ExC-4 | | 0.12 |
| ExC-5 | | 0.016 |
| ExC-6 | | 0.007 |
| Cpd-2 | | 0.036 |
| Cpd-4 | | 0.028 |
| HBS-1 | | 0.16 |
| Gelatin | | 1.18 |
| 6th layer (High-speed red-sensitive emulsion layer) | | |
| Silver iodobromide emulsion Em-J | silver | 1.67 |
| ExC-1 | | 0.18 |
| ExC-3 | | 0.07 |
| ExC-6 | | 0.047 |
| Cpd-2 | | 0.046 |
| Cpd-4 | | 0.077 |
| HBS-1 | | 0.37 |
| Gelatin | | 2.12 |
| 7th layer (Interlayer) | | |
| Cpd-1 | | 0.089 |
| Solid disperse dye ExF-4 | | 0.030 |
| HBS-1 | | 0.050 |
| Polyethylacrylate latex | | 0.83 |
| Gelatin | | 0.84 |

-continued

| | | |
|---|---|---|
| 8th layer (Interlayer effect donor layer (layer for donating interlayer effect to red-sensitive layer)) | | |
| Silver iodobromide emulsion Em-E | silver | 0.560 |
| Cpd-4 | | 0.030 |
| ExM-2 | | 0.096 |
| ExM-3 | | 0.028 |
| ExY-1 | | 0.031 |
| ExG-1 | | 0.006 |
| HBS-1 | | 0.085 |
| HBS-3 | | 0.003 |
| Gelatin | | 0.58 |
| 9th layer (Low-speed green-sensitive emulsion layer) | | |
| Silver iodobromide emulsion Em-G | silver | 0.39 |
| Silver iodobromide emulsion Em-H | silver | 0.28 |
| Silver iodobromide emulsion Em-I | silver | 0.35 |
| ExM-2 | | 0.36 |
| ExM-3 | | 0.045 |
| ExG-1 | | 0.005 |
| HBS-1 | | 0.028 |
| HBS-2 | | 0.01 |
| S-2 | | 0.27 |
| Gelatin | | 1.39 |
| 10th layer (Medium-speed green-sensitive emulsion layer) | | |
| Silver iodobromide emulsion Em-F | silver | 0.20 |
| Silver iodobromide emulsion Em-G | silver | 0.25 |
| ExC-6 | | 0.009 |
| ExM-2 | | 0.031 |
| ExM-3 | | 0.029 |
| ExY-1 | | 0.006 |
| ExM-4 | | 0.028 |
| ExG-1 | | 0.005 |
| HBS-1 | | 0.064 |
| HBS-2 | | $2.1 \times 10^{-3}$ |
| Gelatin | | 0.44 |
| 11th layer (High-speed green-sensitive emulsion layer) | | |
| Silver iodobromide emulsion Em-P | silver | 1.200 |
| ExC-6 | | 0.004 |
| ExM-1 | | 0.016 |
| ExM-3 | | 0.036 |
| ExM-4 | | 0.020 |
| ExM-5 | | 0.004 |
| ExY-5 | | 0.008 |
| ExM-2 | | 0.013 |
| Cpd-4 | | 0.007 |
| HBS-1 | | 0.18 |
| Polyethylacrylate latex | | 0.099 |
| Gelatin | | 1.11 |
| 12th layer (Yellow filter layer) | | |
| Yellow colloid silver | silver | 0.047 |
| Cpd-1 | | 0.16 |
| ExF-5 | | 0.010 |
| Solid disperse dye ExF-6 | | 0.010 |
| HBS-1 | | 0.082 |
| Gelatin | | 1.057 |
| 13th layer (Low-speed blue-sensitive emulsion layer) | | |
| Silver iodobromide emulsion Em-B | silver | 0.18 |
| Silver iodobromide emulsion Em-C | silver | 0.20 |
| Silver iodobromide emulsion Em-D | silver | 0.07 |
| ExC-1 | | 0.041 |
| ExC-8 | | 0.012 |
| ExY-1 | | 0.035 |
| ExY-2 | | 0.71 |

-continued

| | | |
|---|---|---|
| ExY-3 | | 0.10 |
| ExY-4 | | 0.005 |
| Cpd-2 | | 0.10 |
| Cpd-3 | | $4.0 \times 10^{-3}$ |
| HBS-1 | | 0.24 |
| Gelatin | | 1.41 |
| 14th layer (High-speed blue-sensitive emulsion layer) | | |
| Silver iodobromide emulsion Em-A1 | silver | 0.75 |
| ExC-1 | | 0.013 |
| ExY-2 | | 0.31 |
| ExY-3 | | 0.05 |
| ExY-6 | | 0.062 |
| Cpd-2 | | 0.075 |
| Cpd-3 | | $1.0 \times 10^{-3}$ |
| HBS-1 | | 0.10 |
| Gelatin | | 0.91 |
| 15th layer (1st protective layer) | | |
| 0.07 μm AgBrI (2) | silver | 0.30 |
| UV-1 | | 0.21 |
| UV-2 | | 0.13 |
| UV-3 | | 0.20 |
| UV-4 | | 0.025 |
| F-11 | | 0.009 |
| F-18 | | 0.005 |
| F-19 | | 0.005 |
| HBS-1 | | 0.12 |
| S-2 | | $5.0 \times 10^{-2}$ |
| Gelatin | | 2.3 |
| 16th layer (2nd protective layer) | | |
| H-1 | | 0.40 |
| B-1 (diameter 1.7 μm) | | $5.0 \times 10^{-2}$ |
| B-2 (diameter 1.7 μm) | | 0.15 |
| B-3 | | 0.05 |
| S-1 | | 0.20 |
| Gelatin | | 0.75 |

In addition to the above components, to improve the storage stability, processability, resistance to pressure, antiseptic and mildewproofing properties, antistatic properties, and coating properties, the individual layers contained B-4 to B-6, F-1 to F-18, iron salt, lead salt, gold salt, platinum salt, palladium salt, iridium salt, and rhodium salt. A sample was prepared by adding $8.5\times10^{-3}$ g and $7.9\times10^{-3}$ g, per mol of silver halide, of calcium in the form of an aqueous calcium nitrate solution to the coating solutions of the 8the and 11the layers, respectively. Furthermore, to improve the antistatic properties, at least one kind of W-1, W-6, W-7 and W-8 is contained, and to improve the coating properties, at least one kind of W-2 and W-5 are contained. Preparation of organic solid dispersion dye ExF-3 was dispersed by the following method. That is, 21.7 mL of water, 3 mL of a 5% aqueous solution of sodium p-octylphenoxyethoxyethoxyethanesulfonate, and 0.5 g of a 5% aqueous solution of p-octylphenoxypolyoxyethyleneether (polymerization degree of 10) were placed in a 700-mL pocket mill, and 5.0 g of dye ExF-3 and 500 mL of zirconium oxide beads (diameter 1 mm) were added to the mill. The contents were dispersed for 2 hours. This dispersion was done by using a BO type oscillating ball mill manufactured by Chuo Koki K. K. The dispersion was removed from the mill and added with 8 g of a 12.5% aqueous solution of gelatin. The beads were removed from the resultant material by filtration, resulting in a gelatin dispersion of the dye. The average grain size of the fine dye grains was 0.44 μm.

In the same manner as that described above, a solid dispersion of ExF-4 was obtained. The average grain size of the fine dye grains was 0.24 μm. ExF-2 was dispersed by a microprecipitation dispersion method described in Example 1 of European Patent 549,489A. The average grain size was found to be 0.06 μm.

Solid dispersion of dye of ExF-6 was dispersed by the following method.

4,000 g of Water and 376 g of 3% solution of W-2 were added to 2,800 g of a wet cake of E-6 containing 18 mass % of water, and the resultant material was stirred to form a slurry having an ExF-6 concentration of 32 mass %. Next, the Ultra Visco Mill (UVM-2) manufactured by Imex K.K. was filled with 1,700 mL of zirconia beads with an average grain size of 0.5 mm, and the slurry was milled through the UVM-2 at a peripheral speed of approximately 10 m/sec and a discharge rate of 0.5 L/min for 8 hr, thereby obtaining a solid fine-grain dispersion of ExF-6. The average grain size was 0.45 μm.

Compounds used in the formation of each layer were as follows.

ExC-1

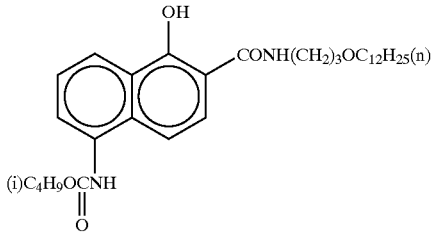

ExC-2

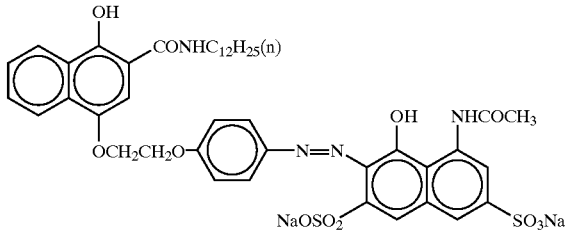

ExC-3

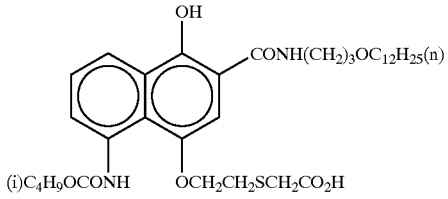

ExC-4

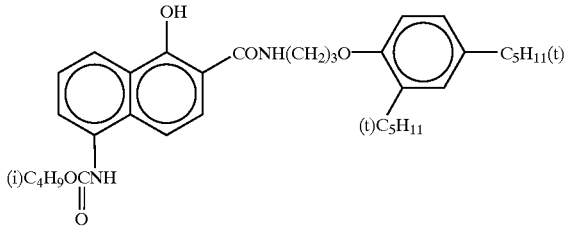

ExC-5

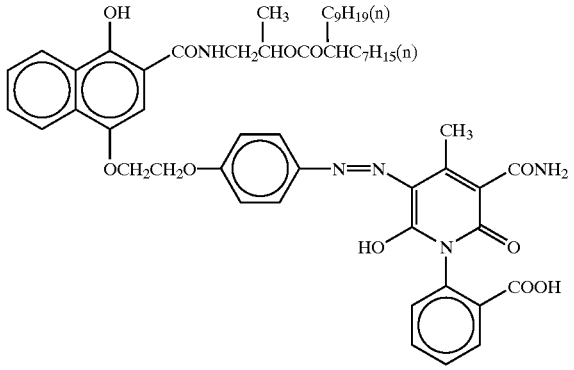

ExC-6

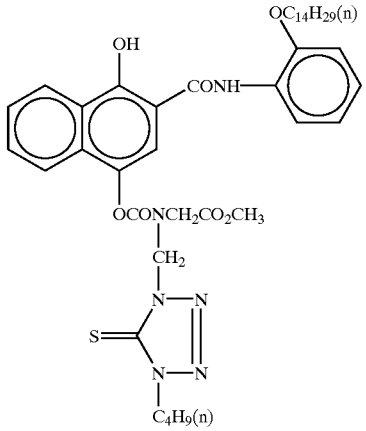

ExC-8

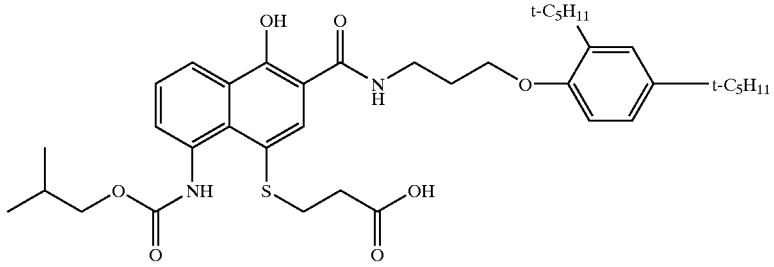

-continued
ExM-1
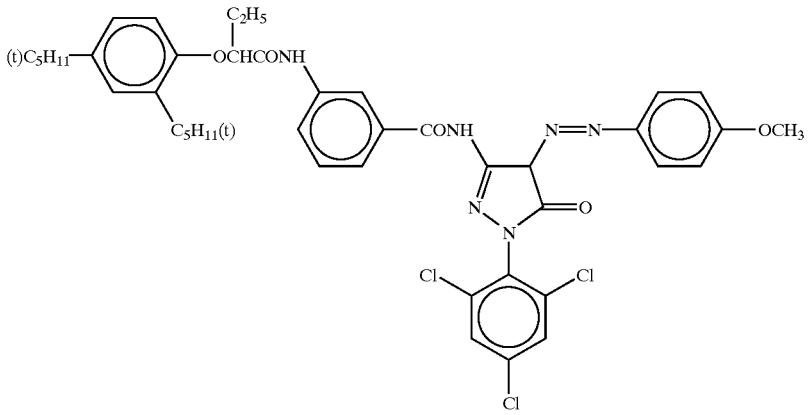
ExM-2
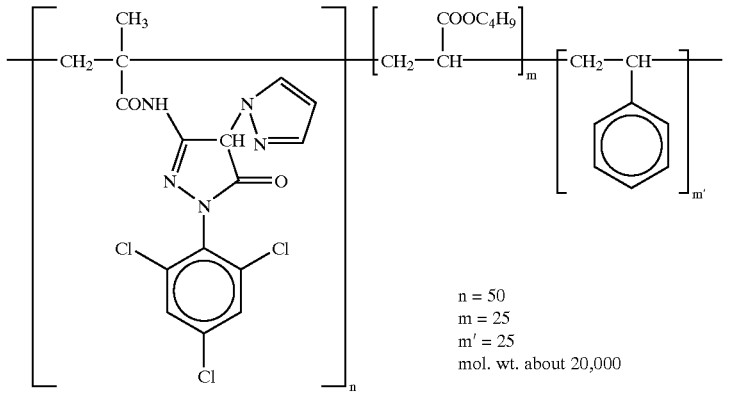
n = 50
m = 25
m′ = 25
mol. wt. about 20,000
ExM-3
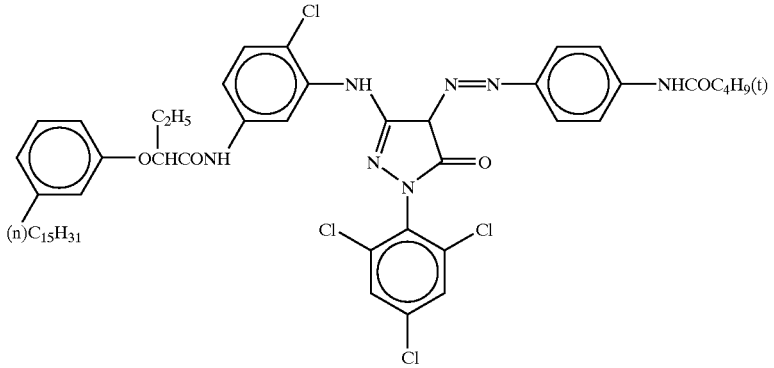
ExM-4
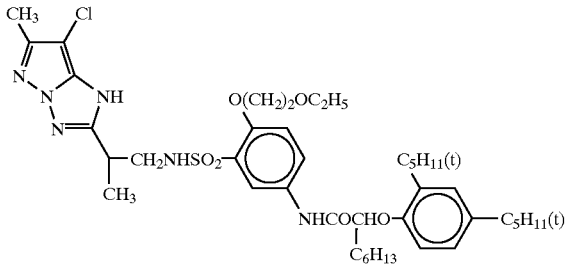
ExM-5
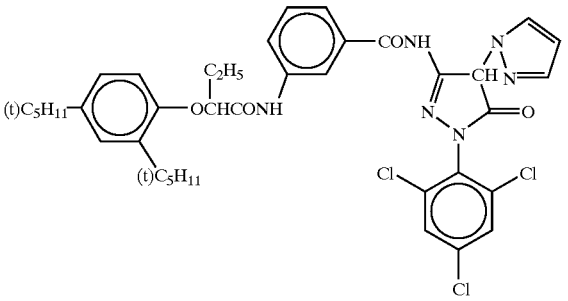

-continued
ExY-1
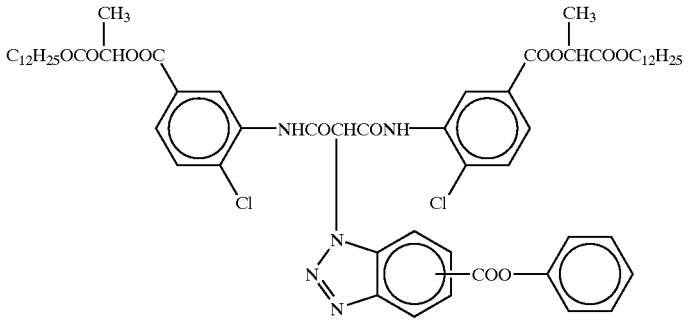
ExY-2
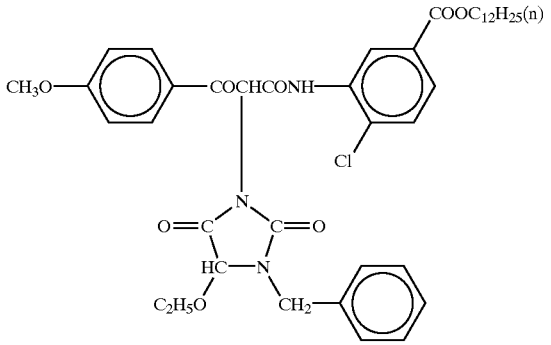
ExY-3
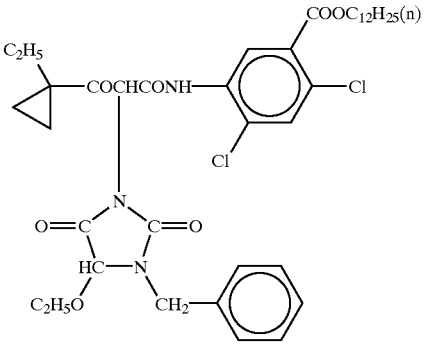
ExY-4
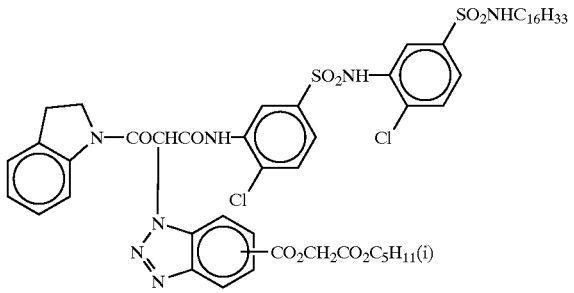
ExY-5
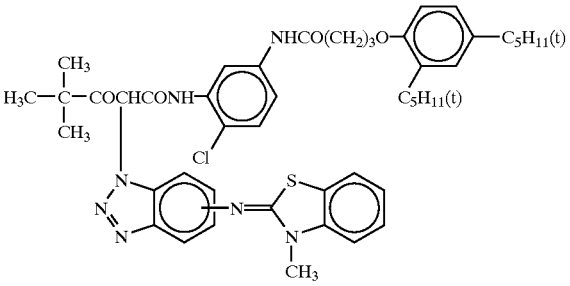
ExG-1
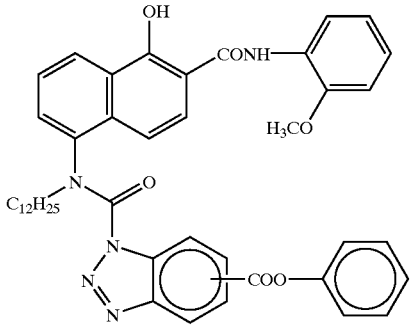
ExY-6
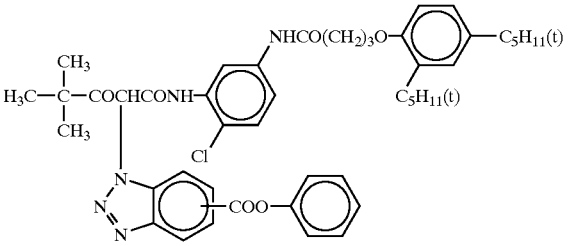

-continued
ExF-1
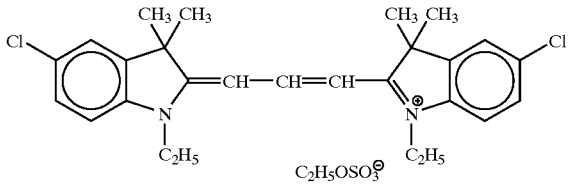
ExF-2
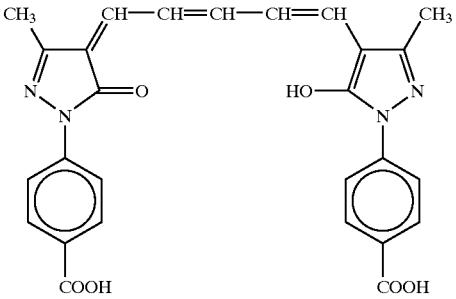
ExF-3
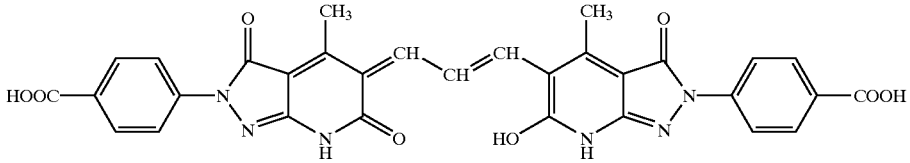
ExF-4
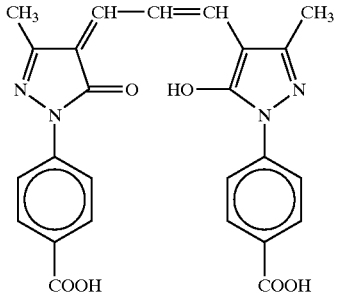
Exf-5
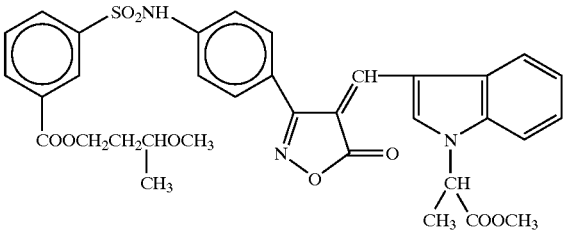
ExF-6
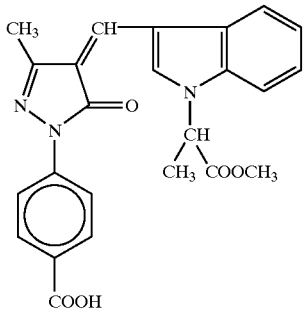
Cpd-1
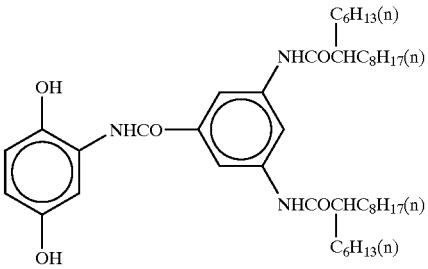
Cpd-2
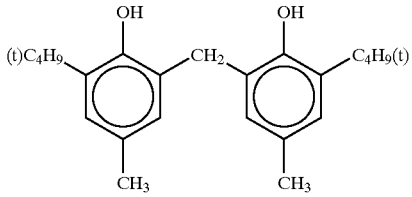
Cpd-3
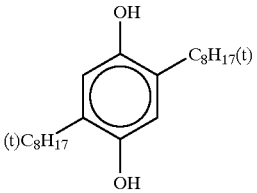
Cpd-4
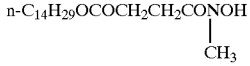
UV-1
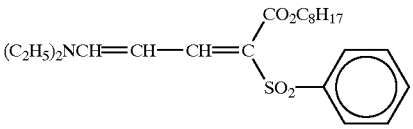

-continued
UV-2
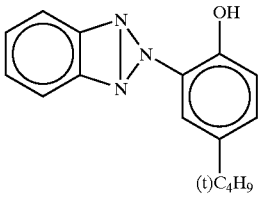
UV-3
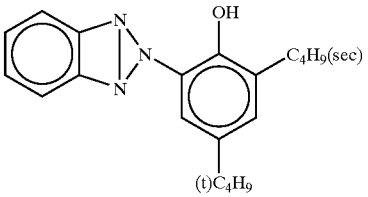
UV-4
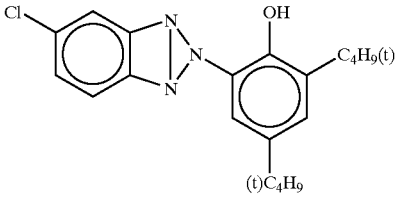
HBS-1
Tricresyl phosphate
HBS-2
Di-n-butyl phthalate
HBS-3
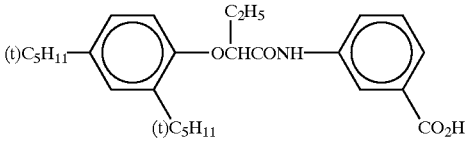
H-1
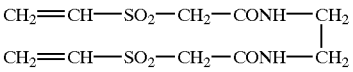
S-1
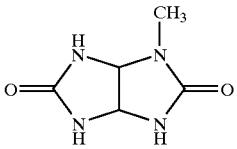
B-1
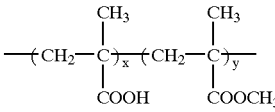
x/y = 10/90 (mass ratio)
Average molecular: about 35,000
B-2
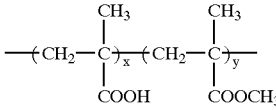
x/y = 40/60 (mass ratio)
Average molecular: about 20,000
B-3
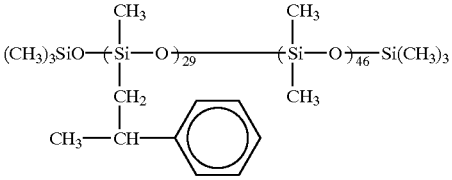
(molar ratio)
Average molecular: about 8,000
B-4
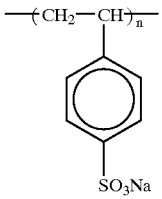
Average molecular: about 750,000
B-5
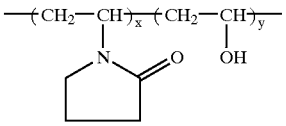
x/y = 70/30 (mass ratio)
Average molecular: about 17,000
B-6
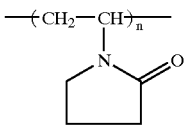
Average molecular: about 10,000
W-1
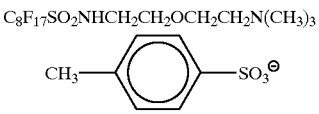
W-2
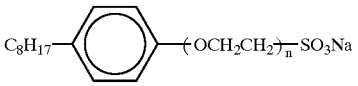
n = 2 to 4
W-5
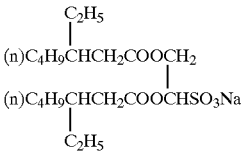

$C_8F_{17}SO_2NHCH_2CH_2CH_2\overset{\oplus}{N}(CH_3)_3\ I^{\ominus}$
$C_8F_{17}SO_2\overset{C_3H_7}{\overset{|}{N}}CH_2COOK$
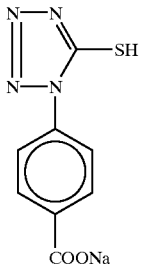
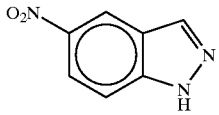
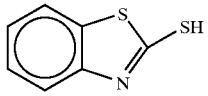
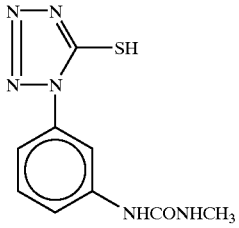
$(n)C_6H_{13}NH$ 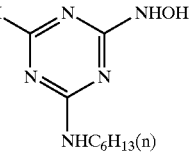 $NHOH$
$NHC_6H_{13}(n)$
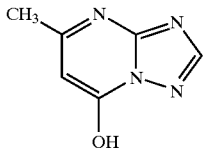
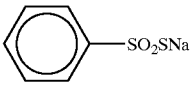
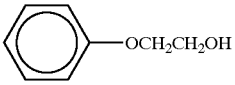
-continued
W-6
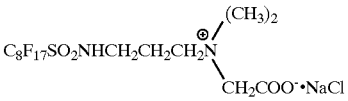
W-7
W-8
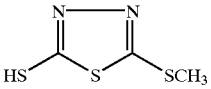
F-1
F-2
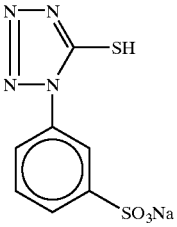
F-3
F-4
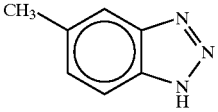
F-5
F-6
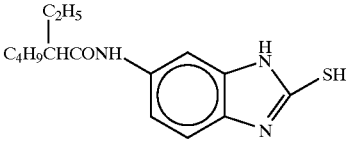
F-7
F-8
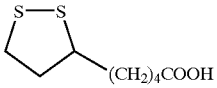
F-9
F-10
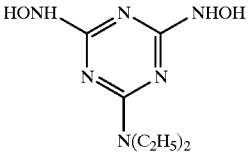
F-11
F-12
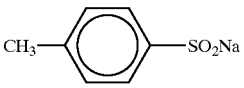
F-13
F-14
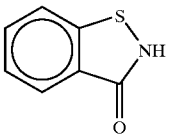
F-15
F-16
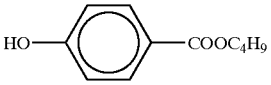
F-17

-continued

F-18

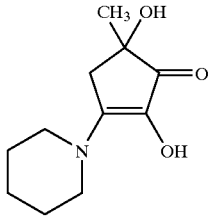

$O{=}P(OCH_2CHC_4H_9)_3$
$C_2H_5$

F-19

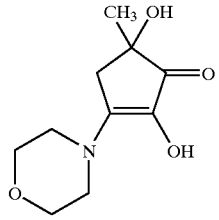

S-2

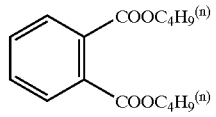

S-37

The method for evaluating the samples is as follow. The samples were exposed for 1/100 seconds through an SC-39 gelatin filter (a long-wavelength light transmitting filter having a cutoff wavelength of 390 nm) manufactured by Fuji Photo Film Co., Ltd. and through a continuous wedge. Development was performed as follows by using an FP-360B automatic processor manufactured by Fuji Photo Film Co., Ltd. It is to be noted that the FP-360B was modified such that an overflow solution from a bleaching bath was entirely discharged to a waste solution tank without being supplied to the subsequent bath. This FP-360B has evaporation correcting means described in JIII Journal of Technical Disclosure No. 94-4992.

The processing steps and the processing solution compositions are presented below.

(Processing steps)

| Step | Time | Temperature | Replenishment rate* | Tank volume |
|---|---|---|---|---|
| Color development | 3 min 5 sec | 37.8° C. | 20 mL | 11.5 L |
| Bleaching | 50 sec | 38.0° C. | 5 mL | 5 L |
| Fixing (1) | 50 sec | 38.0° C. | — | 5 L |
| Fixing (2) | 50 sec | 38.0° C. | 8 mL | 5 L |
| Washing | 30 sec | 38.0° C. | 17 mL | 3 L |
| Stabilization (1) | 20 sec | 38.0° C. | — | 3 L |
| Stabilization (2) | 20 sec | 38.0° C. | 15 mL | 3 L |
| Drying | 1 min 30 sec | 60.0° C. | | |

*The replenishment rate was per 1.1 m of a 35-mm wide light-sensitive material (equivalent to one 24 Ex. 1)

The stabilizer and fixer were returned from (2) to (1) by counterflow, and the overflow of washing water was entirely introduced to the fixing bath (2). Note that the amounts of the developer, bleaching solution, and fixer carried over to the bleaching step, fixing step, and washing step were 2.5 mL, 2.0 mL, and 2.0 mL, respectively, per 1.1 m of a 35-mm wide light-sensitive material. Note also that each crossover time was 6 sec, and this time was included in the processing time of each preceding step.

The aperture areas of the processor were 100 $cm^2$ for the color developer, 120 $cm^2$ for the bleaching solution, and about 100 $cm^2$ for the other processing solutions.

The compositions of the processing solutions are presented below.

| (Color developer) | Tank solution (g) | Replenisher (g) |
|---|---|---|
| Diethylenetriamine pentaacetic acid | 3.0 | 3.0 |
| Disodium cathecol-3,5-disulfonate | 0.3 | 0.3 |
| Sodium sulfite | 3.9 | 5.3 |
| Potassium carbonate | 39.0 | 39.0 |
| Disodium-N,N-bis(2-sulfonateethyl) hydroxylamine | 1.5 | 2.0 |
| Potassium bromide | 1.3 | 0.3 |
| Potassium iodide | 1.3 mg | — |
| 4-hydroxy-6-methyl-1,3,3a,7-tetrazaindene | 0.05 | — |
| Hydroxylamine sulfate | 2.4 | 3.3 |
| 2-methyl-4-[N-ethyl-N-(β-hydroxyethyl)amino-] aniline sulfate | 4.5 | 6.5 |
| Water to make | 1.0 L | 1.0 L |
| pH (adjusted by potassium hydroxide and sulfuric acid) | 10.05 | 10.18 |

| (Bleaching solution) | Tank solution (g) | Replenisher (g) |
|---|---|---|
| Ferric ammonium 1,3-diaminopropanetetra acetate monohydrate | 113 | 170 |
| Ammonium bromide | 70 | 105 |
| Ammonium nitrate | 14 | 21 |
| Succinic acid | 34 | 51 |
| Maleic acid | 28 | 42 |
| Water to make | 1.0 L | 1.0 L |
| pH (adjusted by ammonia water) | 4.6 | 4.0 |

Fixing (1) Tank Solution

A 5:95 (volume ratio) mixture of the above bleaching tank solution and the following fixing tank solution.

| (pH 6.8) | | |
|---|---|---|
| (Fixing (2)) | Tank solution (g) | Replenisher (g) |
| Aqueous ammonium thiosulfate solution (750 g/L) | 240 mL | 720 mL |
| Imidazole | 7 | 21 |
| Ammonium methane thiosulfonate | 5 | 15 |
| Ammonium methane sulfinate | 10 | 30 |
| Ethylenediamine tetraacetic acid | 13 | 39 |
| Water to make | 1.0 L | 1.0 L |
| pH (adjusted by ammonia water and acetic acid) | 7.4 | 7.45 |

Washing Water

Tap water was supplied to a mixed-bed column filled with an H type strongly acidic cation exchange resin (Amberlite IR-120B: available from Rohm & Haas Co.) and an OH type strongly basic anion exchange resin (Amberlite IR-400) to set the concentrations of calcium and magnesium to be 3 mg/L or less. Subsequently, 20 mg/L of sodium isocyanuric acid dichloride and 150 mg/L of sodium sulfate were added. The pH of the solution ranged from 6.5 to 7.5.

| (Stabilizer) common to tank solution and replenisher (g) | |
|---|---|
| Sodium p-toluenesulfinate | 0.03 |
| Polyoxyethylene-p-mononylphenylether (average polymerization degree 10) | 0.2 |
| 1,2-benzoisothiazoline-3-one · sodium | 0.10 |
| Disodium ethylenediaminetetraacetate | 0.05 |
| 1,2,4-triazole | 1.3 |
| 1,4-bis(1,2,4-triazole-1-isomethyl) piperazine | 0.75 |
| Water to make | 1.0 L |
| pH | 8.5 |

The above-described treatment was applied to samples 101 to 120. The density of each sample treated was measured through a blue filter to evaluate its photographic properties. The results obtained are shown in Table 3.

TABLE 3

| Sample | Emulsion | Sensitivity* | Granularity* | Remark |
|---|---|---|---|---|
| 101 | Em-A1 | 100 | 100 | Comp. |
| 102 | Em-A2 | 113 | 98 | Comp. |
| 103 | Em-A3 | 117 | 135 | Inv. |
| 104 | Em-A4 | 95 | 140 | Comp. |
| 105 | Em-A5 | 128 | 133 | Inv. |
| 106 | Em-A6 | 192 | 137 | Inv. |
| 107 | Em-A7 | 198 | 138 | Inv. |
| 108 | Em-A8 | 201 | 140 | Inv. |
| 109 | Em-A9 | 253 | 143 | Inv. |
| 110 | Em-A10 | 251 | 145 | Inv. |
| 111 | Em-A11 | 100 | 103 | Comp. |
| 112 | Em-A12 | 114 | 100 | Inv. |
| 113 | Em-A13 | 118 | 138 | Inv. |
| 114 | Em-A14 | 97 | 145 | Comp. |
| 115 | Em-A15 | 129 | 135 | Inv. |
| 116 | Em-A16 | 194 | 139 | Inv. |
| 117 | Em-A17 | 199 | 140 | Inv. |
| 118 | Em-A18 | 204 | 144 | Inv. |
| 119 | Em-A19 | 255 | 148 | Inv. |
| 120 | Em-A20 | 252 | 150 | Inv. |

*The sensitivity and granularity were indicated as relative values in the case where each value of sample 101 was regarded as 100. The bigger these numbers, the better the sensitivity or granularity.

As Table 3 shows, the samples using the emulsions of the present invention have both improved graininess and higher sensitivities in comparison to the referential samples.

The present invention can provide a silver halide light-sensitive material excellent in sensitivity and graininess by using a silver halide emulsion that has a silver iodide content of 7 mol % or more and is of good monodisperse.

What is claimed is:

1. A silver halide emulsion containing a dispersion medium and silver halide grains, wherein the silver halide grains have a variation coefficient of projected area diameters of 30% or less and 50% or more of the total projected area of the silver halide grains is occupied by silver halide grains satisfying the following requirements (a), (b), (c) and (d):

(a) a hexagonal tabular silver halide grain having a smooth (111) face as a principal plane;

(b) the silver iodide content is 7 mol % or more;

(c) the projected area diameter is 3 $\mu$m or more; and (d) the aspect ratio is 8 or more, wherein the silver halide grains occupying 50% or more of the total projected area satisfy requirement (e) below as well as requirements of from (a) to (d):

(e) the ratios of the areas of (100) faces relative to the average area of the side surface calculated from the average projected area and the average thickness of all the grains are 50% or more.

2. The silver halide emulsion according to claim 1, wherein the silver halide grains occupying 50% or more of the total projected area satisfy requirement (f) below as well as requirements of from (a) to (e):

(f) the equivalent-sphere diameter is 1.2 $\mu$m or more.

3. The silver halide emulsion according to claim 1, wherein the silver halide grains occupying 50% or more of the total projected area satisfy requirement (g) below as well as requirements of from (a) to (e):

(g) the grains have at least ten dislocation lines per grain.

4. The silver halide emulsion according to claim 2, wherein the silver halide grains occupying 50% or more of the total projected area satisfy requirement (g) below as well as requirements of from (a) to (f):

(g) the grains have at least ten dislocation lines per grain.

5. The silver halide emulsion according to claim 1, wherein the silver halide grains occupying 50% or more of the total projected area satisfy requirement (h) below as well as requirements of from (a) to (e):

(h) the grains have, in their vertex portions and/or peripheral portions and/or principal plane portions, at least one epitaxial junction per grain.

6. The silver halide emulsion according to claim 2, wherein the silver halide grains occupying 50% or more of the total projected area satisfy requirement (h) below as well as requirements of from (a) to (f):

(h) the grains have, in their vertex portions and/or peripheral portions and/or principal plane portions, at least one epitaxial junction per grain.

7. The silver halide emulsion according to claim 3, wherein the silver halide grains occupying 50% or more of the total projected area satisfy requirement (h) below as well as requirements of from (a) to (e) and (g):

(h) the grains have, in their vertex portions and/or peripheral portions and/or principal plane portions, at least one epitaxial junction per grain.

8. The silver halide emulsion according to claim 4, wherein the silver halide grains occupying 50% or more of the total projected area satisfy requirement (h) below as well as requirements of from (a) to (g):

(h) the grains have, in their vertex portions and/or peripheral portions and/or principal plane portions, at least one epitaxial junction per grain.

* * * * *